US008132897B2

(12) United States Patent
Kojima et al.

(10) Patent No.: US 8,132,897 B2
(45) **Date of Patent: *Mar. 13, 2012**

(54) LIQUID-DROPLET JETTING APPARATUS AND LIQUID-DROPLET JETTING HEAD

(75) Inventors: Masatomo Kojima, Ichinomiya (JP); Yasuhiro Sekiguchi, Nagoya (JP); Masashi Ono, Okazaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 434 days.

This patent is subject to a terminal disclaimer.

(21) Appl. No.: 12/286,173

(22) Filed: Sep. 29, 2008

(65) Prior Publication Data

US 2009/0096844 A1 Apr. 16, 2009

(30) Foreign Application Priority Data

Sep. 29, 2007 (JP) ..... 2007-256922
Mar. 31, 2008 (JP) ..... 2008-094150

(51) Int. Cl.
*B41J 2/045* (2006.01)

(52) U.S. Cl. ..... 347/72; 347/68

(58) Field of Classification Search ..... 347/68–72
See application file for complete search history.

(56) References Cited

U.S. PATENT DOCUMENTS

| | | | | |
|---|---|---|---|---|
| 6,450,626 | B2 | 9/2002 | Ikeda et al. | |
| 6,863,383 | B2 * | 3/2005 | Takahashi | 347/72 |
| 6,993,812 | B2 * | 2/2006 | Takahashi | 29/25.35 |
| 7,073,894 | B2 | 7/2006 | Isono et al. | |
| 2003/0107622 | A1 | 6/2003 | Sugahara | |
| 2003/0142173 | A1 | 7/2003 | Takahashi | |
| 2005/0068380 | A1 | 3/2005 | Ito | |
| 2005/0231073 | A1 | 10/2005 | Sugahara et al. | |
| 2006/0038859 | A1 | 2/2006 | Sugahara | |
| 2006/0152556 | A1 | 7/2006 | Sugahara | |
| 2007/0109363 | A1 | 5/2007 | Ito | |
| 2007/0222825 | A1 | 9/2007 | Takahashi | |
| 2009/0085984 | A1 * | 4/2009 | Kojima | 347/68 |

FOREIGN PATENT DOCUMENTS

| | | |
|---|---|---|
| EP | 08017146.5 | 2/2009 |
| JP | 2001179969 | 7/2001 |
| JP | 2002019113 | 1/2002 |
| JP | 2002-240273 | 8/2002 |
| JP | 2002254640 | 9/2002 |
| JP | 2003-224312 | 8/2003 |
| JP | 2003-224312 | 6/2004 |
| JP | 2005-59551 | 3/2005 |
| JP | 2005-096350 | 4/2005 |
| JP | 2005-317952 | 11/2005 |

* cited by examiner

*Primary Examiner* — Geoffrey Mruk
(74) *Attorney, Agent, or Firm* — Frommer Lawrence & Haug LLP

(57) ABSTRACT

A piezoelectric actuator includes first active portions corresponding to center portions in a row direction of pressure chambers and second active portions corresponding to left and right portions on outer peripheral sides which are more outside than the center portions of the pressure chambers. When applying voltage to the first active portions, the first active portions deform to project toward pressure chambers. At this time, the second active portions do not deform and the influence of deformation of the first active portions does not reach the adjacent pressure chambers. Accordingly, effect of suppressing crosstalk is exhibited.

16 Claims, 71 Drawing Sheets

A = 0V

A = 20V

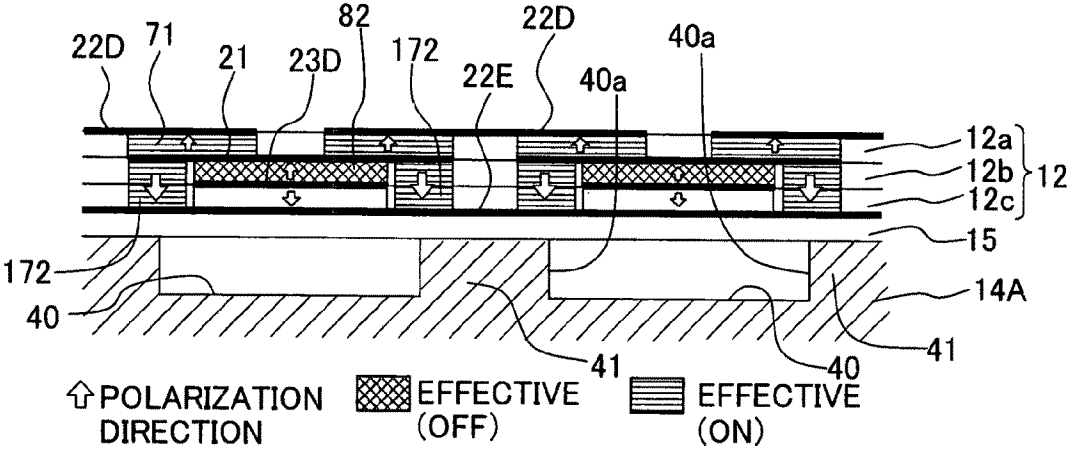
Fig. 33A
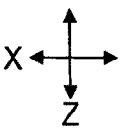
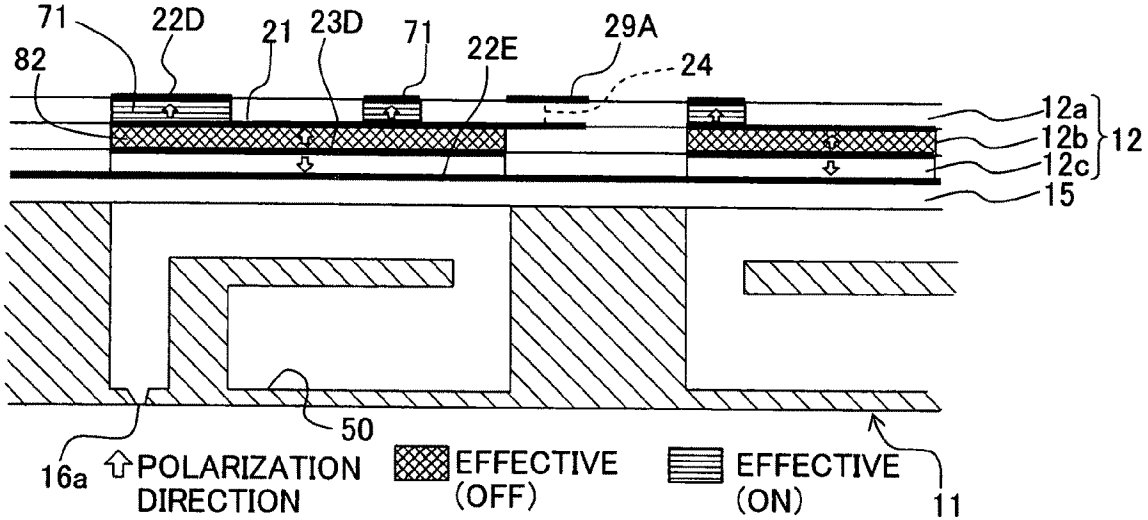
Fig. 33B
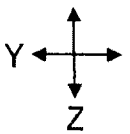

A = 0V

A = 20V

LIQUID-DROPLET JETTING APPARATUS AND LIQUID-DROPLET JETTING HEAD

CROSS-REFERENCE TO RELATED APPLICATIONS

This application claims priority from Japanese Patent Applications No. 2007-256922, filed on Sep. 29, 2007 and No. 2008-094150 filed on Mar. 31, 2008, the disclosures of which are incorporated herein by reference in its entirety.

BACKGROUND OF THE INVENTION

1. Field of the Invention

The present invention relates to a liquid-droplet jetting apparatus such as an ink-jet printer and a liquid-droplet jetting head such as an ink-jet head.

2. Description of the Related Art

Conventionally, as one of liquid-droplet jetting apparatuses, there is known an ink-jet printer provided with an ink-jet head having a cavity unit in which a plurality of pressure chambers are formed regularly and a piezoelectric actuator joined to the cavity unit for selectively jetting ink in the pressure chambers, and a voltage application mechanism for applying a voltage to the piezoelectric actuator. Then, as the piezoelectric actuator described above, there are known one using a vertical effect actuator of stacked type (see, for example, Japanese Patent Application Laid-open No. 2005-59551), and one using a unimorph actuator (see, for example, Japanese Patent Application Laid-open No. 2005-317952.

There are demands for increasing the density of the pressure chambers to secure high image quality or high quality of recording by increasing the number of nozzles in the ink-jet head of such an ink-jet printer. When the pressure chambers are arranged with high density, the distance between adjacent pressure chambers becomes short, and thus the influence to adjacent pressure chambers, a problem of so-called crosstalk occurs while driving.

Specifically, as shown in FIGS. 69, 70 for example, the ink-jet head is formed such that a piezoelectric actuator 912 formed of three piezoelectric material layers 912*a*, 912*b*, 912*c* are joined on an upper side of a cavity unit 914, in which pressure chambers 940 are formed regularly, via a binding plate 915. Then individual electrodes 921 corresponding to the pressure chambers 940 are provided on a side of an upper surface of the piezoelectric material layer 912*a*, and constant potential electrodes 922 (ground potential) are provided on a side of a lower surface of the piezoelectric material layer 912*a*. Further, individual electrodes 921 and constant potential electrodes 922 are provided on an upper surface side and a lower surface side of the piezoelectric material layer 912*c*, respectively. With such a structure, regions (piezoelectric material layers) sandwiched between the individual electrodes 921 and the constant potential electrodes 922 function as active portions S where volumes of the pressure chambers 940 are changed by applying positive potential selectively to the individual electrodes 921 so as to jet ink from nozzle holes 914*b*. Such deformation for jetting ink affects not only the pressure chambers jetting ink but also the pressure chambers 940 adjacent to these pressure chambers 940 by deformation of the piezoelectric material layers 912*a* to 912*c*, as shown in FIG. 71.

Accordingly, there has been occurring a problem of fluctuation of jetting characteristics for the adjacent pressure chambers 940 (for example, a problem that unintended jetting of ink occurs from the nozzle holes 914*b*), namely, a problem of crosstalk.

To solve such a problem of crosstalk, various measures have been proposed. For example, in Japanese Patent Application Laid-open No. 2002-254640 (FIG. 2), there is described a structure in which a beam portion 100 is provided across partition walls 11 on both sides in a width direction of each pressure generating chamber 12 so as to improve the rigidity of the partition walls 11, and thereby occurrence of crosstalk is prevented between adjacent pressure generating chambers.

Further, in Japanese Patent Application Laid-open No. 2002-19113 (FIG. 1), there is described a structure in which an elastic body 7 having a predetermined depth from a nozzle plate 3 and a predetermined width is disposed on a side wall 5 that separates each pressurizing liquid chamber 4, thereby decreasing mechanical crosstalk.

However, these measures are becoming no longer perfect as the increase in density of the pressure chambers (ink jetting ch) proceeds.

SUMMARY OF THE INVENTION

An object of the present invention is to provide a liquid-droplet jetting apparatus and a liquid-droplet jetting head capable of suppressing crosstalk without increasing the number of individual electrodes, namely, the number of signal lines when structured with high density.

According to a first aspect of the present invention, there is provided a liquid-droplet jetting apparatus which jets droplets of a liquid, including:

a liquid-droplet jetting head including a cavity unit in which a plurality of pressure chambers arranged regularly are formed and a piezoelectric actuator which is joined to the cavity unit to cover the pressure chambers and which jets the liquid in the pressure chambers selectively, the piezoelectric actuator having first active portions each corresponding to a center portion of one of the pressure chambers and second active portions each corresponding to an outer peripheral portion, of one of the pressure chambers, which covers a portion located outside of the center portion of one of the pressure chambers; and a voltage application mechanism which applies a voltage to the piezoelectric actuator;

wherein the first active portions and the second active portions expand in a first direction toward the pressure chambers and contract in a second direction orthogonal to the first direction when the voltage is applied to the first and second active portions by the voltage application mechanism; and when a first voltage is applied to the first active portions the voltage application mechanism does not apply a second voltage to the second active portions, and when the first voltage is not applied to the first active portions the voltage application mechanism applies the second voltage to the second active portions.

Here, the "active portions" means portions which turn to a deformation state or a non-deformation state by application/non-application of voltage. Further, the "second active portions" include, besides the case of existing across portions corresponding to pressure chambers and portions corresponding to beam portions between the pressure chambers, the case of existing only in the portions corresponding to beam portions out of the portions corresponding to the pressure chambers and the case of existing only in the portions corresponding to the pressure chambers. The "first direction" means a direction in which the pressure chambers and the active portions are aligned, that is, a stacking direction of the piezoelectric actuator and the cavity unit.

In this manner, according to application/non-application of voltage, deformation occurs in reverse directions in the first active portions corresponding to the center portions of the pressure chambers and the second active portions corresponding to the portions on the outer peripheral sides which are more outside than the center portions of the pressure chambers. When the pressure chambers are arranged with high density and hence adjacent pressure chambers are close to each other, deformation of the first active portions is cancelled, when being transmitted to adjacent pressure chambers, by deformation of the second active portions, thereby suppressing so-called crosstalk which is propagation of deformation of the first active portions to adjacent pressure chambers. The first voltage applied to the first active portions may be same as the second voltage applied to the second active portions.

In the liquid-droplet jetting apparatus of the present invention, each of the second active portions may cover an inside portion located inside an outer peripheral edge of one of the pressure chambers.

In this case, not only the first active portions but the second active portions contribute to volumetric changes of the pressure chambers, and thus volumes of the pressure chambers can be changed larger than in the case only by the first active portions. Therefore, it is possible to improve jetting efficiency (jetting amount when voltage is applied) for jetting liquids in the pressure chambers selectively by applying the voltage to the piezoelectric actuator.

In the liquid-droplet jetting apparatus of the present invention, the piezoelectric actuator may include individual electrodes to which first potential and second potential different from the first potential are applied selectively, first constant potential electrodes to which the first potential is applied, and second constant potential electrodes to which the second potential is applied; each of the first active portions may include a piezoelectric material sandwiched between one of the individual electrodes and one of the first constant potential electrodes; and each of the second active portions may include a piezoelectric material sandwiched between one of the individual electrodes and one of the second constant potential electrodes.

In this case, just by applying the first potential and the second potential selectively to the individual electrodes, deformation of the first active portions and deformation of the second active portions (returning to an original state) can be made to occur at the same time completely. Thus, an attempt of the deformation of the first active portions to propagate to adjacent pressure chambers is cancelled by the deformation of the second active portions, thereby suppressing crosstalk without requiring highly precise timing control.

In the liquid-droplet jetting apparatus of the present invention, the individual electrodes may be formed across a first region corresponding to the first active portions and a second region corresponding to the second active portions of the piezoelectric actuator so as to cover the first and second regions; the first constant potential electrodes may be formed to cover the first region of the piezoelectric actuator; and the second constant potential electrodes may be formed to cover the second region of the piezoelectric actuator.

In this case, the electrodes can be arranged efficiently, and thereby arrangement without a waste becomes possible.

In the liquid-droplet jetting apparatus of the present invention, the first active portions may be polarized in a direction same as a direction of an electric field generated the applied voltage when the second potential is applied to the individual electrodes and the first potential is applied to the first constant potential electrodes; and the second active portions may be polarized in a direction same as a direction of an electric field generated by the applied voltage when the first potential is applied to the individual electrodes and the second potential is applied to the second constant potential electrodes.

In this case, in the first and second active portions, an application direction of voltage during driving and an application direction of voltage during polarization can all be aligned, and the electrodes can be used not only during driving (during deformation of active portions) but for polarization during manufacturing. Further, since the application direction of voltage during driving and the application direction of voltage during polarization (polarization direction) are the same, and a reverse electric field is not applied to a piezoelectric material layer during driving, occurrence of deterioration in deformation of the active portions can be suppressed. Note that, in this description the words "an application direction of voltage" is defined as a direction of an electric field generated by the applied voltage.

In the liquid-droplet jetting apparatus of the present invention, the first potential may be positive potential and the second potential may be ground potential. Further, the first potential may be ground potential and the second potential may be positive potential.

In these cases, by applying two kinds of potential, the positive potential and the ground potential selectively to the individual electrodes, driving can be controlled easily.

In the liquid-droplet jetting apparatus of the present invention, the second constant potential electrodes may be common in two adjacent pressure chambers among the pressure chambers.

In this case, since the second constant potential electrodes are shared by the adjacent two of the pressure chambers, the number of second constant potential electrodes can be reduced, and thus the electrodes as a whole can be simplified.

In the liquid-droplet jetting apparatus of the present invention, the piezoelectric actuator may have a piezoelectric material layer; and the individual electrodes may be formed on a side of one surface of the piezoelectric material layer and the first constant potential electrodes and the second constant potential electrodes may be formed on a side of the other surface of the piezoelectric material layer, and the first active portions and the second active portions may be formed on the same piezoelectric material layer. Here, "the piezoelectric material layer" includes, other than a piezoelectric sheet produced by burning a so-called green sheet, one produced by a method such as so-called AD method (aerosol deposition method).

In this case, an arrangement of required electrodes can be realized by having at least one piezoelectric material layer, and thus it is advantageous in the aspect of material cost.

In the liquid-droplet jetting apparatus of the present invention, an insulating layer thinner than the piezoelectric material layer may be provided to be sandwiched by the first constant potential electrodes and the second constant potential electrodes formed on the side of the other surface; and the first constant potential electrodes and the second constant potential electrodes may be isolated by the insulating layer.

In this case, since the first constant potential electrodes and the second constant potential electrodes are isolated sandwiching the insulating layer, the first constant potential electrodes and the second constant potential electrodes do not short circuit even when they are arranged close to each other. Thus, it becomes possible to arrange the first active portions and the second active portions close to each other, which is advantageous for downsizing.

In the liquid-droplet jetting apparatus of the present invention, the insulating layer may be formed of a material same as the piezoelectric material layer.

In this case, since the same material as the piezoelectric material layer is used for the insulating layer, manufacturing thereof is easy, which is also advantageous in the aspect of cost.

In the liquid-droplet jetting apparatus of the present invention, the first constant potential electrodes may be formed to be sandwiched between adjacent two pressure chambers among the pressure chambers to form rows with the two adjacent pressure chambers; and the second constant potential electrodes may be formed only on one side of the two pressure chambers.

In this case, the second active portions are arranged on one side of the pressure chambers, and crosstalk is suppressed only for the one side.

In the liquid-droplet jetting apparatus of the present invention, the piezoelectric actuator may have a plurality of piezoelectric material layers; the first constant potential electrodes or the second constant potential electrodes may be formed on a farthest surface not facing the pressure chambers, of a farthest layer, among the plurality of piezoelectric material layers, the farthest layer being located farthest from the pressure chambers; the individual electrodes may be formed on a surface of one of the piezoelectric material layers, the surface being different from the farthest layer; surface electrodes which are to be input terminals to the individual electrodes, respectively, may be formed in areas, of the farthest surface, overlapping with the outer peripheral portions; and the individual electrodes may be conducted to the surface electrodes via a conductive material filled in through holes penetrating the piezoelectric material layers.

In this case, when having a plurality of piezoelectric material layers, a reasonable arrangement of individual electrodes can be realized using surface electrodes and through holes.

In the liquid-droplet jetting apparatus of the present invention, the second active portions may be formed on a layer other than the farthest layer among the plurality of piezoelectric material layers; and each of the surface electrodes may be formed in an area, on the farthest surface, overlapping with a portion between the adjacent pressure chambers.

In this case, the surface electrodes are formed in regions between adjacent pressure chambers without interfering with the second active portions. Thus, freedom of positions to form the surface electrodes improves.

According to a second aspect of the invention, there is provided a liquid-droplet jetting apparatus which jets droplets of a liquid, including:

a liquid-droplet jetting head including a cavity unit in which a plurality of pressure chambers arranged regularly are formed and a piezoelectric actuator which is joined to the cavity unit to cover the pressure chambers and jets the liquid in the pressure chambers selectively, the piezoelectric actuator having first portions each located to correspond to a center portion of one of the pressure chambers and second portions each located to correspond to an outer peripheral portion which covers a portion located outside of the center portion of one of the pressure chambers; and a voltage application mechanism which applies a voltage to the piezoelectric actuator;

wherein the voltage application mechanism switches application and non-application of a first voltage to the first portions so as to change a volume of each of the pressure chambers, and switches application and non-application of a second voltage to the second portions so as to suppress that deformation of the first portions generated in a pressure chamber among the pressure chambers due to switching to the application of voltage to the first portions, propagates to another pressure chamber adjacent to the pressure chamber.

According to the second aspect of the present invention, application and non-application of voltage to the first portions are switched so as to change the volumes of the pressure chambers, and application and non-application of voltage to the second portions are switched so as to suppress that deformation of the first active portions due to this switching propagates to the adjacent pressure chambers, thereby suppressing crosstalk.

According to the third aspect of the present invention, there is provided a liquid-droplet jetting head which jets droplets of a liquid, including:

a cavity unit in which a plurality of pressure chambers arranged regularly are formed; and a piezoelectric actuator which is joined to the cavity unit to cover the pressure chambers and jets the liquid in the pressure chambers selectively, the piezoelectric actuator having first active portions each corresponding to a center portion of one of the pressure chambers, second active portions each corresponding to an outer peripheral portion, of one of the pressure chambers, which covers a portion located outside of the center portion of one of the pressure chambers, individual electrodes formed to across a first region corresponding to the first active portions and a second region corresponding to the second active portions so as to cover the first and second regions, first constant potential electrodes formed to cover the first region, and second constant potential electrodes formed to cover the second region.

In this case, deformation in reverse direction occurs according to application/non-application of voltage in the first active portions corresponding to the center portions of the pressure chambers and the second active portions corresponding to the portions on the outer peripheral sides which are more outside than the center portions of the pressure chambers, and hence crosstalk which is propagation of deformation of the first active portions to adjacent pressure chambers is suppressed.

As described above, the liquid-droplet jetting apparatus and the liquid-droplet jetting head of the present invention, deformation in reverse direction occurs according to application/non-application of voltage in the first active portions corresponding to the center portions of the pressure chambers and the second active portions corresponding to the portions on the outer peripheral sides which are more outside than the center portions of the pressure chambers. Accordingly, even when the pressure chambers are arranged with high density, crosstalk which is propagation of deformation of the active portions to adjacent pressure chambers can be suppressed.

BRIEF DESCRIPTION OF THE DRAWINGS

FIGS. 33A, 33B are views similar to FIGS. 6A, 6B respectively regarding the tenth embodiment;

DETAILED DESCRIPTION OF THE PREFERRED EMBODIMENTS

Hereinafter, embodiments of the present invention will be explained according to the drawings.

First Embodiment

Figure 1A:
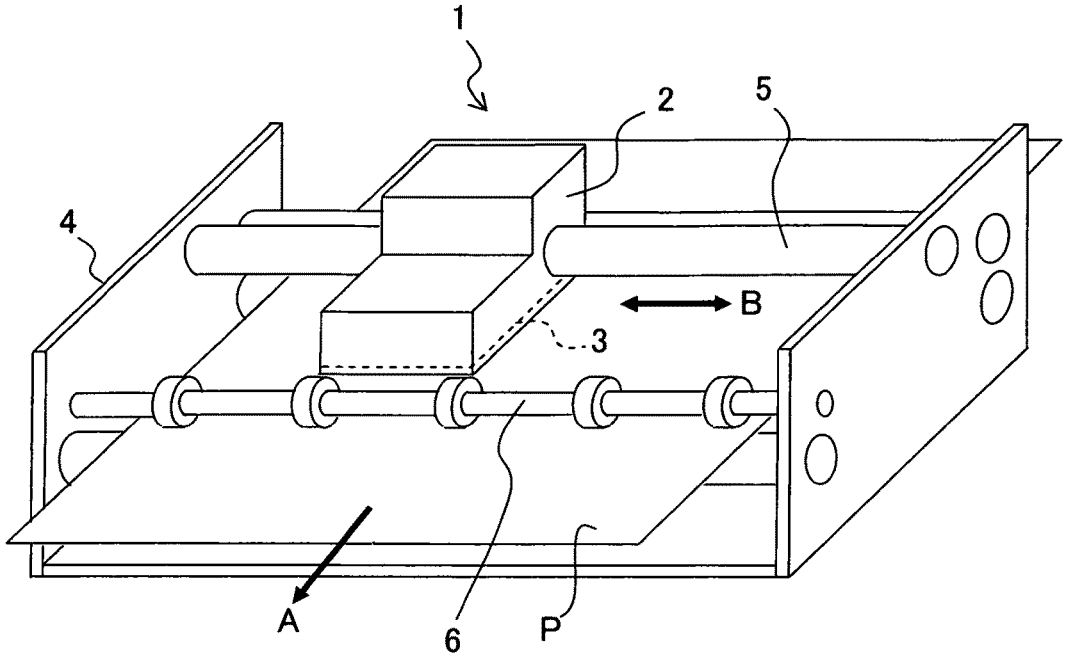
FIG. 1A is a schematic structural view showing a schematic structure of an ink-jet printer (liquid-droplet jetting apparatus) according to the present invention.
Figure 1B:
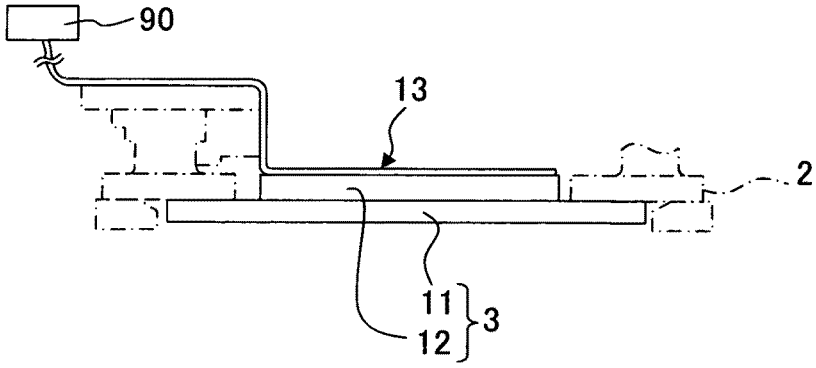
FIG. 1B is an explanatory view showing a relationship among a cavity unit, a piezoelectric actuator and a flexible wiring board (COP) according to the present invention.

FIG. 1A is a schematic structural view showing a schematic structure of an ink-jet printer (liquid-droplet jetting apparatus) according to the present invention, and FIG. 1B is an explanatory view showing a relationship among a cavity unit, a piezoelectric actuator and a flexible wiring board (COP) according to the present invention.

In the ink-jet printer 1 according to the present invention, as shown in FIG. 1A, an ink-jet head 3 (liquid-droplet jetting head) for recording on a recording paper P (recording medium) is provided on a lower surface of a carriage 2 on which an ink cartridge (not shown) is mounted. The carriage 2 is supported by a carriage shaft 5 and a guide plate (not shown) provided in a printer frame 4, and reciprocates in a direction B orthogonal to a feeding direction A of the recording paper P. The recording paper P carried in the direction A from a not-shown paper feeding unit is introduced into a space between a platen roller (not shown) and the ink-jet head 3, where predetermined recording is performed with ink jetted toward the recording paper P from the ink-jet head 3, and is discharged thereafter by discharging rollers 6.

Further, as shown in FIG. 1B, the ink-jet head 3 is provided with a flexible wiring board 13 (signal line), which has a cavity unit 11 and a piezoelectric actuator 12 from a lower side in order, and supplies a drive signal to an upper surface of the piezoelectric actuator 12.

Figure 2A:
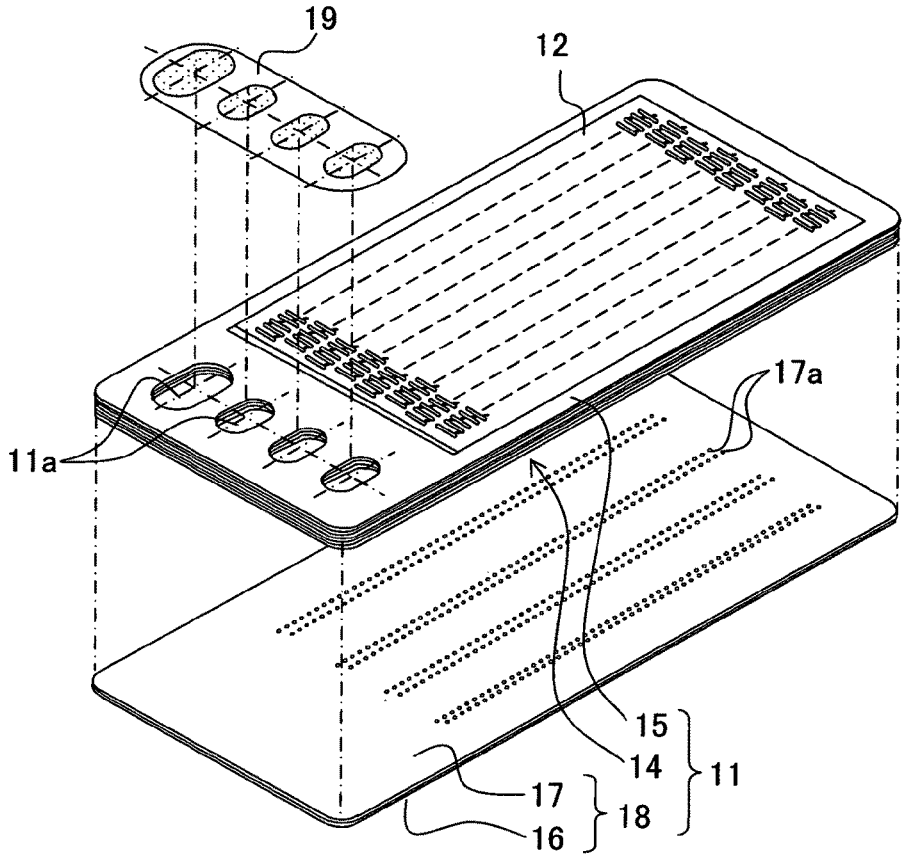
FIGS. 2A, 2B are perspective views showing that the piezoelectric actuator is attached to an upper side of the cavity unit.
Figure 2B:
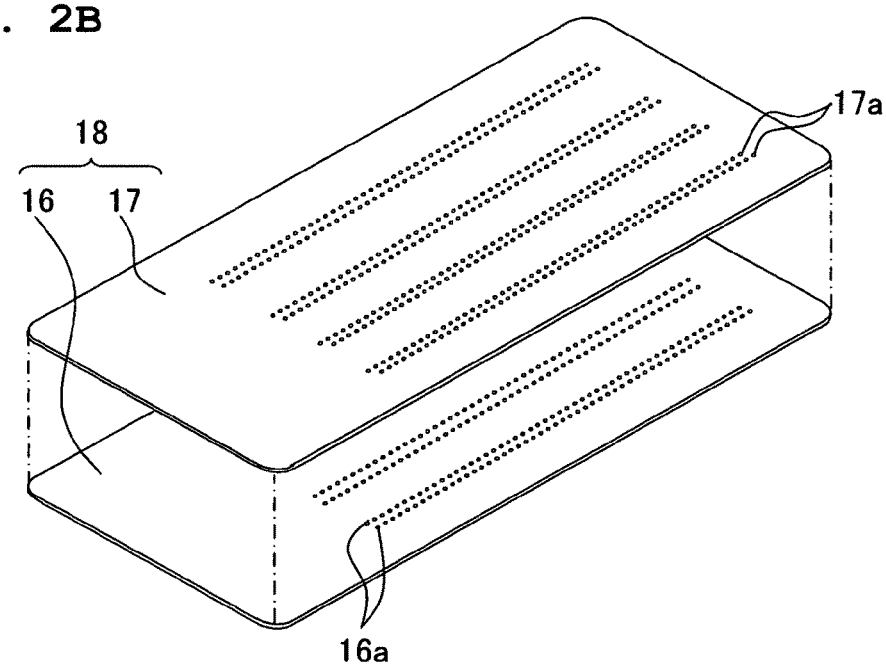

As shown in FIG. 2, the cavity unit 11 includes a stack 14 formed of a plurality of plate members. A top plate 15 is provided on an upper side of the stack 14. A plate assembly 18 is adhered integrally on a lower side of the stack 14, and the plate assembly 18 is formed by adhering a nozzle plate 16 having nozzle holes 16*a* and a spacer plate 17 having through holes 17*a* corresponding to the nozzle holes 16*a*. Then, a piezoelectric actuator 12 for selectively jetting ink (liquid) in pressure chambers 40 is joined on an upper side of the top plate 15. Further, a filter 19 for catching dust or the like included in the ink is provided on openings 11*a* of the cavity unit 11. The nozzle plate 16 is a plate of synthetic resin (polyimide resin for example) in which each of the nozzle holes 16*a* is provided to correspond to one of the pressure chambers 40 of the cavity plate 14A (forming the stack 14). Note that the nozzle plate 16 may be a metal plate.

Figure 3:
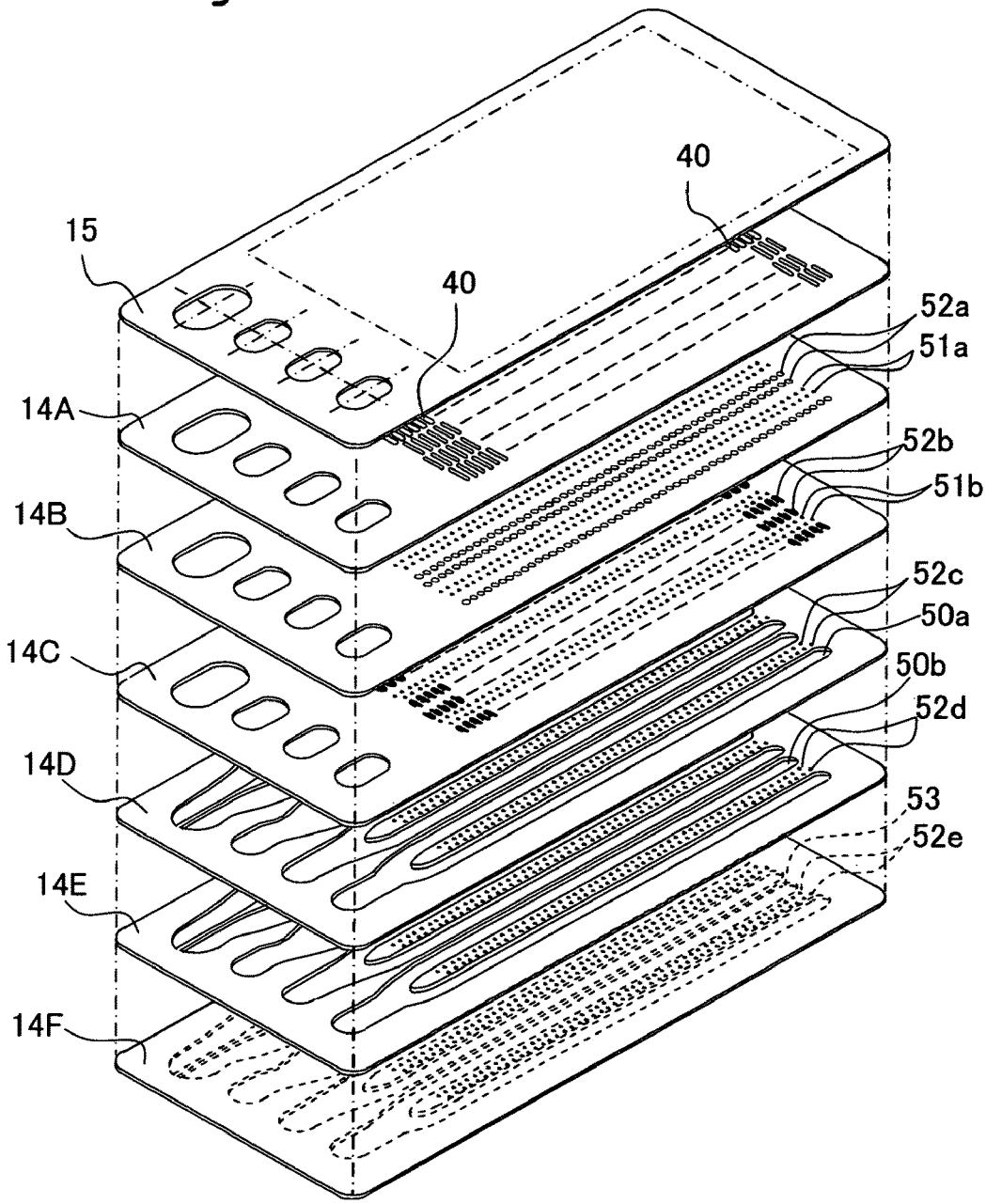
FIG. 3 is a view showing the cavity unit exploded into plates as component parts, together with a top plate.

As shown in FIG. 3, the stack 14 is formed such that a cavity plate 14A, a base plate 14B, an aperture plate 14C, two manifold plates 14D, 14E, and a damper plate 14F are stacked in this order from an upper side and these plates are bonded by a metal-diffusion bonding. These six plates 14A to 14F are aligned with each other and stacked so that ink channels are formed individually for the nozzle holes 16*a*, respectively. Here, the cavity plate 14A is a metal plate in which openings functioning as a plurality of pressure chambers 40 are formed regularly corresponding to nozzle rows. The base plate 14B is a metal plate in which there are formed through holes 51*a* forming parts of communication holes 51 allowing communication between the pressure chambers 40 and manifolds 50 (common ink chambers) which will be explained later, and through holes 52*a* forming parts of communication holes 52 allowing communication between the pressure chambers 40 and the nozzle holes 16*a*. On an upper surface of the aperture plate 14C, communication channels 21 allowing communication between the pressure chambers 40 and the manifolds 50 are formed as recessed channels. Further, the aperture plate 14C is a metal plate in which there are provided communication holes 51*b* forming parts of the communication holes 51, and communication holes 52*b* forming parts of the communication holes 52. In the manifold plates 14D, 14E, communication holes 50*a*, 50*b* defining the manifolds 50 are formed respectively. Furthermore, the manifold plates 14D, 14E are metal plates in which communication holes 52*c*, 52*d* forming parts of the communication holes 52 are provided respectively. The damper plate 14F is a metal plate in which communication holes 52*e* forming parts of the communication holes 52 are provided respectively, and damper chambers 53 which are formed as recesses also provided in a lower surface of the damper plate 14F.

The cavity unit 11 includes the plurality of nozzle holes 16*a*, the plurality of pressure chambers 40 communicating with the nozzle holes 16*a* respectively and manifolds 50 temporarily storing ink supplied to the pressure chambers 40. Further, the communication holes 51*a*, 51*b* communicate with each other and form the communication holes 51 allowing communication between the pressure chambers 40 and the manifolds 50. Furthermore, the communication holes 52*a* to 52*e* communicate with each other and form the communication holes 52 allowing communication between the pressure chambers 40 and the nozzle holes 16*a*.

Figure 4:
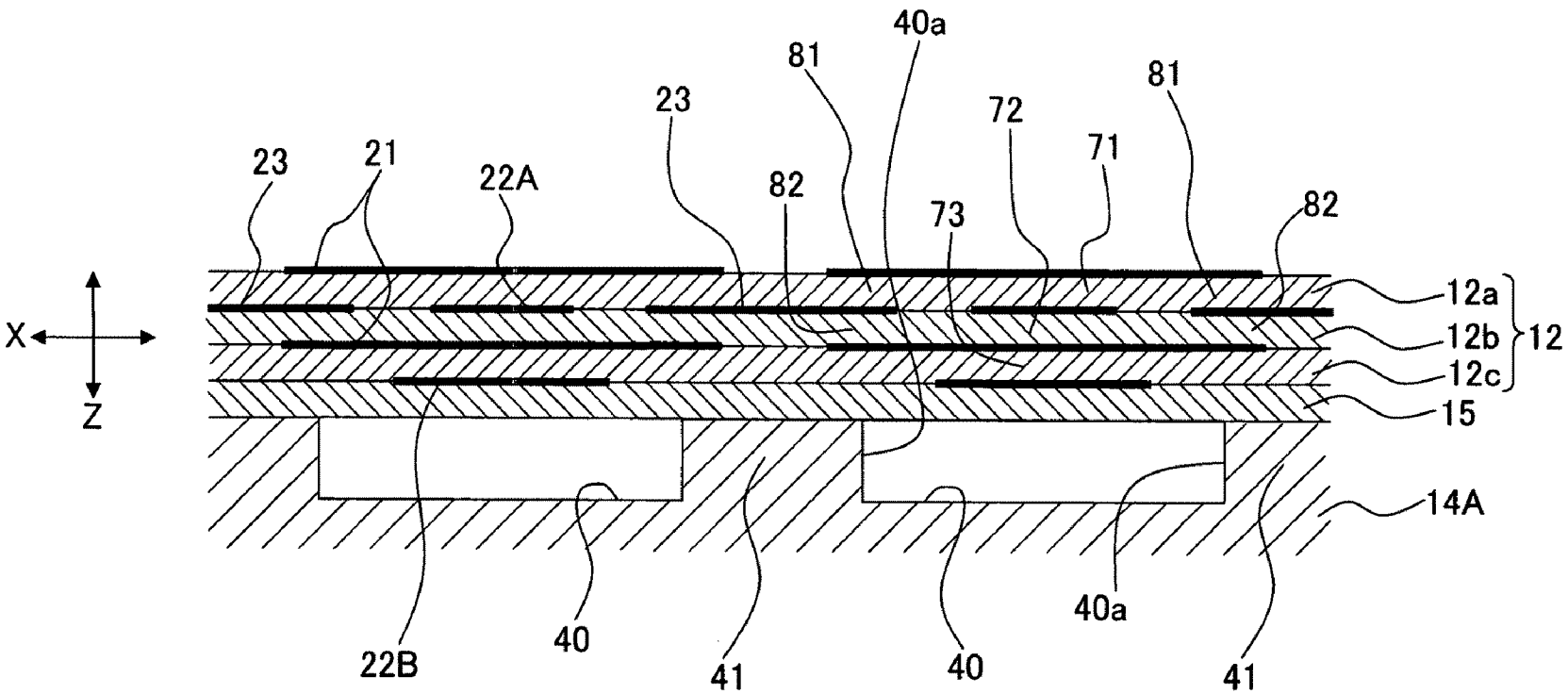
FIG. 4 is a schematic cross-sectional view of first embodiment.

The piezoelectric actuator 12 is formed by stacking a plurality of piezoelectric material layers 12*a*, 12*b*, 12*c* as shown in FIG. 4. The piezoelectric material layers 12*a* to 12*c* are formed of lead zirconate titanate (PZT) based ceramic materials (piezoelectric sheets) having ferroelectricity, and is polarized in a thickness direction thereof (see FIGS. 6A, 6B).

Then, the piezoelectric actuator 12 includes, as viewed in a plan view (as viewed from a stacking direction of the cavity unit 11 and the piezoelectric actuator 12), first active portions 71, 72, 73 (first portions) corresponding to center portions of the pressure chambers 40 and second active portions 81, 82 (second portions) corresponding to left and right portions on outer peripheral sides which are more outside than the center portions of the pressure chambers 40. Here, as shown in FIG. 4, the first active portions 71, 72, 73 correspond to piezoelectric sheets 12*a*, 12*b*, 12*c* respectively, and the second active portions 81, 82 correspond to left sides and right sides of the pressure chambers 40 respectively. Note that the center portions of the pressure chambers 40 are center portions in a nozzle row direction X in which the nozzle holes 16*a* are arranged.

The second active portions 81, 82 include not only regions corresponding to beam portions (girder portions, column portions) 41 which are walls partitioning adjacent pressure chambers 40 but regions corresponding to portions more inside (center portion side) than outer peripheral edges 40*a* of the pressure chambers 40.

The first active portions 71 to 73 are, respectively, regions of the piezoelectric sheet 12*a* between individual electrodes 21A and first constant potential electrodes 22A, regions of the piezoelectric sheet 12*b* between the first constant potential electrodes 22A and individual electrodes 21B, and regions of the piezoelectric sheet 12*c* between the individual electrodes 21B and first constant potential electrodes 22B. On the other hand, both of the second active portions 81, 82 are regions of the piezoelectric sheets 12*a* to 12*c* between the individual electrodes 21A and the second constant potential electrodes 23. Note that the electrodes 21A, 21B, 22A, 22B are formed of Ag—Pd based metal materials or the like.

A driver IC 90 (see FIG. 1B) supplying driving signals is electrically connected to the individual electrodes 21 via the flexible wiring board 13 (signal lines). The driver IC 90 and the flexible wiring board 13 form a voltage application mechanism for applying driving voltage to the first and second active portions 71 to 73, 81, 82 of the piezoelectric actuator 12.

A first potential (ground potential) and a second potential different therefrom (20 V for example) are applied selectively to the individual electrodes 21 via the flexible wiring board 13 to change volumes of the pressure chambers 40. Further, the first potential (ground potential) is applied constantly to the first constant potential electrodes 22A, 22B, and the second potential (20 V for example) is applied constantly to the second constant potential electrodes 23.

Thus, the piezoelectric actuator 12 has the individual electrodes 21 corresponding to the pressure chambers 40. The piezoelectric actuator 12 changes the volumes of the pressure chambers 40 to jet ink from the nozzle holes 16*a*, when the first potential (ground potential) and the second potential (positive potential) are applied selectively to the individual electrodes 21 as drive signals.

A length of the individual electrodes 21 is shorter than a length of the pressure chambers 40 in a direction Y orthogonal to the nozzle row direction X (see FIG. 6B), but longer than a length of the pressure chambers 40 in the nozzle row direction X. The individual electrodes 21 are formed to range across regions (first region) corresponding to the first active portions 71 to 73 and regions (second region) corresponding to the second active portions 81, 82 so as to cover both of these regions. A length of the first constant potential electrodes 22A, 22B is shorter than a length of the pressure chambers 40 in the nozzle row direction X so as to cover regions corresponding to the first active portions 71 to 73. Then a length of the first constant potential electrodes 22B located on the side of the pressure chambers 40 is longer in the nozzle row direction X than a length of the first constant potential electrodes 22A located away from the pressure chambers 40. That is, the individual electrodes 21 are shared (used commonly) for the first and second constant potential electrodes 22A, 22B, 23.

The second constant potential electrodes 23 are formed to cover regions corresponding to the second active portions 81, 82 and regions corresponding to the beam potions 41 between the pressure chambers 40 which are adjacent to each other in a direction orthogonal to the nozzle row direction. That is, the second constant potential electrodes 23 extend to regions corresponding to side portions, of the pressure chambers 40, in the nozzle row direction, the side portions including the beam portions 41. Each of the second constant potential electrodes is shared for two pressure chambers 40 which are adjacent to each other in the nozzle row direction.

Specifically, the individual electrodes 21 are formed on a side of one surface (upper face in FIG. 4) of the piezoelectric material layer 12*a* which is farthest from the pressure chambers 40, and the first constant potential electrodes 22A and the second constant potential electrodes 23 are formed on a side of the other surface (lower face in FIG. 4) of the piezoelectric material layer 12*a*. Accordingly, the first active portions 71 and the second active portions 81 are formed side by side in the same piezoelectric material layer 12*a*. Further, the first constant potential electrodes 22A and the second constant potential electrodes 23 are formed alternately on a side of one surface (upper face in FIG. 4) of the piezoelectric material layer 12*b*, and the individual electrodes 21 are formed on a side of the other surface (lower face in FIG. 4) of the piezoelectric material layer 12*b*. Accordingly, the first active portions 72 and the second active portions 82, corresponding to the first active portions 71 and the second active portions 81 of the piezoelectric material layer 12*a*, are formed side by side in the same piezoelectric material layer 12*b*. Furthermore, the individual electrodes 21 are formed on a side of one surface (upper face in FIG. 4) of the piezoelectric material layer 12*c* which is closest to the pressure chambers 40, and the first constant potential electrodes 22B are formed on a side of the other surface (lower face in FIG. 4) of the piezoelectric material layer 12*c*. Thus, the first active portions 73 are formed in the piezoelectric material layer 12*c*. A length of the first active portions 73 is longer than a length of the first active portions 71, 72 in the nozzle row direction, since the constant potential electrodes 22B are longer than the constant potential electrodes 22A in the nozzle row direction X.

Figure 5:
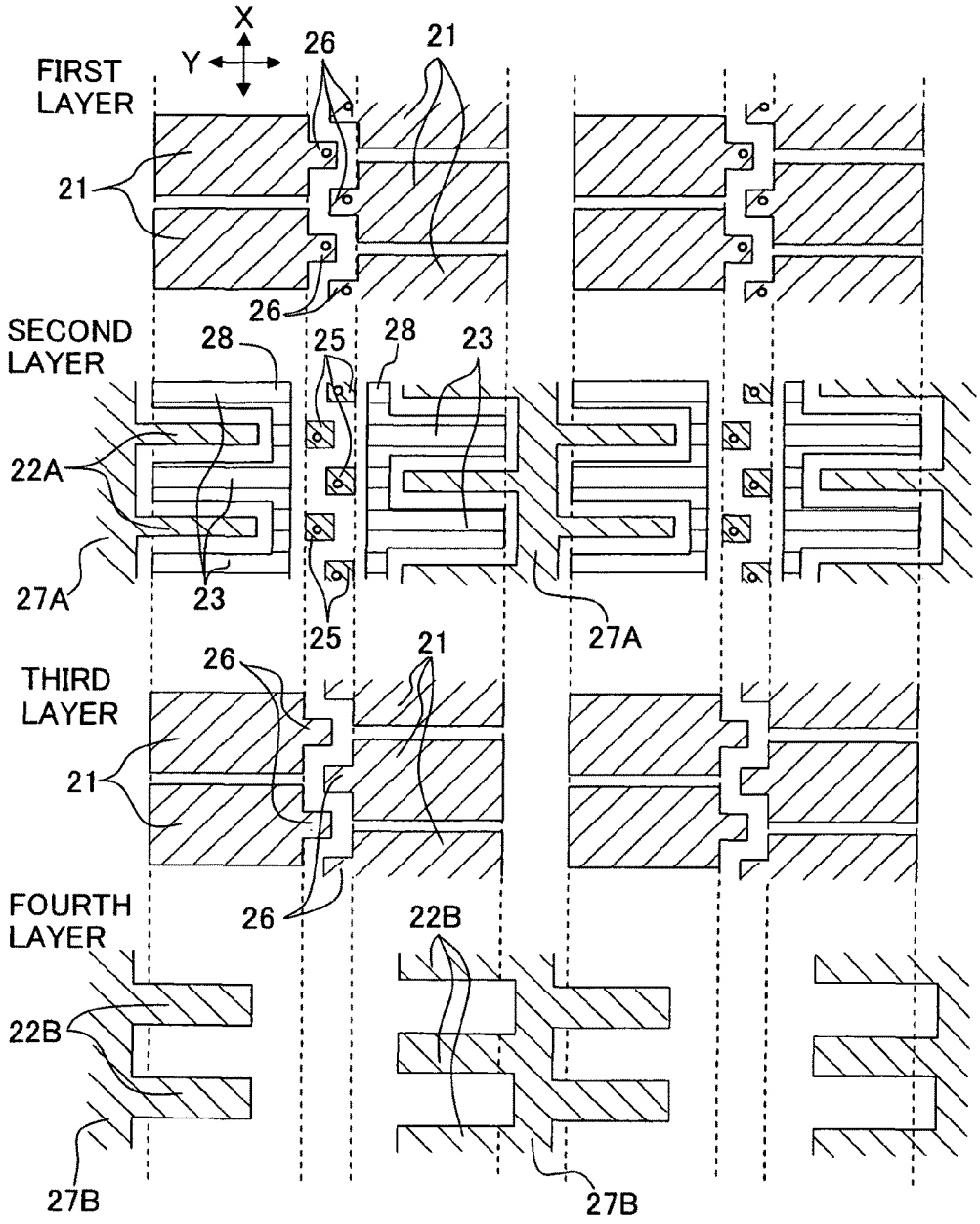
FIG. 5 is an explanatory view of arrangement of electrodes in piezoelectric material layers of the piezoelectric actuator.

Further, the electrodes 21, 22A, 22B, 23 of the respective piezoelectric sheets 12*a* to 12*c* are arranged in a plan view as shown in FIG. 5. Namely, on an upper face side (first layer, third layer) of the piezoelectric sheet 12*a* (12*c*), the individual electrodes 21 are arranged at a constant pitch in the nozzle row direction (X direction) corresponding respectively to the pressure chambers 40. A plurality of rows of individual electrodes 21 are arranged in the Y direction. Then, in rows adjacent to each other in the Y direction, the individual electrodes 21 are formed to be shifted by a half pitch from each other in the X direction. Between these rows, on the individual electrodes 21, connection portions 26 to be connected to the connection terminals (not shown) of the flexible wiring board 13 are formed in a zigzag pattern.

On a lower side (second layer) of the piezoelectric material layer 12*a*, the first constant potential electrodes 22A are formed at a constant pitch in the nozzle row direction corresponding respectively to the pressure chambers 40. One ends of the first constant potential electrodes 22A are connected to one of first common electrodes 27A which is kept at the ground potential and extends in the nozzle row direction. Further, between the first constant potential electrodes 22A, the second constant potential electrodes 23 are formed respectively, and one ends thereof are also at positive potential (for example 20 V: constant) and connected to one of second common electrodes 28 extending in the nozzle row direction X. Then between the adjacent pressure chambers 40, middle electrodes 25 are formed in a zigzag form (see FIG. 6B) for electrically connecting the individual electrodes 21 on the upper face side of the piezoelectric material layer 12*a* to the individual electrodes 21 on the upper face side of the piezoelectric material layer 12*c* located therebelow using through holes 24 (filled with conductive materials inside).

In a lower face side of the piezoelectric material layer 12*c*, the first constant potential electrodes 22B are formed at a constant pitch in the nozzle row direction corresponding respectively to the pressure chambers 40, and one ends thereof are connected to one of first common electrodes 27B at the ground potential extending in the nozzle row direction X. Note that the first constant potential electrodes 22B located on the side of the pressure chambers 40 are formed longer in length in the nozzle row direction X than the first constant potential electrodes 22A located away from the pressure chambers 40.

Figure 6A:
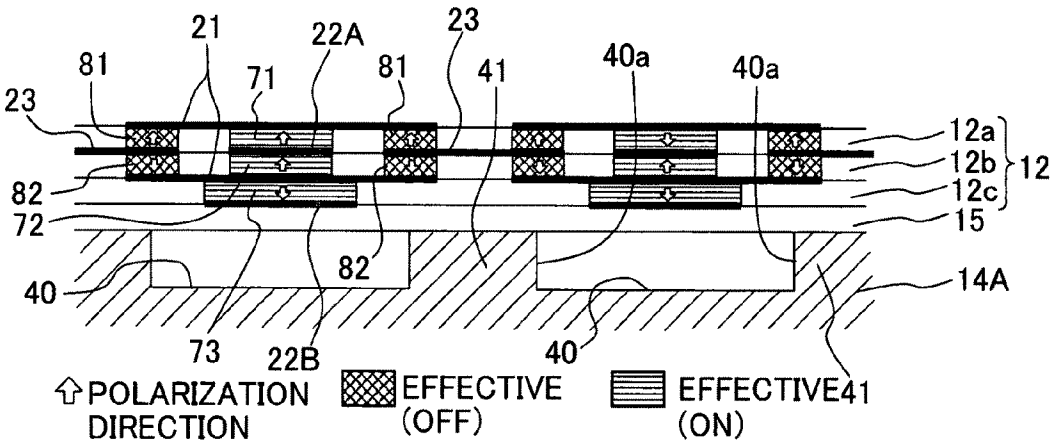
FIGS. 6A, 6B are explanatory views showing a relationship among a polarization direction, portions (first active portions) which are effective while being turned ON and effective during application of voltage, and portions (second active portions) which are effective while being turned OFF and effective during non-application of voltage, regarding the first embodiment.
Figure 6B:
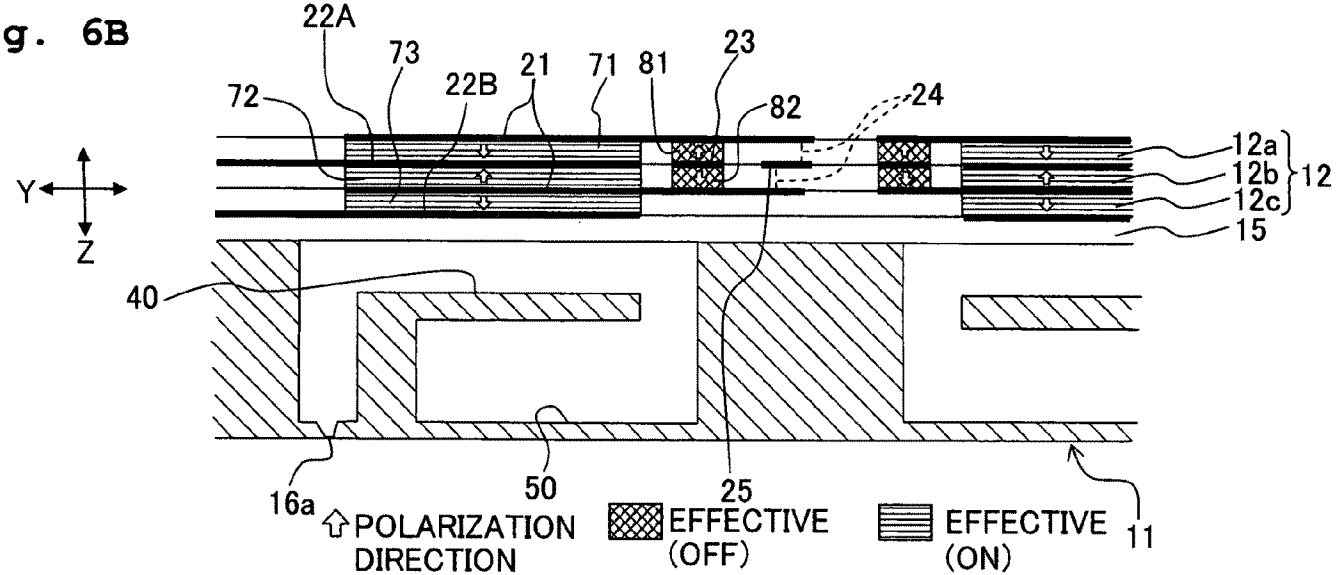

Note that as shown in FIGS. 6A, 6B, the first active portions 71 to 73 are polarized in the same direction (polarization direction) as the direction of the electric field generated by the applied voltage when the second potential is applied to the individual electrodes 21 and the first potential is applied to the first constant potential electrodes 22A, 22B for deformation. On the other hand, the second active portions 81, 82 are polarized in the same direction as the direction of the electric field generated by the applied voltage when the first potential is applied to the individual electrodes 21 and the second potential is applied to the second constant potential electrodes 23 for deformation. That is, the directions of the electric field generated by the applied voltage and the polarization directions are the same. Here, in FIGS. 6A, 6B, portions which are "effective while being turned ON" correspond respectively to the first active portions to which voltage (20 V) is applied when the second potential is applied to the individual electrodes 21, and portions which are "effective while being turned OFF" correspond respectively to the second active portions to which voltage (20 V) is applied when the first potential is applied to the individual electrodes 21.

The first constant potential electrodes 22A, 22B are always at the first potential (ground potential), and the second constant potential electrodes 23 are always at the second potential (positive potential). Then, the first potential (ground potential) and the second potential (positive potential) are applied to the individual electrodes 21 selectively for changing the volumes of the pressure chambers 40. That is, as shown in Table 1 below, the direction of the electric field generated by the applied voltage is the same during polarization and during driving. However, the first constant potential electrodes 22A, 22B are always at the ground potential (0 V), the second constant potential electrodes 23 are always at the positive potential (20 V: constant), and to the individual electrodes 21, the positive potential (20 V: constant) is applied or this application is released (see FIG. 27A). Therefore, when the positive potential is applied to the individual electrodes 21, the voltage is applied to the first active portions 71 to 73 but the voltage is not applied to the second active portions 81, 82. On the other hand, when the positive potential is not applied to the individual electrodes 21 and the individual electrodes 21 are at the ground potential, the voltage is not applied to the first active portions 71 to 73, and the voltage is applied to the second active portions 81, 82. Here, the voltage applied between electrodes during driving is, as shown in Table 1, smaller than the voltage applied during polarization, thereby suppressing deterioration due to repeated application of voltage between electrodes.

TABLE 1

| TYPE OF ELECTRODE | APPLIED POTENTIAL DURING POLARIZATION | APPLIED POTENTIAL DURING DRIVING |
|---|---|---|
| INDIVIDUAL ELECTRODE 21 | 50 V | 20 V (ON/OFF) |
| FIRST CONSTANT POTENTIAL ELECTRODES 22A, 22B | 0 V | 0 V |
| SECOND CONSTANT POTENTIAL ELECTRODE 23 | 100 V | 20 V (CONSTANT) |

Figure 7A:
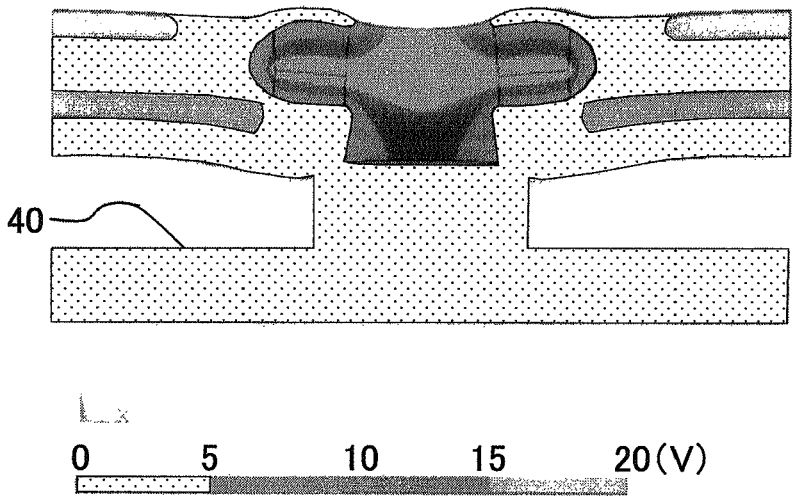
FIGS. 7A, 7B are explanatory views showing respectively volumetric changes of pressure chambers during non-application/application of voltage to first active portions.

Since the electrodes 21, 22A, 22B, 23 are arranged as described above, during non-application of voltage to the first active portions 71 to 73 (during standby) in which the second potential (ground potential) is applied to the individual electrodes 21 by the voltage application mechanism, the first active portions 71 to 73 are in a state of non-expand/non-contract (non-deform) in the first and second directions Z, X. At this time, the second active portions 81, 82 are in a voltage applied state, and attempt to expand in a stacking direction Z (first direction) toward the pressure chambers 40 and contract in the nozzle row direction X (second direction) orthogonal to the stacking direction Z. Thus, by the operation of the top plate 15 as a binding plate (a restraint plate), the second active portions 81, 82 located at the side portions in the nozzle row directions deform to bend in a direction to depart from the pressure chambers 40. As shown in FIG. 7A, this deformation of the second active portions 81, 82 contributes to increasing of volumetric changes of the pressure chambers 40, and contributes to sucking of a large amount of ink from the manifolds 50 to the pressure chambers 40.

On the other hand, during application of voltage (during driving) to the first active portions 71 to 73 in which the first potential (positive potential: 20 V) is applied to the individual electrodes 21, the first active portions 71 to 73, being applied with voltage in the same direction as the polarization direction, expand in the stacking direction Z toward the pressure chambers 40 and contract in the nozzle row direction X orthogonal to the stacking direction Z thereof by piezoelectric lateral effect. Accordingly, the first active portions 71 to 73 turn to a state of projecting and deforming in a direction toward insides of the pressure chambers 40. On the other hand, as the top plate 15 does not contract spontaneously because it is not influenced by electric field, a difference is made in distortion in the polarization direction and in the vertical direction between the piezoelectric material layer 12*c* located on the upper side and the top plate 15 located on the lower side. This and the top plate 15 being fixed to the cavity plate 14A together cause the piezoelectric material layer 12*c* and the top plate 15 to attempt to deform so as to project toward the side of the pressure chambers 40 (unimorph deformation). Accordingly, the volumes of the pressure chambers 40 decrease, the pressure of ink increases, and the ink is jetted from the nozzle holes 16*a*.

Figure 7B:
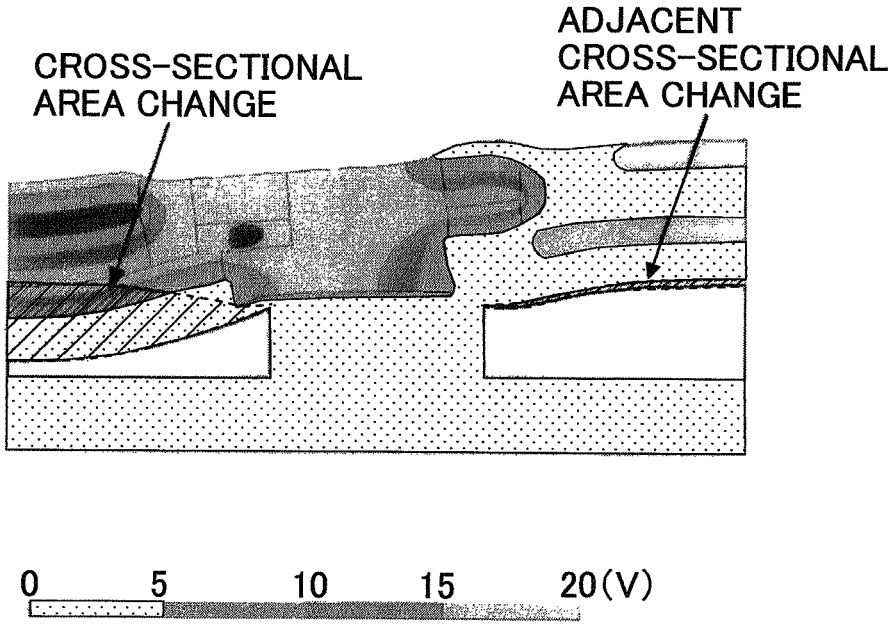

In this application period of voltage to the first active portions 71 to 73, the second active portions 81, 82 turn to a non application state of voltage, and hence return to a state of non-expand/non-contract (non-deform) in the first and second directions Z, X. Thus, when the first active portions 71 to 73 project and deform in the direction toward the pressure chambers 40, the second active portions 81, 82 return to a state of not deforming. Therefore, as shown in FIG. 7B, the influence of deformation of the first active portions 71 to 73 is cancelled by the second active portions 81, 82 and hardly reaches the pressure chambers 40 adjacent thereto, thereby suppressing crosstalk. That is, application and non-application of voltage to the second active portions 81, 82 are switched so as to suppress that deformation of the first active portions 71 to 73 due to switching of application and non-application of voltage to the first active portions 71 to 73 propagates to the adjacent pressure chambers 40.

Thereafter, when the individual electrodes 21 are returned to the same potential (ground potential) as the first constant potential electrodes 22A, 22B, the first active portions 71 to 73 turn to a state of not deforming as described above. Then, the second active portions 81, 82 deform to bend in a direction to depart from the pressure chambers 40, and the volumes of the pressure chambers 40 return to the original volumes. Thus, the ink is sucked into the pressure chambers from the manifolds 50.

The jetting operation of ink is repeated by such deformation of the first active portions 71 to 73 and the second active portions 81, 82, and volumetric changes of the pressure chambers 40 are made to be large in each jetting operation, thereby increasing jetting efficiency and suppressing crosstalk in the three directions.

Figure 40:
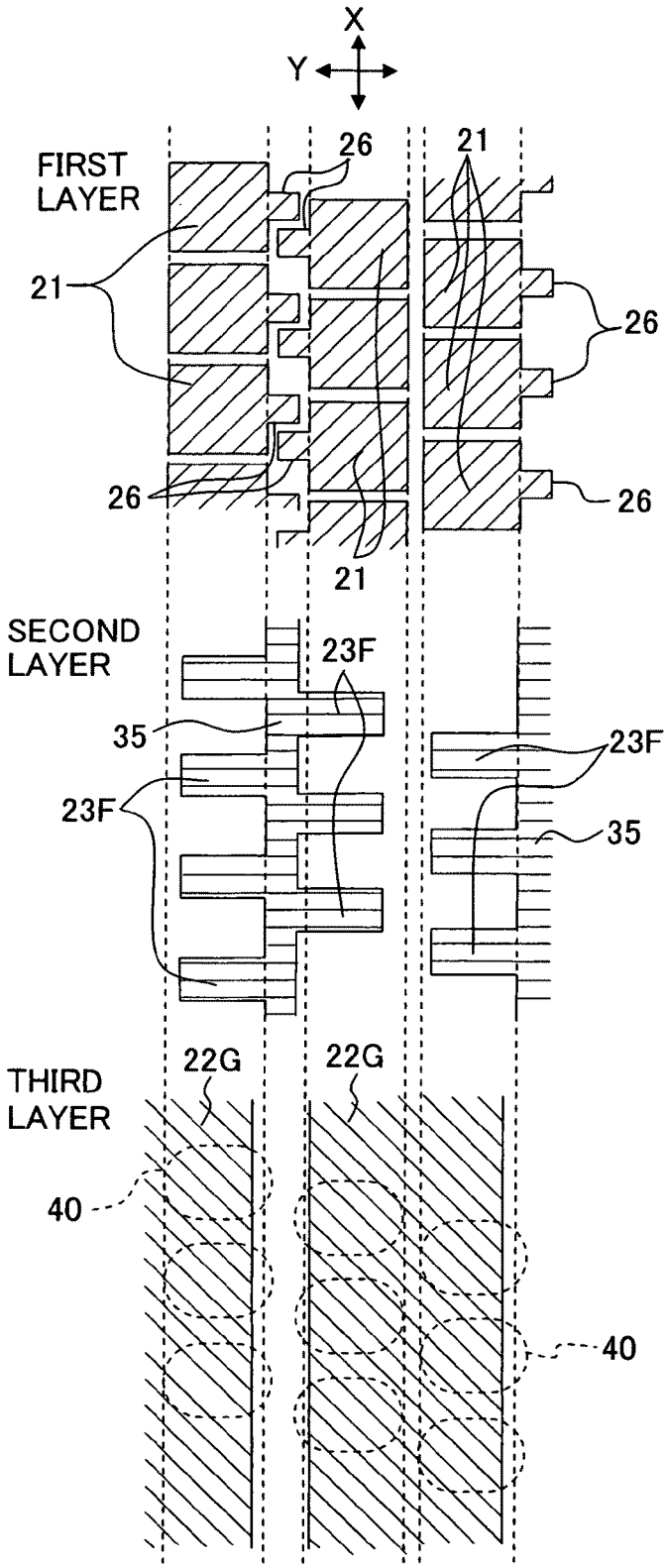
FIG. 40 is a view showing arrangements of electrodes on the piezoelectric material layers respectively.

Incidentally, the ratio of changes of cross-sectional areas of adjacent pressure chambers were obtained in the first embodiment and the conventional example (see FIG. 40). As shown in Table 2, it is 11% in the case of the first embodiment while it is 24% in the case of the conventional example. The change ratio in the case of the first embodiment decreases to almost half as compared to the conventional example, and it can be seen that the effect of suppressing crosstalk is exhibited.

Figure 9:
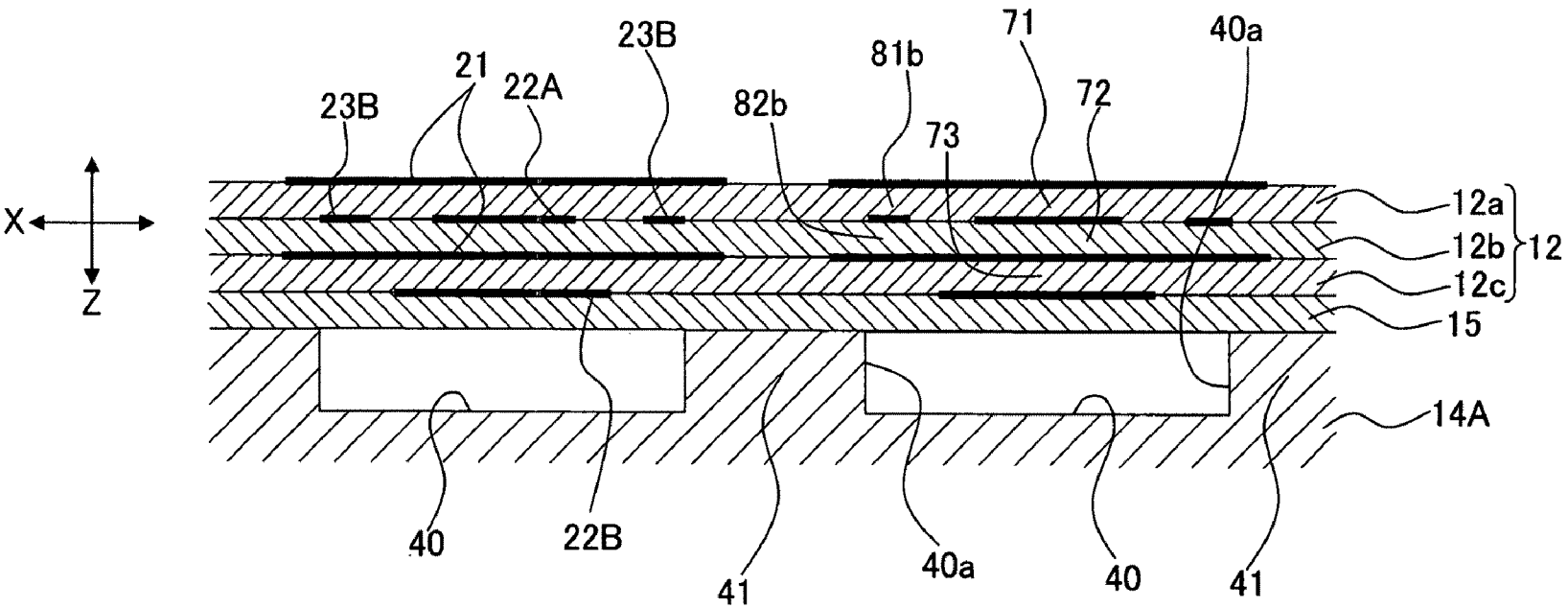
FIG. 9 is a view similar to FIG. 4 regarding another modification example of the first embodiment.

Conversely, as shown in FIG. 9, it is also possible to structure such that second active portions 81*b*, 82*b* exist only in the regions corresponding to portions on the outer peripheral sides of the pressure chambers 40. That is, the second constant potential electrodes 23B can be provided only in the regions corresponding to the portions on the outer peripheral sides which are more outside than the center portions of the pressure chambers 40 irrelevantly to the regions corresponding to the beam portions 41. In this case, lengths of the second active portions 81*b*, 82*b* in the nozzle row direction become shorter, as compared to the structure in which the above-described second active portions 81, 82 are arranged across the first regions and the second regions, the first regions corresponding to the portions on the outer peripheral sides which are more outside than the center portions of the pressure chambers 40, and the second regions corresponding to the beam portions 41 (see FIG. 4). Therefore, although being lower in effect of suppressing crosstalk and effect of contributing to volumetric changes, the point that these effects are exhibited is the same as described above.

Figure 10:
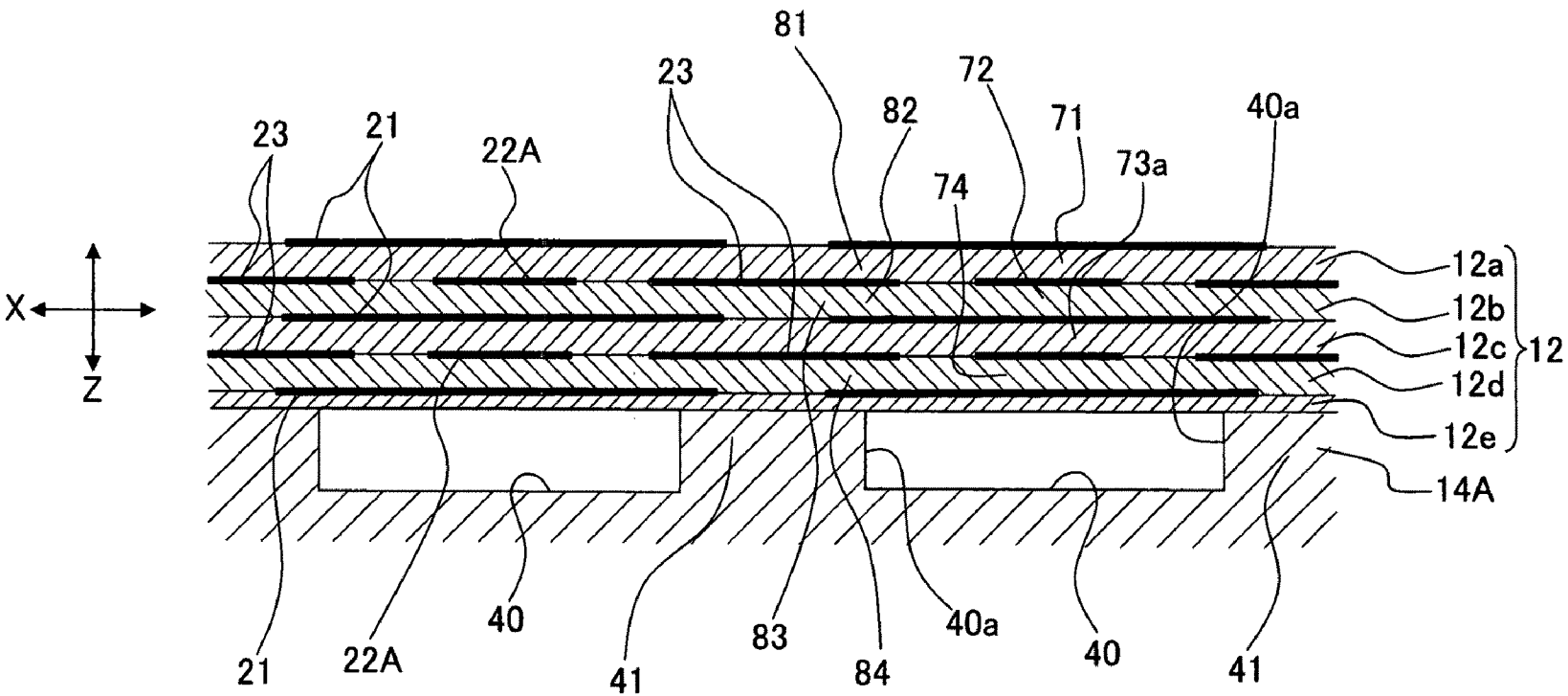
FIG. 10 is a view similar to FIG. 4 regarding a different modification example of the first embodiment.

Furthermore, as shown in FIG. 10, it can also be a structure in which a piezoelectric material layer 12*d* is provided, without providing the top plate, on the upper side of the cavity plate 14A via an insulating layer 12*e* having a small layer thickness, and first and second active portions are formed in this piezoelectric material layer 12*d*. In this case, in the piezoelectric material layer 12*d*, similarly to the piezoelectric material layer 12*b*, the first and second constant potential electrodes 22A, 23 are formed alternately on one surface (upper surface), and the individual electrodes 21 are formed

TABLE 2

| | ELECTRODE WIDTH (μm) | | | | ADJACENT | |
|---|---|---|---|---|---|---|
| | INDIVIDUAL ELECTRODE | FIRST CONSTANT POTENTIAL ELECTRODE | SECOND CONSTANT POTENTIAL ELECTRODE | CROSS-SECTIONAL AREA CHANGE ($\mu m^2$) | CROSS SECTIONAL AREA CHANGE ($\mu m^2$) | ADJACENT CHANGE RATIO |
| CONVENTIONAL EXAMPLE | 250 | FULL | — | 5.82 | 1.38 | 24% |
| first embodiment | 480, 320 | 120 | 188 | 6.02 | 0.69 | 11% |
| second embodiment | 480, 320 | 220 | 220 | 6.56 | 0.74 | 11% |
| fifth embodiment | 408 | 140 | 300 | 5.10 | 0.10 | 2% |
| eighth embodiment | 408 | FULL | 250 | 5.63 | 0.70 | 12% |
| eleventh embodiment | 480 | FULL | 250 | 5.89 | 0.18 | 3% |

Figure 8:
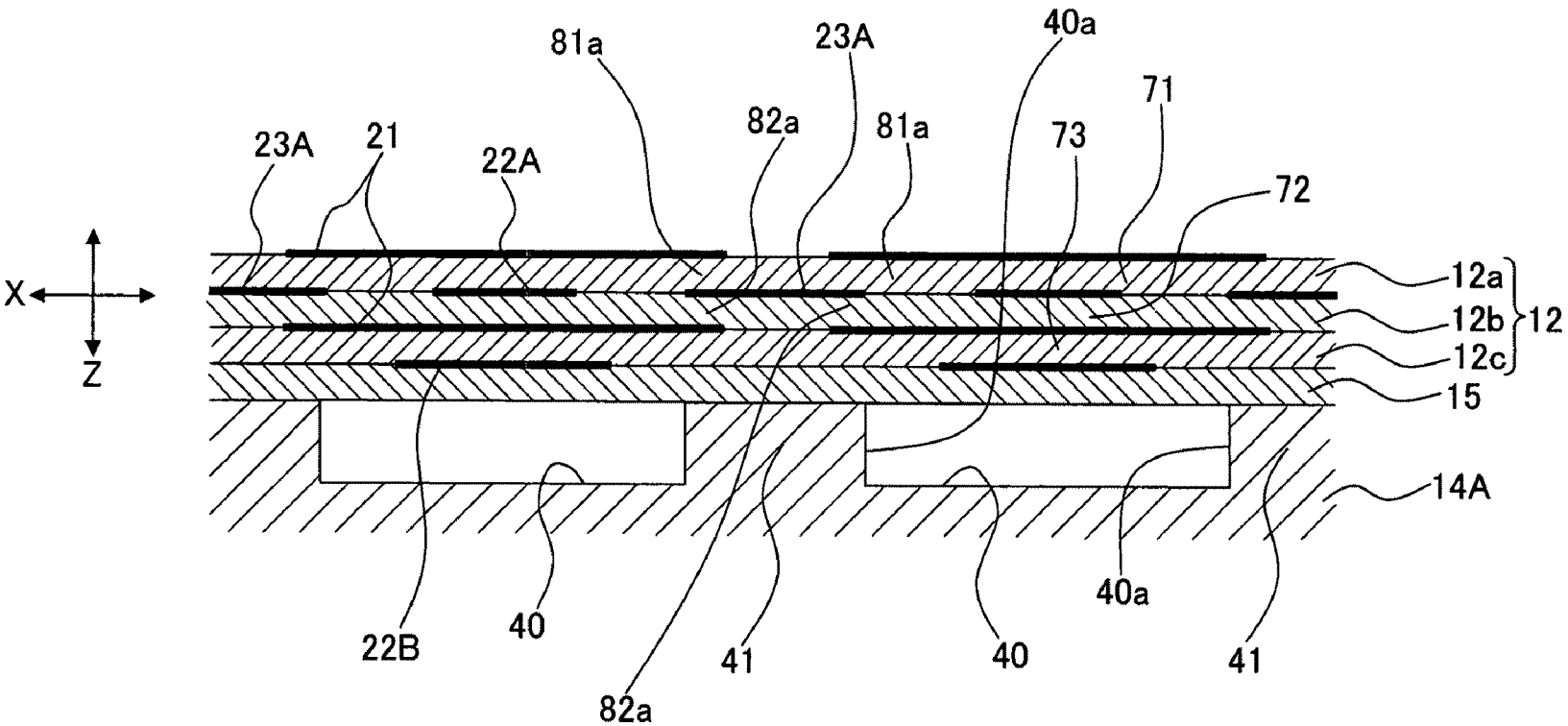
FIG. 8 is a view similar to FIG. 4 regarding a modification example of the first embodiment.

In the first embodiment, the second active portions 81, 82 are arranged across the first regions and the second regions, the first regions corresponding to the portions on the outer peripheral sides which are more outside than the center portions of the pressure chambers 40 in the nozzle row direction X, and the second regions corresponding to the beam portions 41. However, it is also possible to structure as shown in FIG. 8. That is, it is also possible to structure such that the second constant potential electrodes 23A are provided only in the regions corresponding to the beam portions 41 irrelevantly to the regions corresponding to the pressure chambers 40, and second active portions 81*a*, 82*a* exist only in the regions corresponding to the beam portions 41. In this case, even when voltage is applied to the second active portions 81*a*, 82*a* and the second active portions 81*a*, 82*a* deform, it does not contribute to increasing of the volumes of the pressure chambers 40, but the effect of suppressing crosstalk is exhibited.

on the other surface (lower surface). Accordingly, there are formed first active portions 71, 72, 73*a*, 74 corresponding respectively to the center portions of the pressure chambers 40, and second active portions 81, 82, 83, 84 corresponding respectively to portions on outer peripheral sides thereof.

Figure 11A:
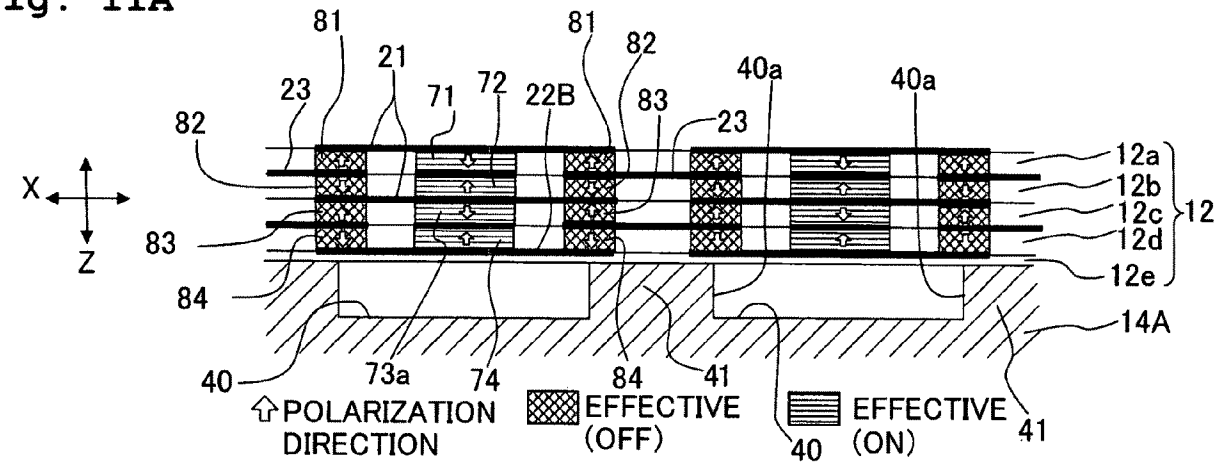
FIGS. 11A, 11B are views similar to FIGS. 6A, 6B respectively regarding the different modification example (see FIG. 10) of the first embodiment.
Figure 11B:
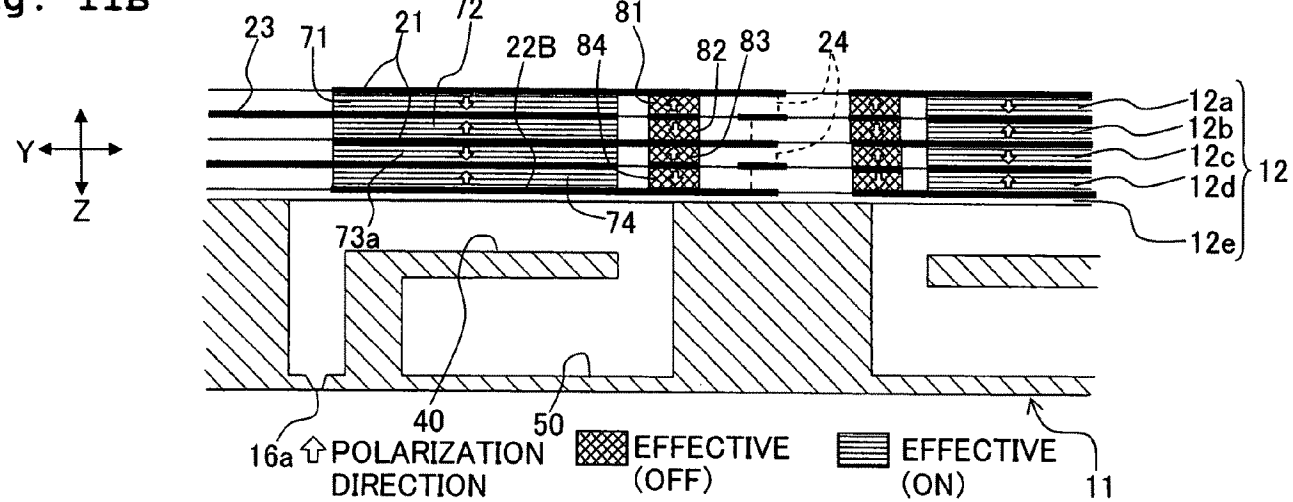

Incidentally, a relationship among the polarization direction, portions (first active portions) which are effective while being turned ON and effective during application of voltage and portions (second active portions) which are effective while being turned OFF and effective during non-application of voltage is shown in FIGS. 11A, 11B.

In this manner, the first active portions 71, 72, 73*a*, 74 and the second active portions 81, 82, 83, 84 both perform deformation of vertical effect, not the uniform deformation, and hence the second active portions 81 to 84 cannot deform to bend away from the pressure chambers 40 like the uniform deformation (that is, deformation in a direction to enlarge the pressure chambers 40). Therefore, the effect of suppressing crosstalk can be obtained, but the effect of increasing volumetric changes of the pressure chambers 40 cannot be obtained.

Figure 12:
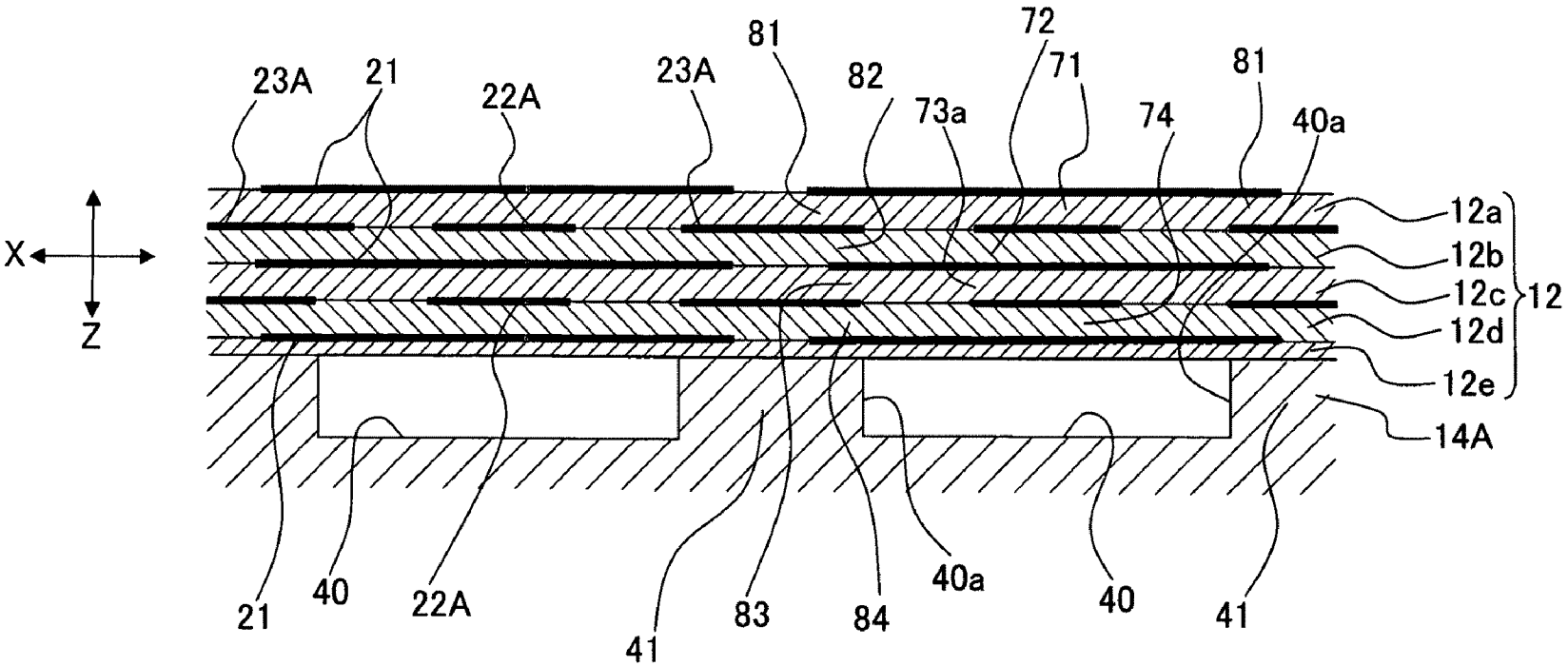
FIG. 12 is a view similar to FIG. 4 regarding a further different modification example of the first embodiment.

Further, also regarding the structure in which the second constant potential electrodes 23A are provided only in the regions corresponding to the beam portions 41 (see FIG. 8), similarly it can also be a structure as a matter of course in which the piezoelectric material layer 12*d* is provided on the side of the pressure chambers 40 via the insulating layer 12*e* having a small layer thickness. In this case, as shown in FIG. 12, in the piezoelectric material layer 12*d*, similarly to the piezoelectric material layer 12*b*, the first and second constant potential electrodes 22A, 23A are arranged alternately on one surface (upper surface), and the individual electrodes 21 are arranged on the other surface (lower surface). Accordingly, there are formed first active portions 71, 72, 73*a*, 74 corresponding respectively to the center portions of the pressure chambers 40, and second active portions 81, 82, 83, 84 corresponding respectively to portions on outer peripheral sides thereof.

Figure 13A:
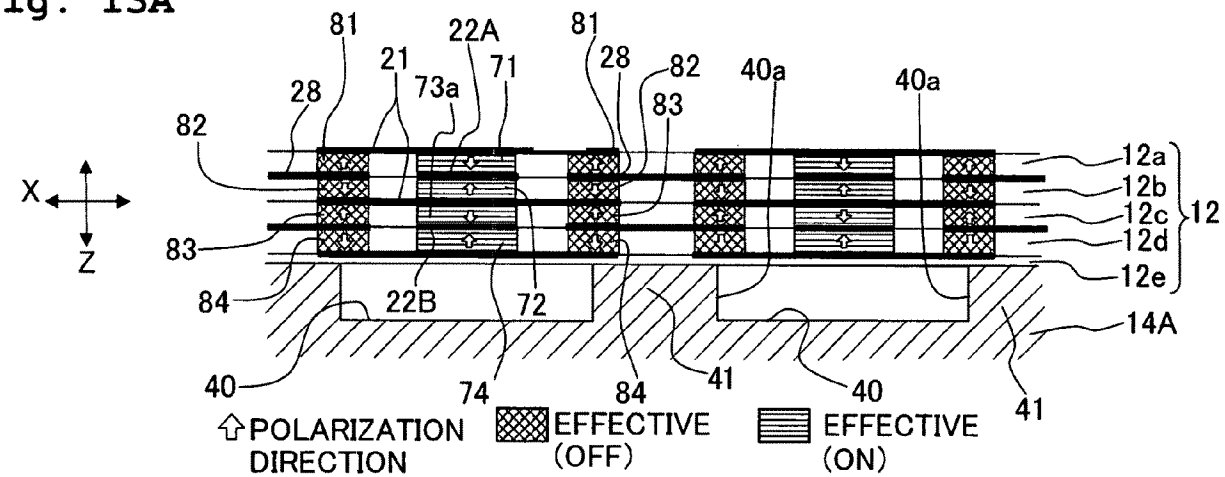
FIGS. 13A, 13B are views similar to FIGS. 6A, 6B respectively regarding the further different modification example of the first embodiment.
Figure 13B:
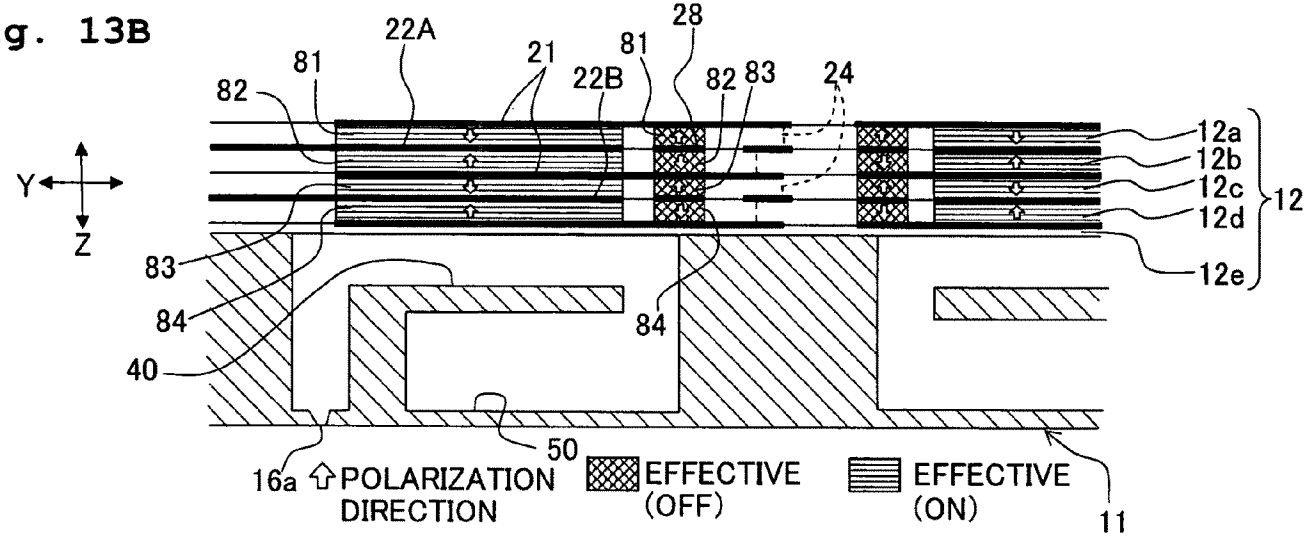

Incidentally, a relationship among the polarization direction, portions (first active portions) which are effective while being turned ON and effective during application of voltage and other portions (second active portions) which are effective while being turned OFF and effective during non-application of voltage is shown in FIGS. 13A, 13B.

As in the first embodiment, when forming the first and second constant potential electrodes 22A, 23 on the same surface alternately in the nozzle row direction X, it is not possible to take large intervals between these electrodes, and hence the lengths of these electrodes in the nozzle row direction cannot be taken long. However, as shown in the next second embodiment, an insulating layer with a small layer thickness can be used to increase the lengths of them.

Second Embodiment

Figure 14:
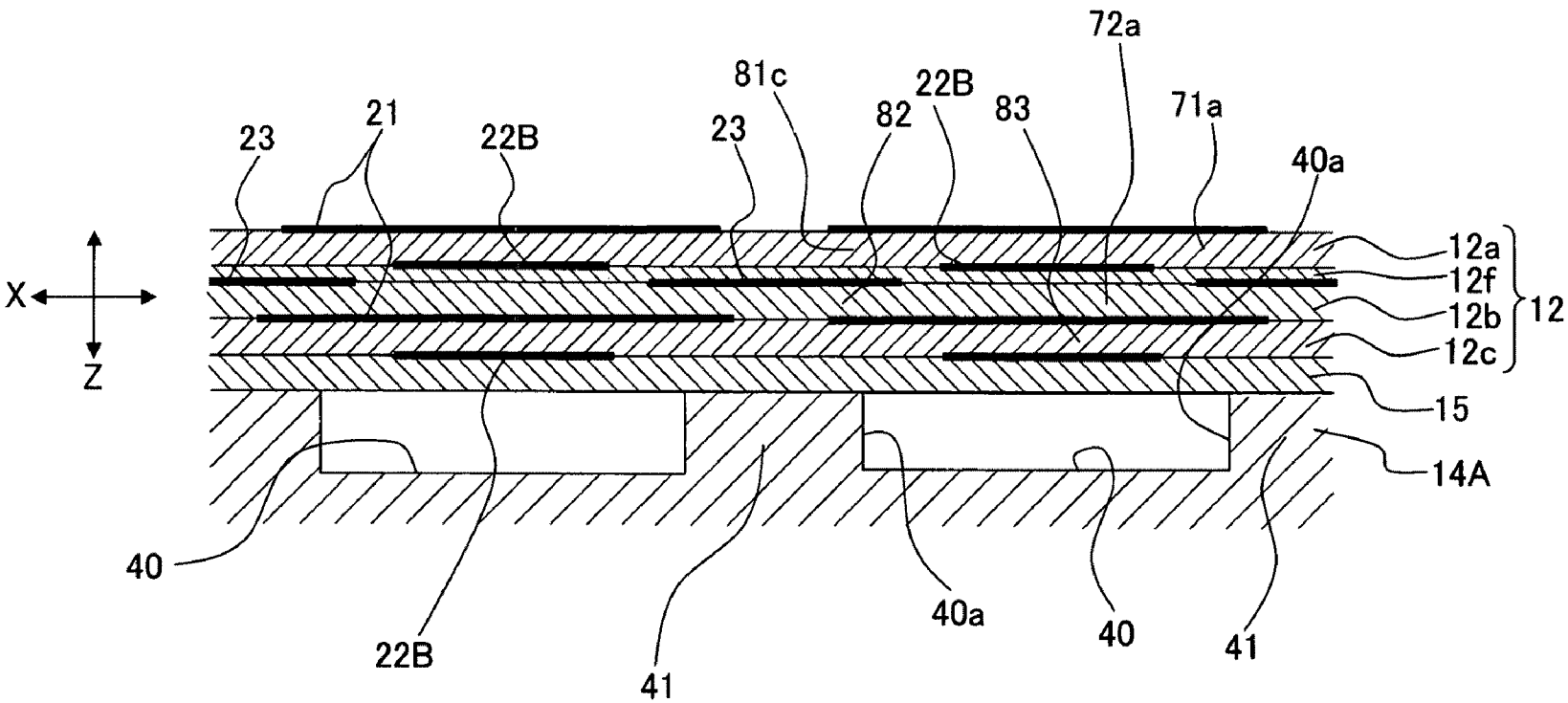
FIG. 14 is a view similar to FIG. 4 regarding the second embodiment.

In this embodiment, as shown in FIG. 14, the piezoelectric actuator has a stacked structure in which an insulating layer 12*f* having a smaller layer thickness than the piezoelectric material layers 12*a*, 12*b* is sandwiched between the piezoelectric material layer 12*a* and the piezoelectric material layer 12*b*. Note that this insulating layer 12*f* can be formed of the same material as the piezoelectric material layers 12*a* to 12*d*.

Only first constant potential electrodes 22B are formed on one surface (upper surface) side of this insulating layer 12*f* at a constant pitch, and only second constant potential electrodes 23 are formed on the other surface (lower surface) side thereof at a constant pitch. Accordingly, the first constant potential electrodes 22B and the second constant potential electrodes 23 are electrically isolated with the insulating layer 12*f*, but similarly to the case of the first embodiment, they are formed between the piezoelectric material layer 12*a* and the piezoelectric material layer 12*b*. Thus, there are formed first active portions 71*a*, 72*a*, 73 corresponding respectively to the center portions of the pressure chambers 40, and second active portions 81*c*, 82 corresponding respectively to portions on outer peripheral sides thereof.

In this manner, since the first constant potential electrodes 22B and the second constant potential electrodes 23 are isolated by being sandwiching the insulating layer 12*f* therebetween, the lengths in the nozzle row direction of the first constant potential electrodes 22B formed between the piezoelectric material layer 12*a* and the piezoelectric material layer 12*b* can be made long, thereby realizing an electrode arrangement which is advantageous for increasing volumetric changes of the pressure chambers 40. Also in the case of the second embodiment, as shown in Table 2, the ratio of changes of cross-sectional areas of adjacent pressure chambers is 11%. Similarly to the case of the first embodiment, the change ratio decreases to almost half as compared to the case of the conventional example, and it can be seen that the effect of suppressing crosstalk is exhibited.

Using such an insulating layer with a small layer thickness, it can also be a structure as described in the next third embodiment.

Third Embodiment

Figure 15:
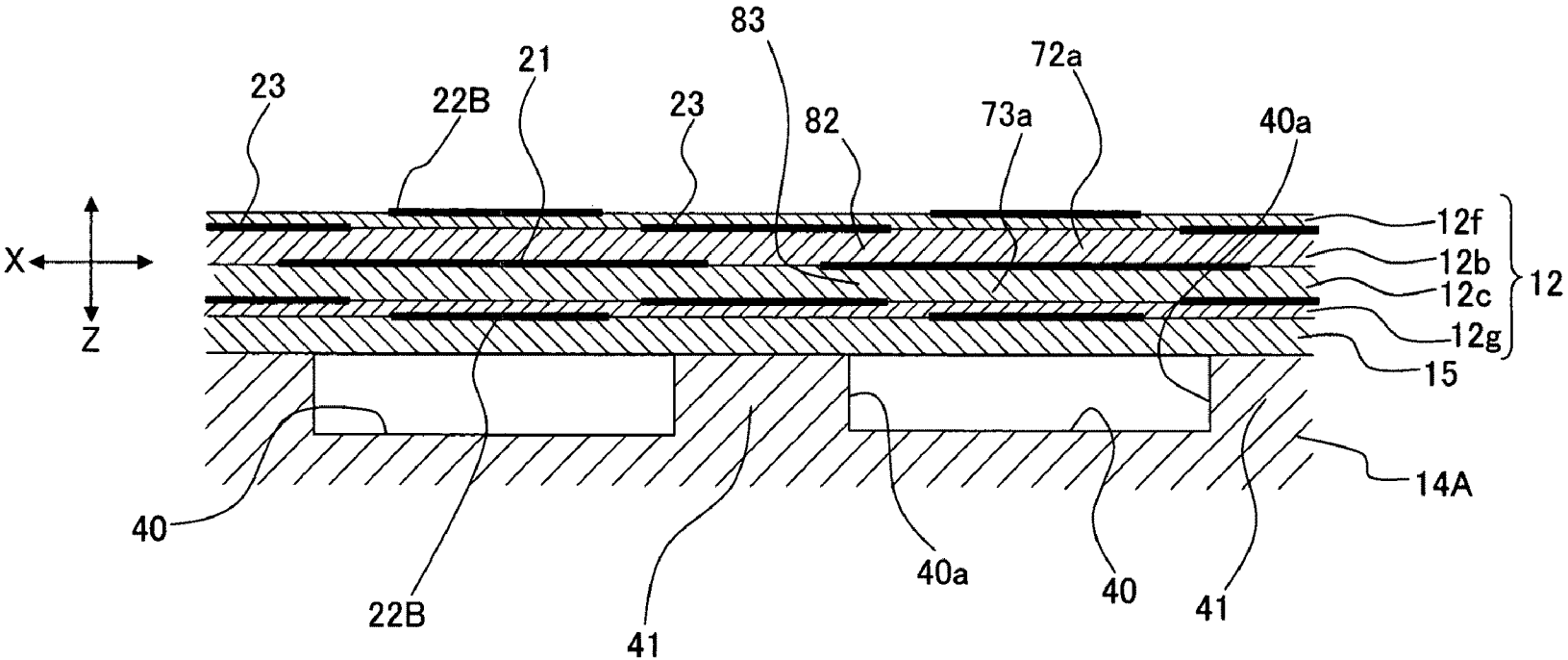
FIG. 15 is a view similar to FIG. 4 regarding the third embodiment.

In this embodiment, as shown in FIG. 15, the uppermost piezoelectric material layer 12*a* in the second embodiment is omitted, and instead, another insulating layer 12*g* with a small layer thickness similar to the insulating layer 12*f* is arranged between the piezoelectric material layer 12*c* and the top plate 15. Second constant potential electrodes 23 are formed on an upper surface side of the insulating layer 12*g*, and first constant potential electrodes 22B are formed on a lower surface side thereof. In this case, the first and second constant potential electrodes 22B, 23 are formed symmetrically sandwiching the individual electrodes 21 arranged on the lower surface side of the piezoelectric material layer 12*b*. Accordingly, there are formed first active portions 72*a*, 73*a* corresponding respectively to the center portions of the pressure chambers 40, and second active portions 82,83 corresponding respectively to portions on outer peripheral sides thereof.

Further, only one layer may exist as the piezoelectric material layers described above, and it can also be a structure as described in the next fourth embodiment.

Fourth Embodiment

Figure 16:
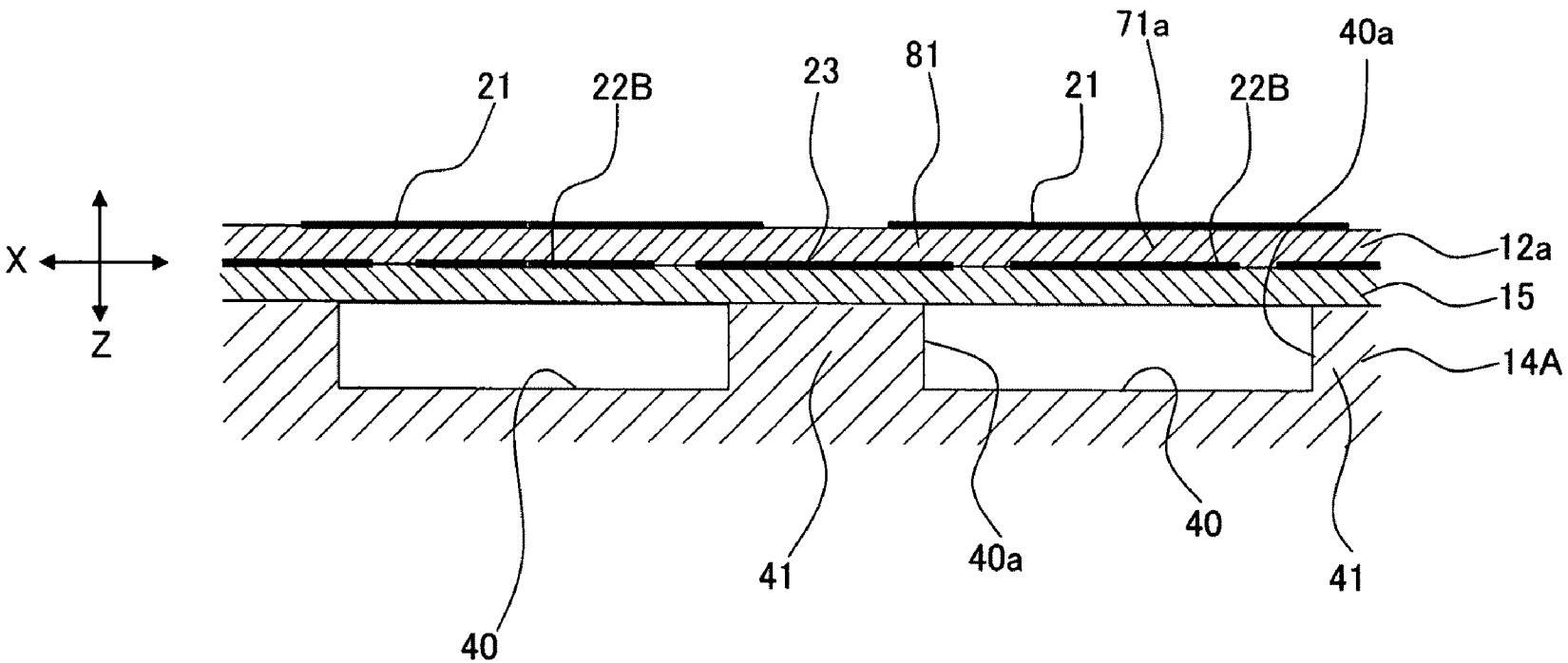
FIG. 16 is a view similar to FIG. 4 regarding the fourth embodiment.

In this example, as shown in FIG. 16, individual electrodes 21 are formed on one surface (upper surface) side of a piezoelectric material layer 12*a*, and first and second constant potential electrodes 22B, 23 are formed alternately in the nozzle row direction on the other surface (lower surface) side. Accordingly, there are formed first active portions 71*a* corresponding respectively to the center portions of the pressure chambers 40, and second active portions 81, 81 corresponding respectively to both sides of portions on outer peripheral sides thereof.

With this structure, the top plate 15 functions as a binding plate. Although the number of piezoelectric material layers is smaller than in the first to third embodiments and the amount of deformation becomes smaller, excellent jetting efficiency can be realized by unimorph deformation even with one piezoelectric material layer 12*a*.

Also in such a case of having one piezoelectric material layer, as described in the next fifth embodiment, it is also possible to have a structure using an insulating layer with a small layer thickness.

Fifth Embodiment

Figure 17:
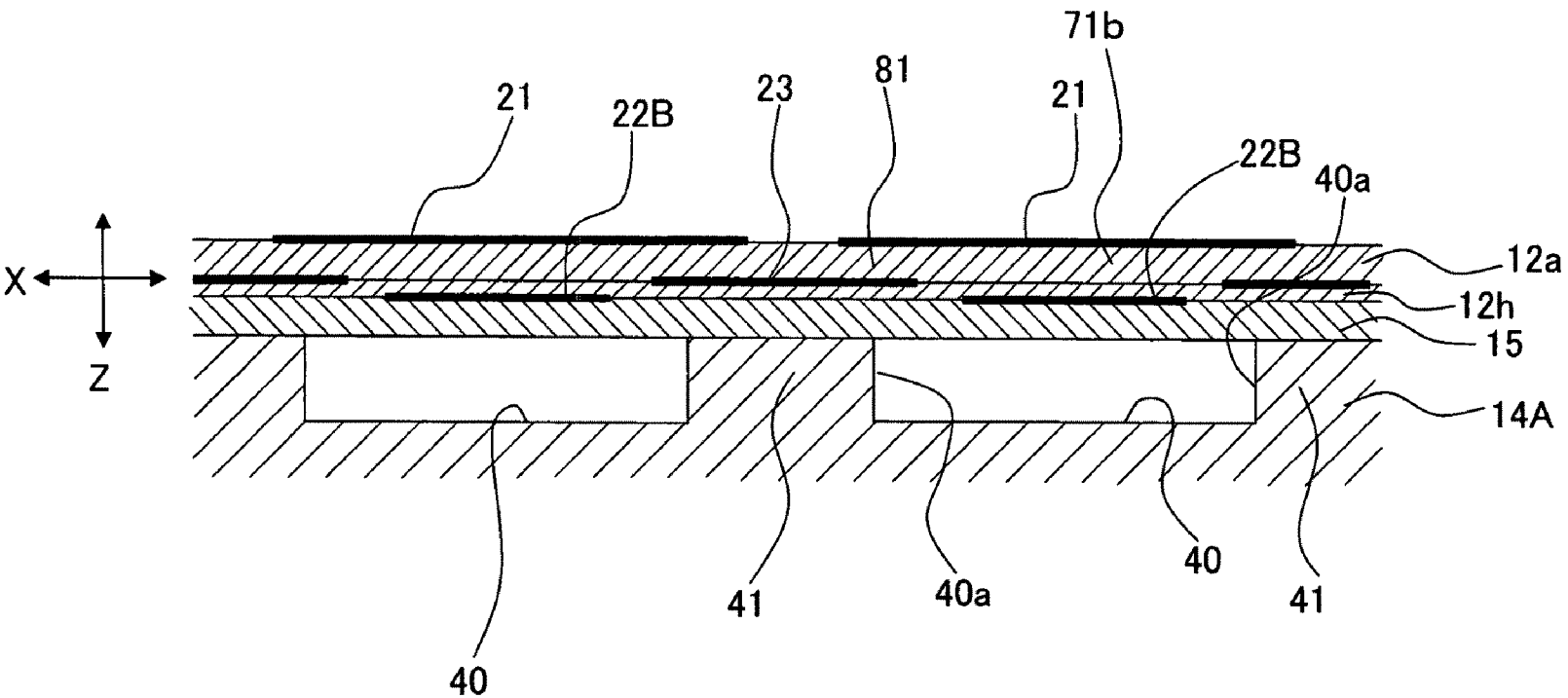
FIG. 17 is a view similar to FIG. 4 regarding the fifth embodiment.

In this embodiment, as shown in FIG. 17, there is provided a structure sandwiching an insulating layer 12*h* between the piezoelectric material layer 12*a* and the top plate 15. Individual electrodes 21 are formed on an upper surface side of the piezoelectric material layer 12*a*, and second constant potential electrodes 23 are formed on a lower surface side thereof. Then first constant potential electrodes 22B are formed on a lower surface side of the insulating layer 12*h*. Accordingly, there are formed first active portions 71*b* corresponding respectively to the center portions of the pressure chambers 40, and second active portions 81 corresponding respectively to portions on outer peripheral sides thereof.

Figure 18B:
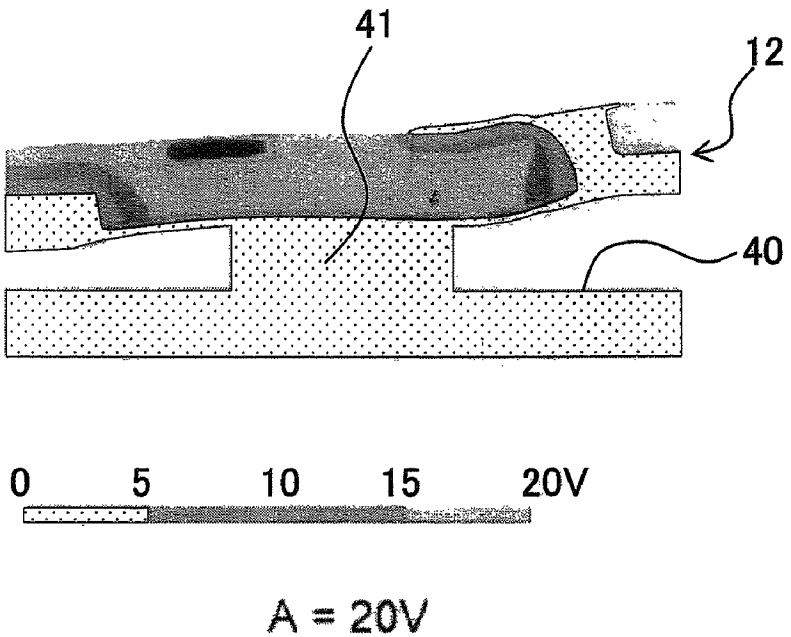
FIGS. 18A, 18B are views similar to FIGS. 7A, 7B respectively regarding the fifth embodiment.
Figure 18A:
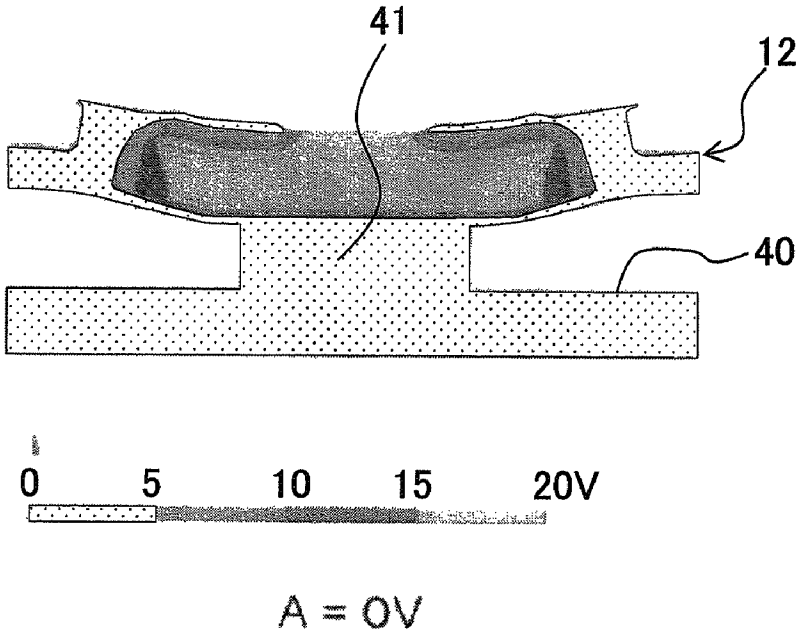

Also in this case, it can be seen that the effect of suppressing crosstalk is exhibited by application/non-application of voltage as shown in FIGS. 18A, 18B. In the case of the fifth embodiment, as shown in Table 2, the ratio of changes of cross-sectional areas of adjacent pressure chambers is 2%, and this change ratio decreases significantly as compared to the conventional example. It can be seen that the effect of suppressing crosstalk is quite large.

When it is not necessary to provide, as in the above-described embodiments, the second active portions on both sides of the first active portions, and it is just needed to exhibit the effect of suppressing crosstalk only on one sides of the first active portions, the second active portions can be provided only on one sides of the first active portions, as described in sixth embodiment.

Sixth Embodiment

Figure 19:
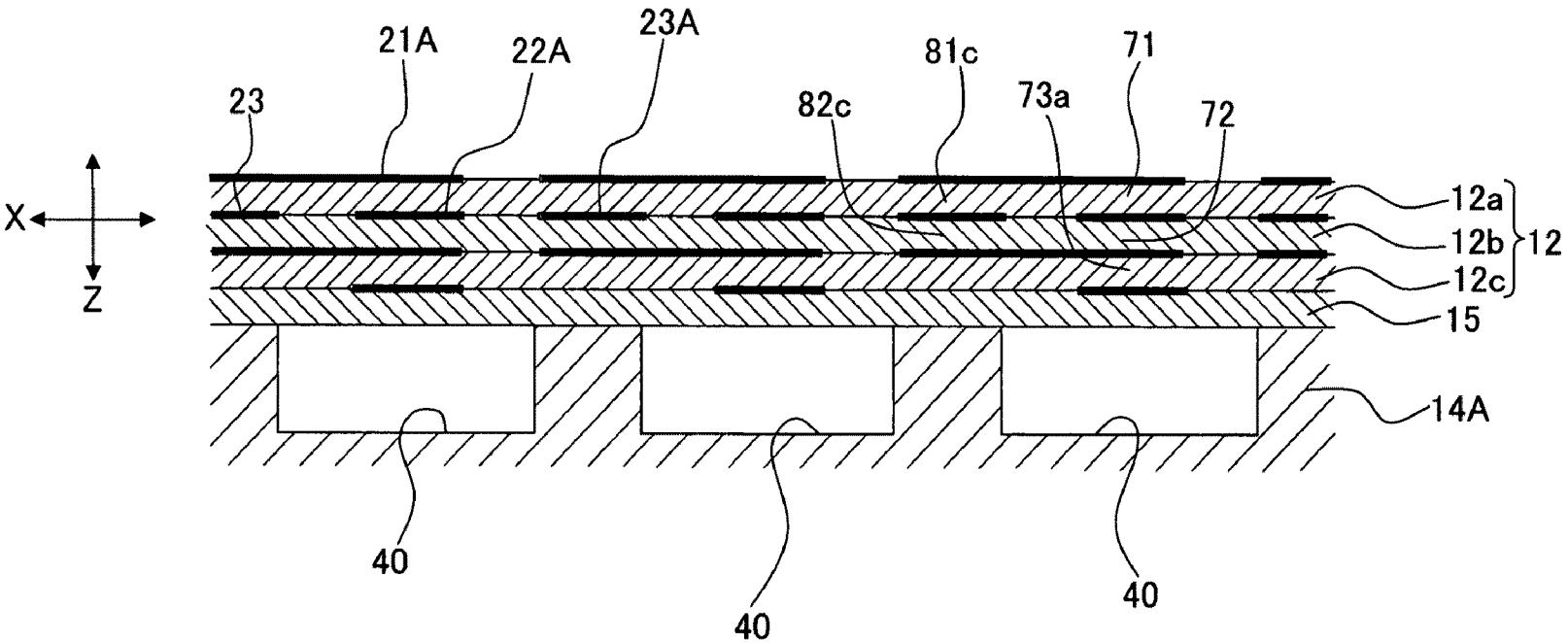
FIG. 19 is a view similar to FIG. 4 regarding the sixth embodiment.

In this embodiment, as shown in FIG. 19, individual electrodes 21A are arranged in parts of regions corresponding to the pressure chambers 40 and regions corresponding to the beam portions 41.

Then the individual electrodes 21A are formed on one surface (upper surface) side of the piezoelectric material layer 12*a*, and first and second constant potential electrodes 22A, 23A are formed corresponding respectively to side portions of the individual electrodes 21A on the other surface (lower surface) side thereof. Further, individual electrodes 21A are formed on an upper surface side of the piezoelectric material layer 12*c*, and first constant potential electrodes 22A are formed on a lower surface side thereof. Accordingly, there are formed first active portions 71, 72, 73*a* corresponding respectively to the center portions of the pressure chambers 40, and second active portions 81*c*, 82*c* corresponding respectively to portions of outer peripheral sides thereof.

With such a structure, the effect of suppressing crosstalk can be exhibited only on the side where the second active portions 81*c*, 82*c* are arranged.

Further, as in the next seventh embodiment, it is also possible to form first constant potential electrodes extending along the nozzle row direction, and to have them in common for the pressure chambers formed in rows in the nozzle row direction.

Seventh Embodiment

Figure 20:
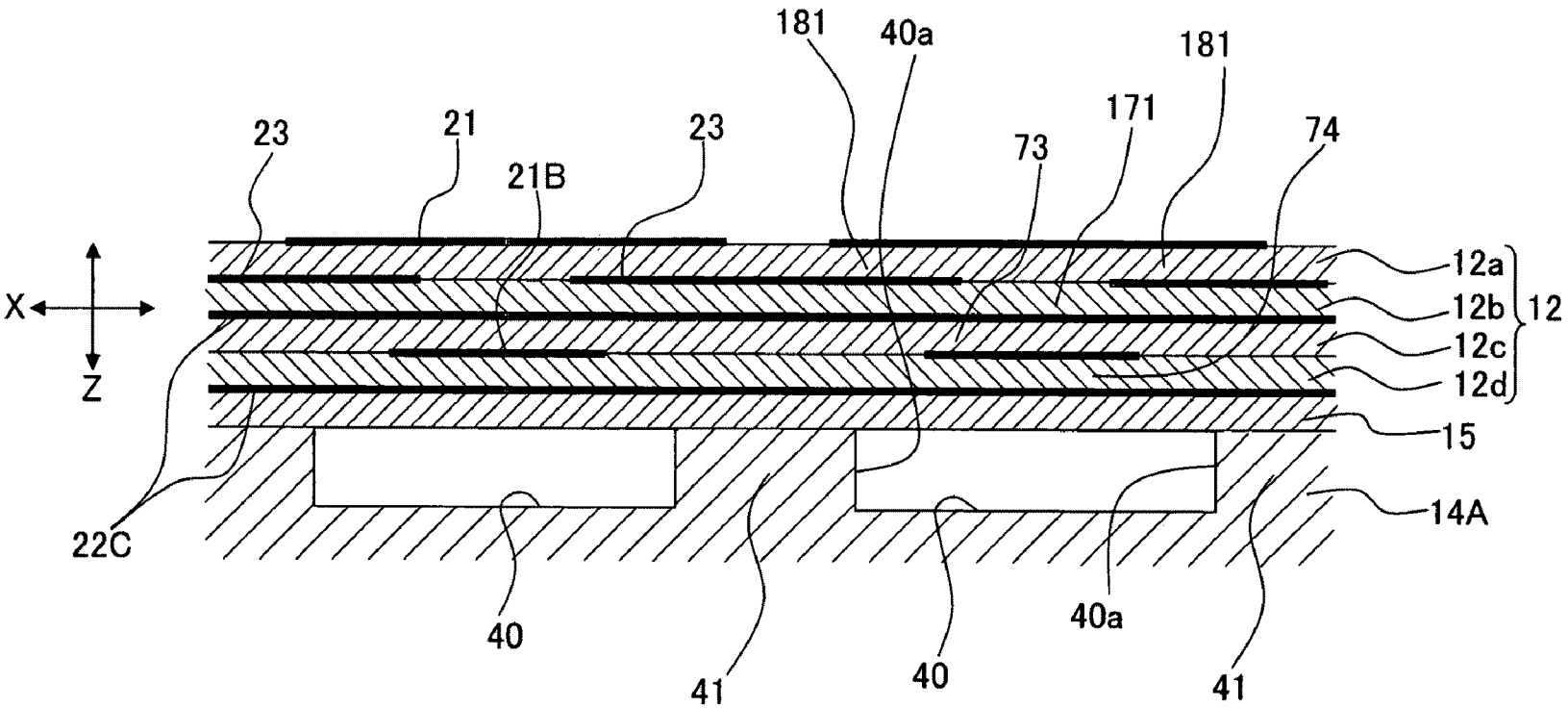
FIG. 20 is a view similar to FIG. 4 regarding the seventh embodiment.

In this example, as shown in FIG. 20, there are provided four piezoelectric material layers 12*a* to 12*d*. Individual electrodes 21 are formed on one surface (upper surface) side of the piezoelectric material layer 12*a* farthest from the pressure chambers 40, and second constant potential electrodes 23 are formed on the other surface (lower surface) side thereof. Then first constant potential electrodes 22C are formed on one surface side of a piezoelectric material layer 12*c* that is third one from the piezoelectric material layer 12*a* toward the pressure chambers 40, and individual electrodes 21B are formed on the other surface side thereof. Then first constant potential electrodes 22*c* are formed on a side of the pressure chambers 40 of a piezoelectric material layer 12*d* that is fourth one from the piezoelectric material layer 12*a* toward the pressure chambers 40. Accordingly, there are formed first active portions 171, 73, 74 corresponding respectively to the center portions of the pressure chambers 40, and second active portions 181 corresponding respectively to portions on outer peripheral sides thereof.

Figure 21:
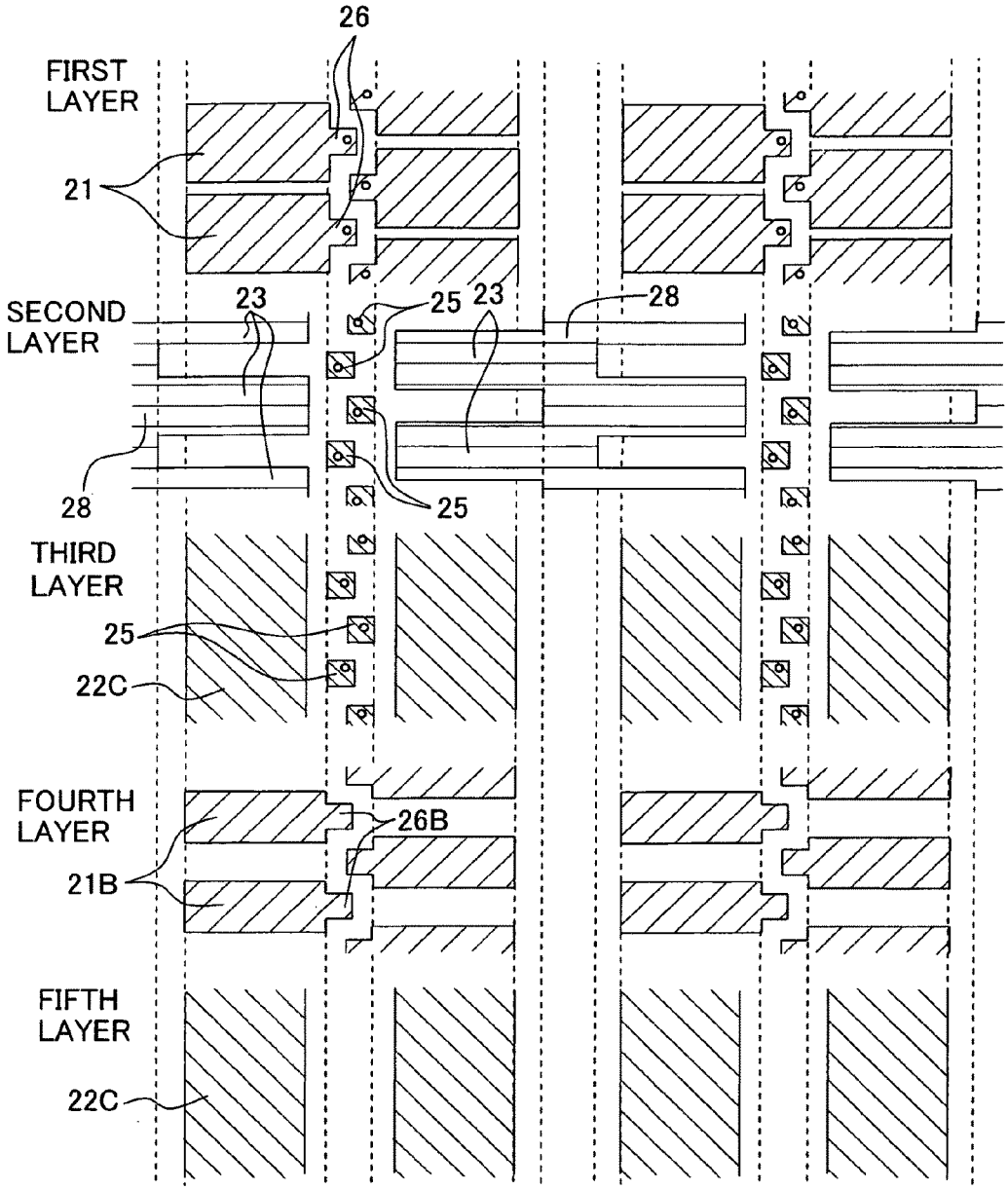
FIG. 21 is a view similar to FIG. 5 regarding the seventh embodiment.

Then the electrodes 21, 22B, 22C, 23 of the respective piezoelectric material layers 12*a* to 12*d* are arranged as shown in FIG. 21 in a plan view. Namely, on an upper surface side (first layer) of the piezoelectric material layer 12*a* and a lower surface side (third layer) of the piezoelectric material layer 12*c*, individual electrodes 21, 21B are formed at a constant pitch in the nozzle row direction X corresponding respectively to the pressure chambers 40. Then the adjacent individual electrodes 21, 21B are formed to be shifted by a half pitch in the nozzle row direction. Between these rows, connection terminals 26, 26B of the individual electrodes 21, 21B are formed in a zigzag pattern. Then connection terminals (not shown) of the flexible wiring board 13 are connected to connection terminal portions 26 of the individual electrodes 21. These connection terminal portions 26 of the individual electrodes 21 are connected electrically to the connection terminal portions 26B of the respective individual electrodes 21B via through holes 24 (filled with conductive materials inside) penetrating the piezoelectric material layers 12*a* to 12*c* and via middle electrodes 25 formed on a lower surface side of the piezoelectric material layer 12*a* and an upper surface side of the piezoelectric material layer 12*c* (see FIG. 22B). Note that the individual electrodes 21 on the upper surface side of the piezoelectric material layer 12*a* are formed longer than the individual electrodes 21B on the lower surface side of the piezoelectric material layer 12*c* in length in the nozzle row direction.

Further, on the lower surface side of the piezoelectric material layer 12*a*, second constant potential electrodes 23 are formed at a constant pitch in the nozzle row direction corresponding to the pressure chambers 40, and one ends thereof are connected to one of common electrodes 28 extending in the nozzle row direction. Further, on the upper surface side of the piezoelectric material layer 12*c* and on a lower surface side of the piezoelectric material layer 12*d*, first constant potential electrodes 22C are formed to extend in the nozzle row direction corresponding respectively to the pressure chambers 40.

Figure 22A:
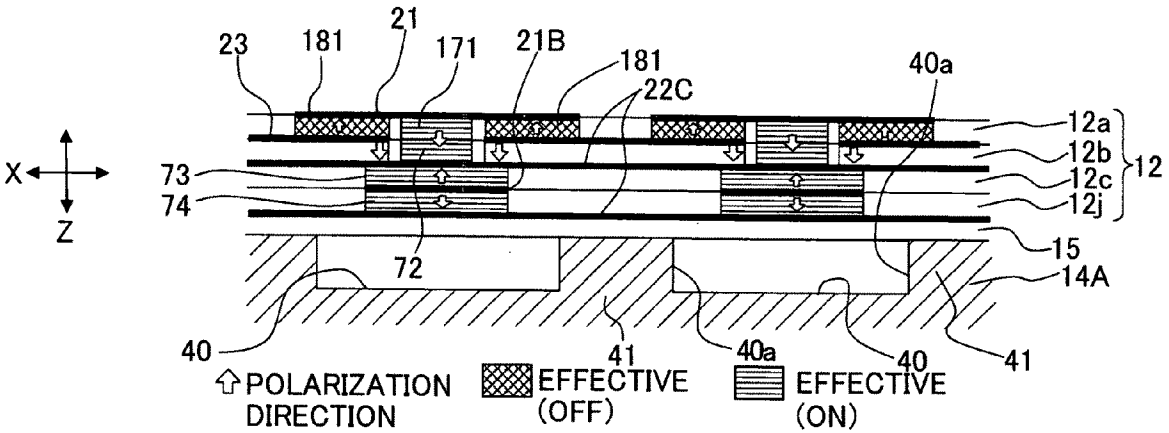
FIGS. 22A, 22B are views similar to FIGS. 6A, 6B respectively regarding the seventh embodiment.
Figure 22B:
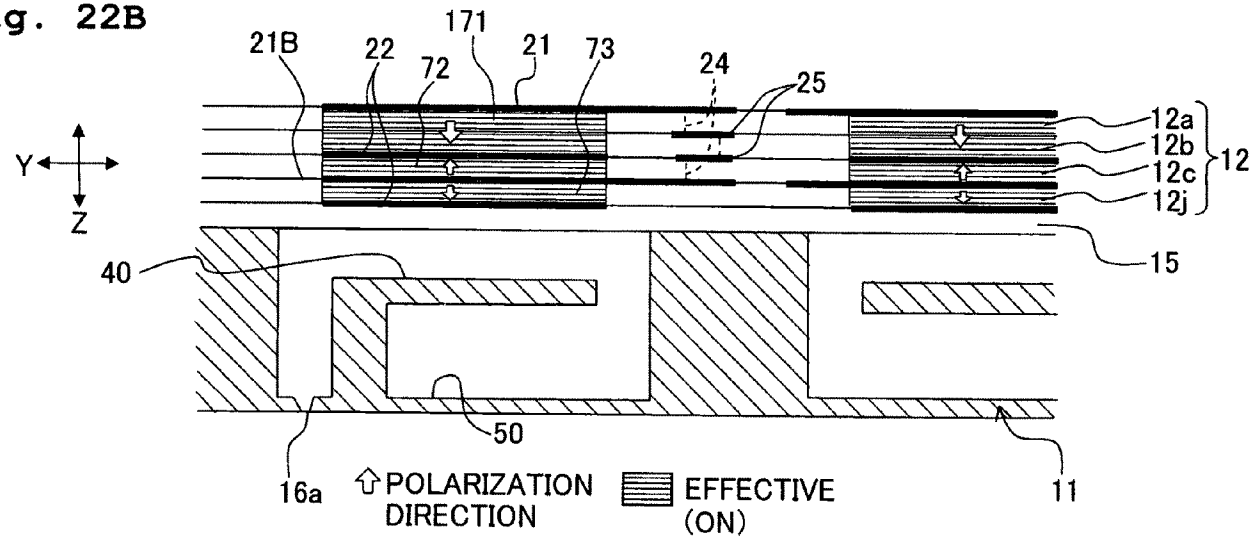

Thus, since the first constant potential electrodes 22C are formed in the nozzle row direction X and are shared by the pressure chambers 40 in the nozzle row direction, the arrangement of the electrodes 21, 21B, 22C, 23 becomes simple, which is advantageous for making the apparatus compact. Incidentally, a relationship among the polarization direction, portions (first active portions) which are effective while being turned ON and effective during application of voltage and portions (second active portions) which are effective while being turned OFF and effective during non-application of voltage is shown in FIGS. 22A, 22B.

In the above-described first, second, fourth to seventh embodiments, since the connection portions to the flexible wiring board 13 are arranged on the piezoelectric material layer 12*a* which is farthest from the pressure chambers, there is a fear that during connection with solder, dispersion of deformation characteristics due to flowing in of the solder occurs. Accordingly, as in the next eighth embodiment, such a problem can be avoided by arranging the individual electrodes between the piezoelectric material layer 12*a* and the piezoelectric material layer 12*b* located more inside, similarly to the case of the third embodiment.

Eighth Embodiment

In this embodiment, among the plurality of piezoelectric material layers forming the piezoelectric actuator, surface individual electrodes for connection are formed on one surface (farthest surface) side of the piezoelectric material layer (farthest layer) which is farthest from the pressure chambers, and individual electrodes are formed on the other surface side thereof.

Figure 23:
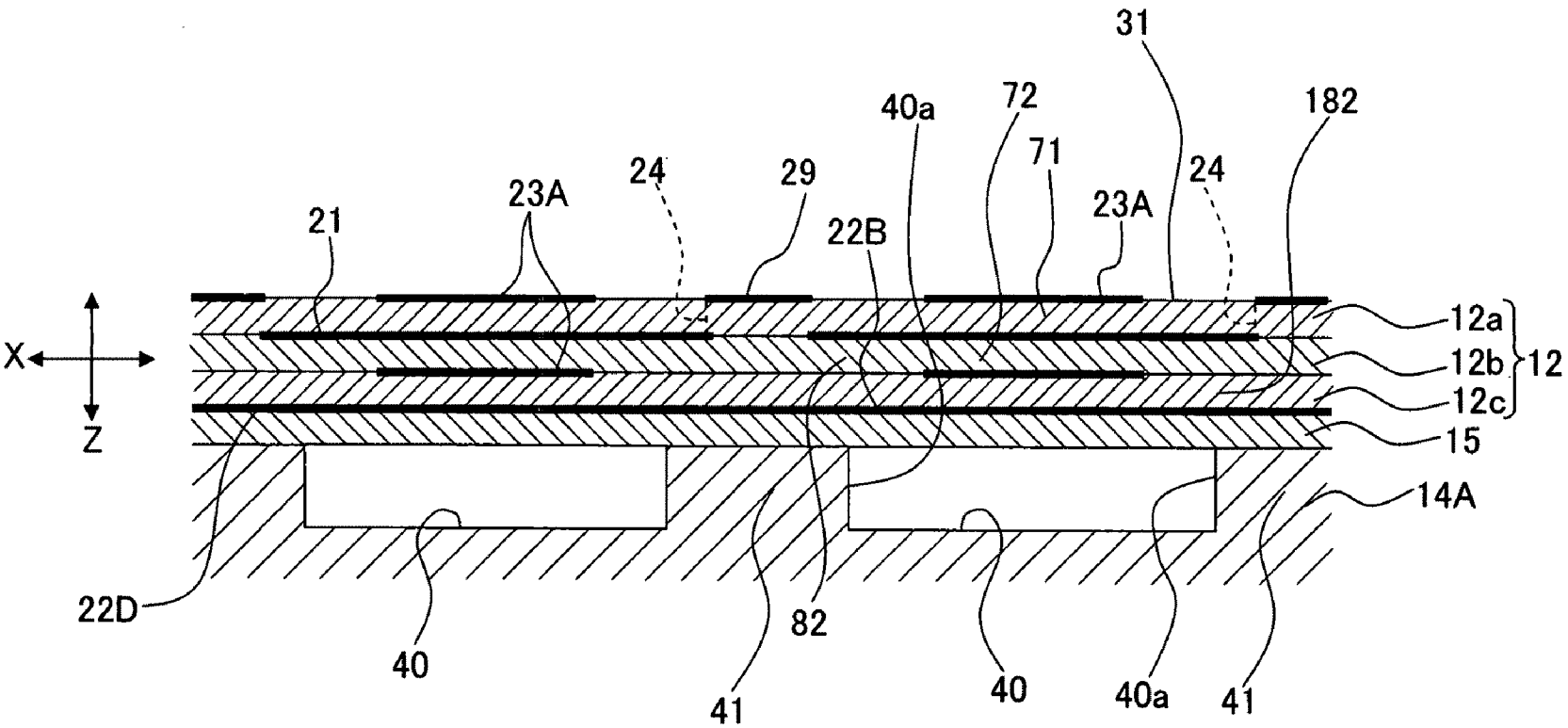
FIG. 23 is a view similar to FIG. 4 regarding the eighth embodiment.

As shown in FIG. 23, individual electrodes 21 and surface individual electrodes 29 are conducted to each other by conductive materials filled in through holes 24 penetrating the piezoelectric material layer 12*a*. Then first constant potential electrodes 22D are formed on a surface on the side of the pressure chambers 40 of the piezoelectric material layer 12*c* which is closest to the pressure chambers 40. On the other hand, second constant potential electrodes 23A are formed on a farthest surface 31, which is a surface on a side opposite to the pressure chambers 40, of the piezoelectric material layer 12*a* located farthest from the pressure chambers 40 of the plurality of piezoelectric material layers 12*a* to 12*c*.

The individual electrodes 21 are formed on a surface on the side of the pressure chambers 40 of the piezoelectric material layer 12*a*. That is, they are formed on a surface, which is a surface different from the farthest surface 31, of one of the piezoelectric material layers 12*a* to 12*c* and is a surface on the side of the pressure chambers 40 of the piezoelectric material layer 12*a* (farthest layer). Then the surface individual electrodes 29 to be input terminals to the individual electrodes 21 are formed in regions (regions corresponding to the beam portions 41) more outside than outer peripheral edges of the pressure chambers 40 of the farthest surface 31. These surface individual electrodes 29 and the individual electrodes 21 conduct to each other via the conductive materials 24 filled in the through holes penetrating the piezoelectric material layer 12*a*. The surface individual electrodes 29 are formed in regions of the farthest surface 31 between the adjacent pressure chambers 40 (regions corresponding to the so-called beam portions 41).

Accordingly, there are formed first active portions 71, 72 corresponding respectively to the center portions of the pressure chambers 40, and second active portions 182 corresponding respectively to portions on outer peripheral sides thereof. Therefore, the second active portions 182 are formed in the piezoelectric material layers 12*b*, 12*c* on the side of the pressure chambers 40, which are layers other than the farthest layer (piezoelectric material layer 12*a*) of the plurality of piezoelectric material layers 12*a* to 12*c*.

Figure 24:
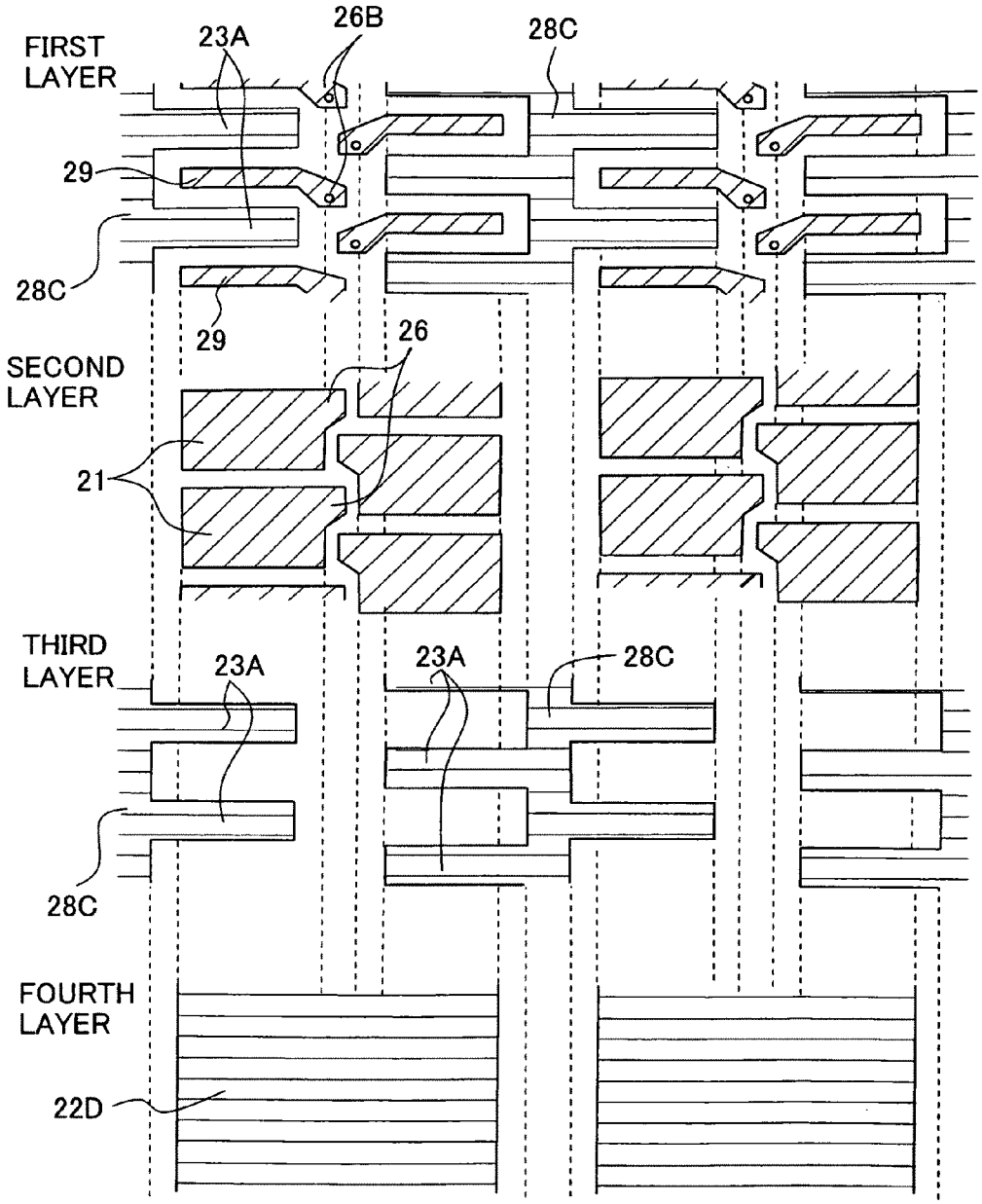
FIG. 24 is a view similar to FIG. 5 regarding the eighth embodiment.

Further, the electrodes 21, 22D, 23A formed on the surfaces of the piezoelectric material layers 12*a* to 12*c* are arranged as shown in FIG. 24, in a plan view. Specifically, on the upper surface sides of the piezoelectric material layers 12*a*, 12*c* (first layer, third layer), the second constant potential electrodes 23A are formed at a constant pitch in the nozzle row direction corresponding respectively to the pressure chambers 40, and the adjacent second constant potential electrodes 23A are formed to be shifted by a half pitch in the nozzle row direction. Then the surface individual electrodes 29 are formed corresponding respectively to the individual electrodes 21 between the second constant potential electrodes 23A in the nozzle row direction on the upper surface side of the piezoelectric material layer 12*a*. End portions of the surface individual electrodes 29 on sides opposite to the second constant potential electrodes 23A are formed in a zigzag pattern as connection terminal portions 26B which extend to portions between the adjacent pressure chambers 40 to be connected to the connection terminals of the flexible wiring board 13.

Figure 25A:
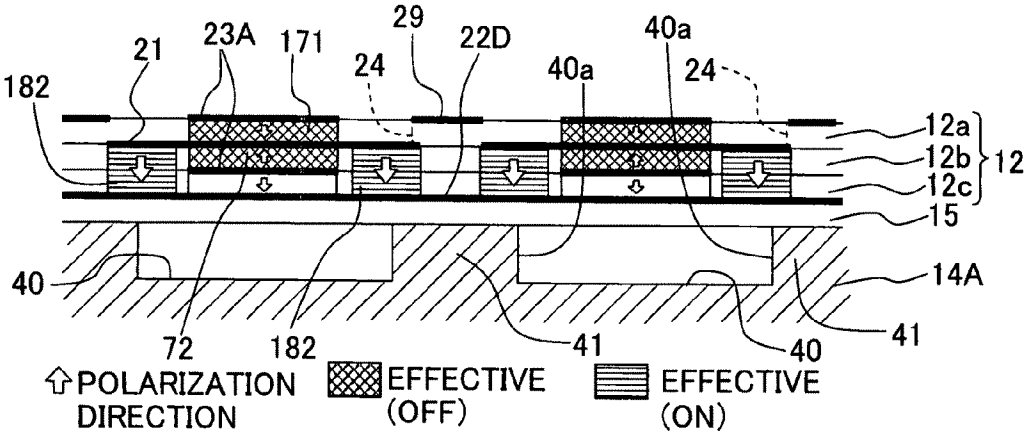
FIGS. 25A, 25B are views similar to FIGS. 6A, 6B respectively regarding the eighth embodiment.

On the lower surface side of the piezoelectric material layer 12*a*, the individual electrodes 21 are formed at a constant pitch in the nozzle row direction corresponding respectively to the pressure chambers 40, and connection terminal portions 26 thereof are connected respectively to the connection terminals 26B of the surface individual electrodes 29 using the conductive materials filled in the through holes 24 penetrating the piezoelectric material layer 12*a* (see FIG. 25A).

On the lower surface side of the piezoelectric material layer 12*c*, the first constant potential electrodes 22D which are in common to two adjacent rows of pressure chambers 40 are formed so as to extend in the nozzle row direction.

Thus, since the connection terminal portions 26B to which the connection terminals of the flexible wiring board 13 are connected are formed in the regions corresponding to the beam portions 41 which do not deform while driving, dispersion of deformation characteristics for the respective first active portions does not easily occur if solder flows in during connection with the connection terminals of the flexible wiring board 13.

Figure 25B:
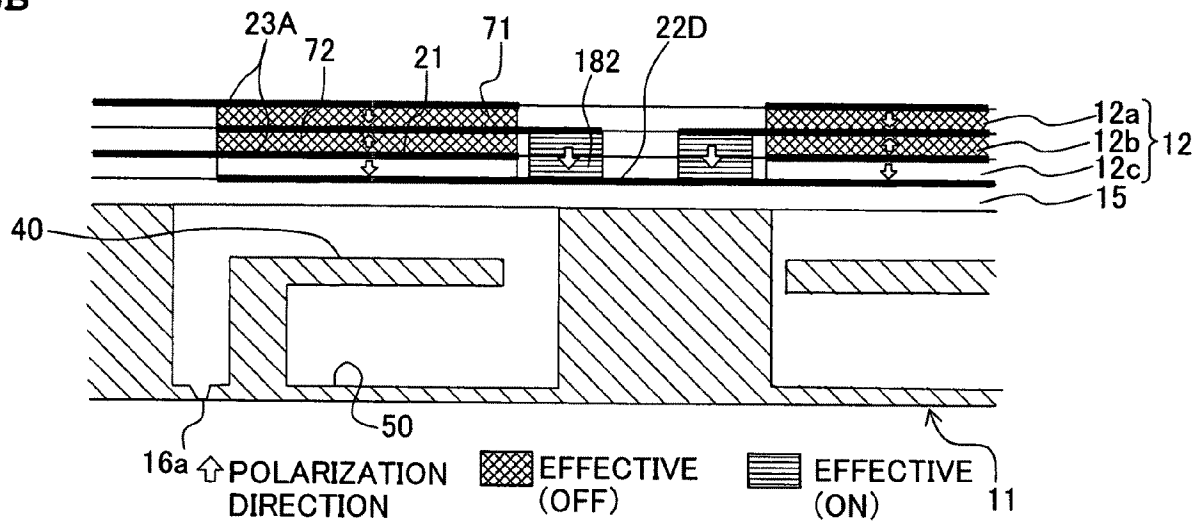
Figure 26B:
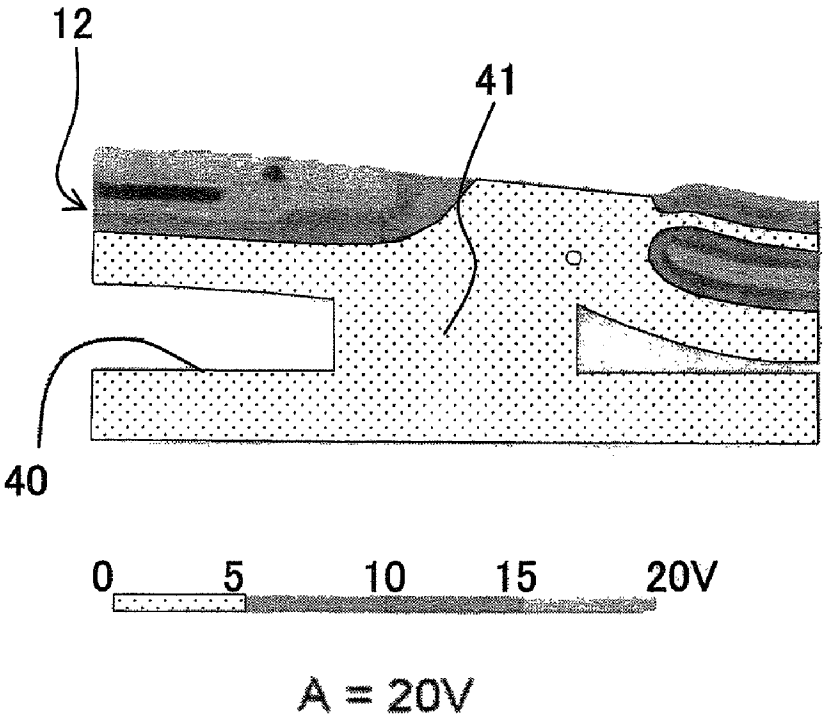
FIGS. 26A, 26B are views similar to FIGS. 7A, 7B respectively regarding the eighth embodiment.
Figure 26A:
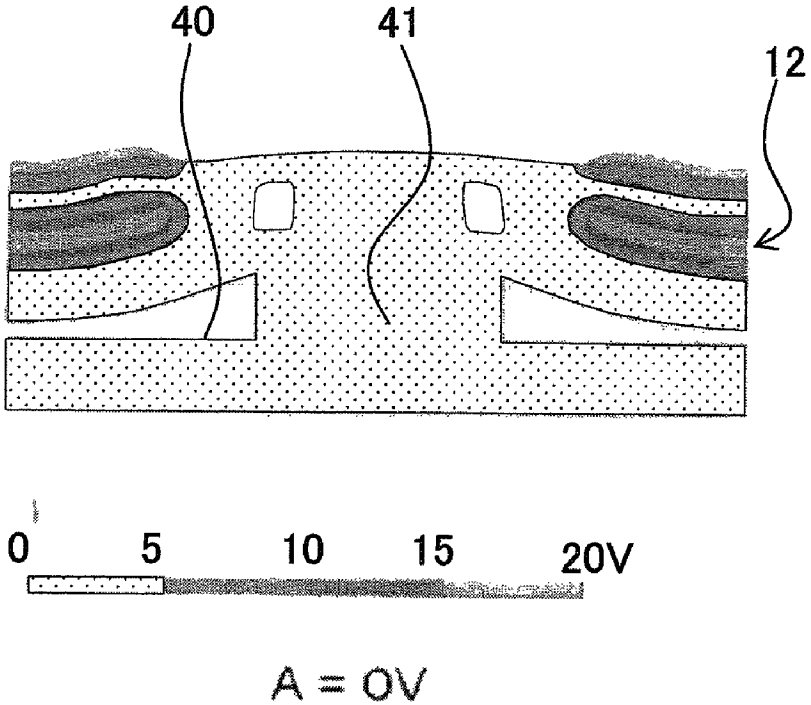

Incidentally, a relationship among the polarization direction, portions (first active portions) which are effective while being turned ON and effective during application of voltage and portions (second active portions) which are effective while being turned OFF and effective during non-application of voltage is shown in FIGS. 25A, 25B. Then it can be seen that the effect of suppressing crosstalk is exhibited by application/non-application of voltage as shown in FIGS. 26A, 26B. In the case of eighth embodiment, as shown in Table 2, the ratio of changes of cross-sectional areas of adjacent pressure chambers is 12%, and it can be seen that, similarly to the case of the first embodiment, the change ratio decreases to almost half as compared to the conventional example, and the effect of suppressing crosstalk is exhibited.

Figure 27A:
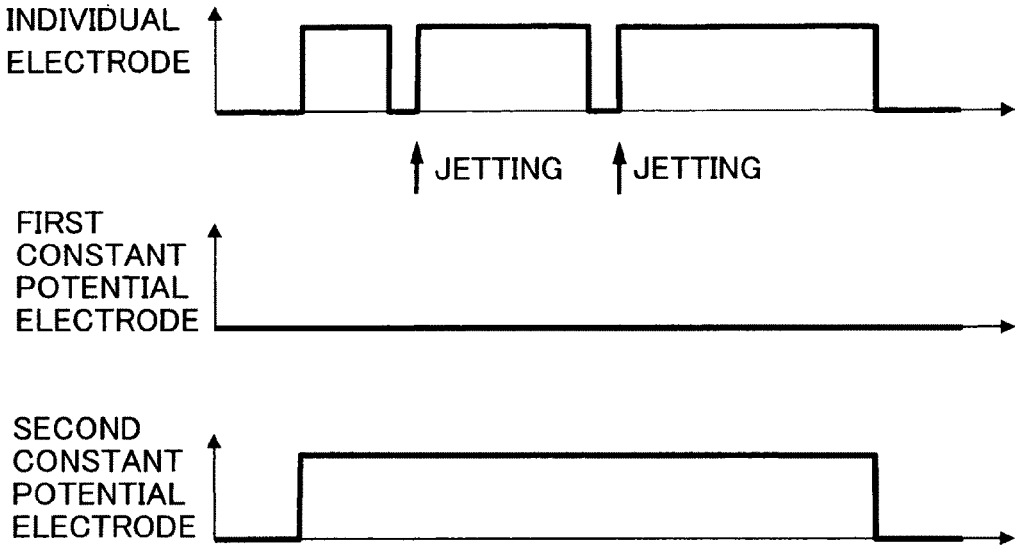
FIGS. 27A, 27B are timing charts.
Figure 27B:
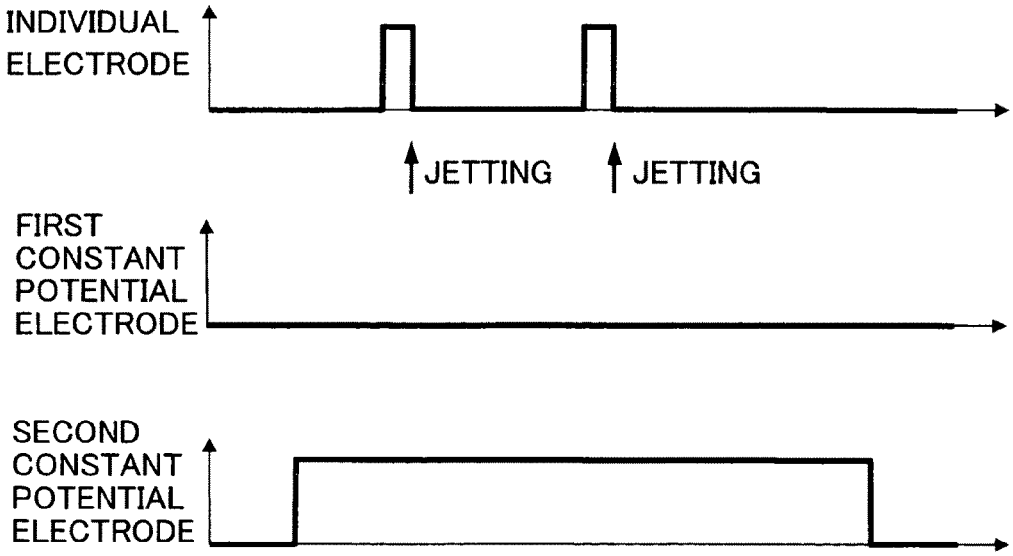

Then, in the above-described first to seventh embodiments, jetting occurs when voltage is applied to the first active portions (that is, when the second potential is applied to the individual electrodes) as shown in FIG. 27A, but in the case of the eighth embodiment and the tenth embodiment which will be explained later, as shown in FIG. 27B, conversely jetting occurs when application of voltage to the first active portions is released (that is, when the first potential is applied to the individual electrodes).

Further, when using the surface individual electrodes similarly to the eighth embodiment, it is also possible to make jetting occur when voltage is applied to the first active portions similarly to the first to seventh embodiments by having a structure in the following ninth embodiment (see FIG. 27A).

Ninth Embodiment

Figure 28:
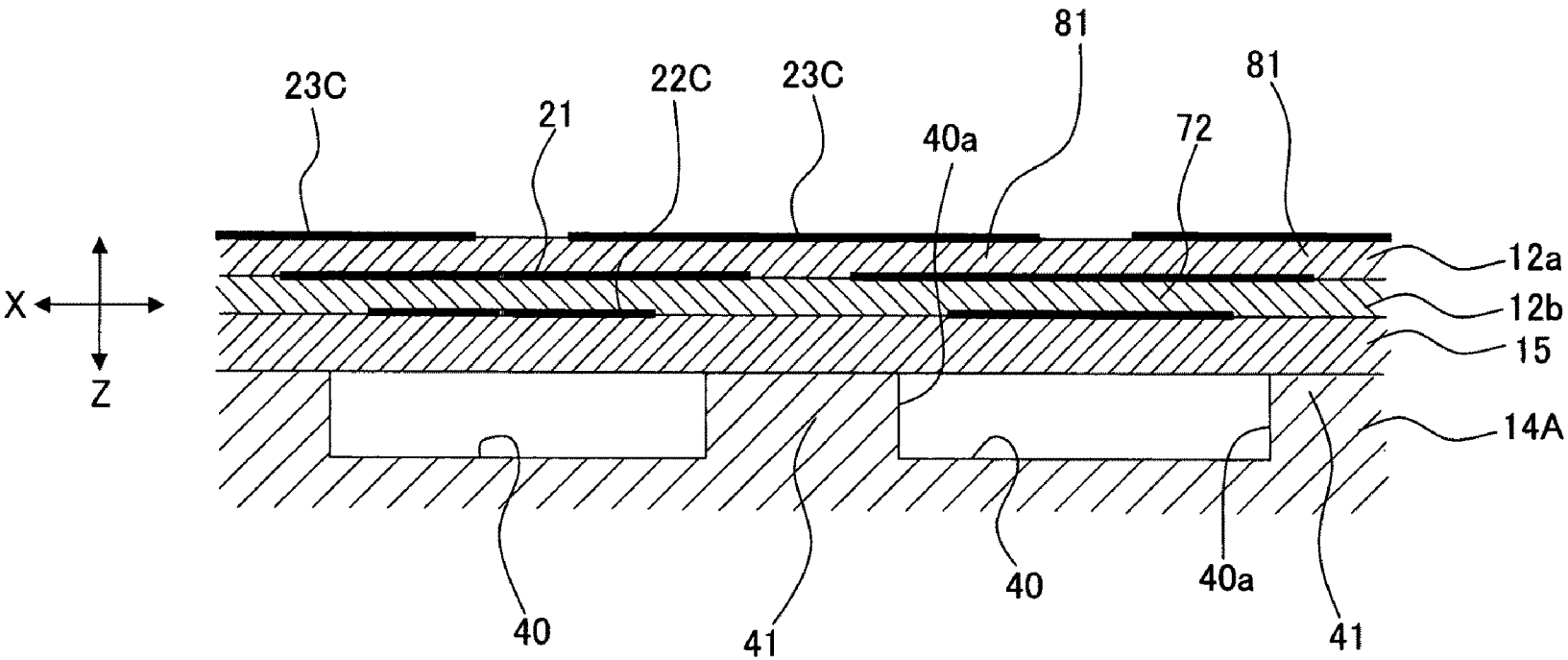
FIG. 28 is a view similar to FIG. 4 regarding the ninth embodiment.

In this embodiment, as shown in FIG. 28, the piezoelectric actuator is made as a two-layer structure, in which second constant potential electrodes 23C are formed on an upper surface side of the piezoelectric material layer 12*a* on an upper side, and individual electrodes 21 are formed on a lower surface side thereof. Then first constant potential electrodes 22C are formed on a lower surface side of the piezoelectric material layer 12*b* on a lower side. Accordingly, there are formed first active portions 72 corresponding respectively to the center portions of the pressure chambers 40, and the second active portions 81 corresponding respectively to portions on outer peripheral sides thereof.

Figure 29:
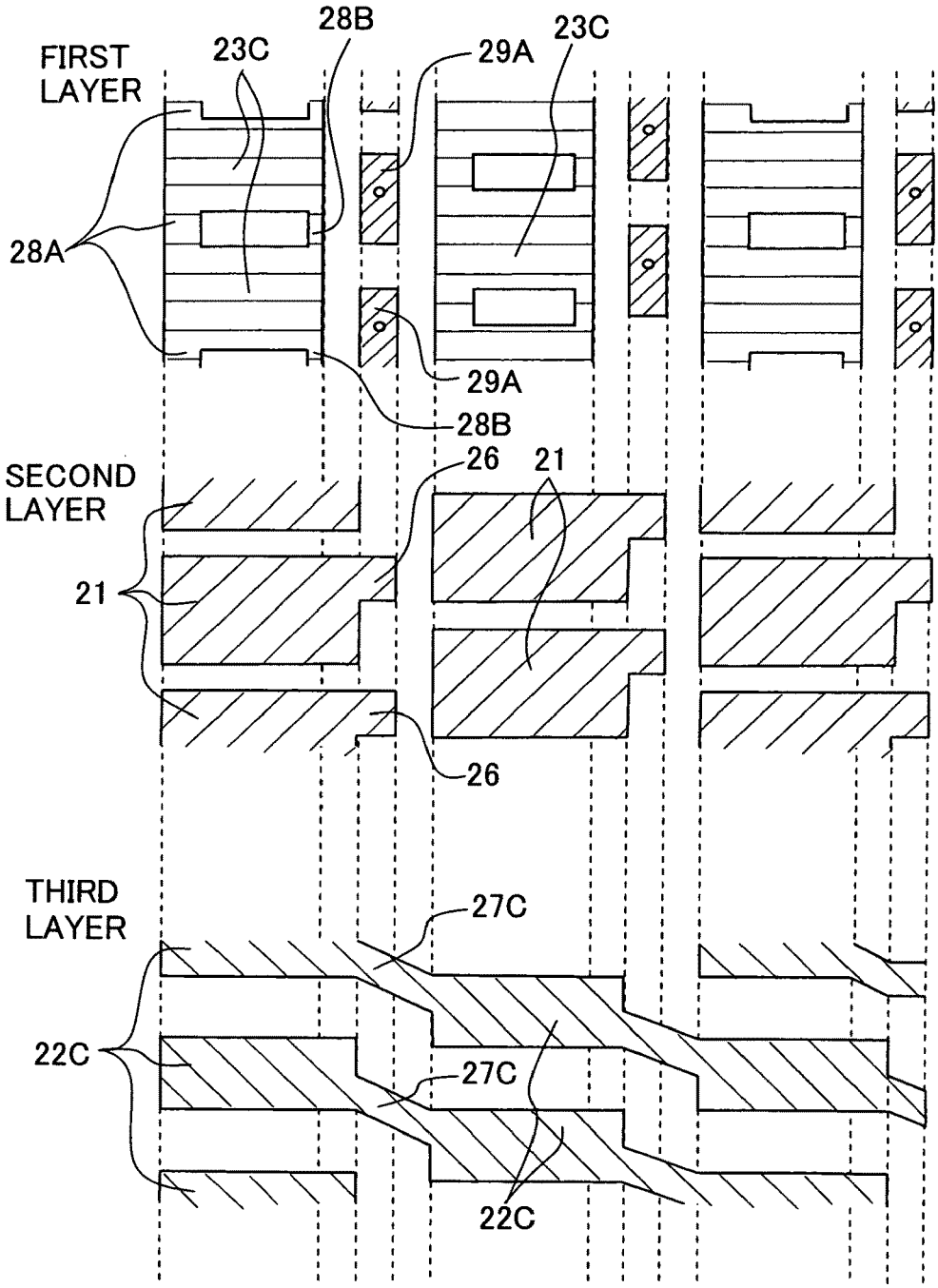
FIG. 29 is a view similar to FIG. 5 regarding the ninth embodiment.

In this manner, individual surface electrodes 21*c* to be connection portions with the flexible wiring board 13 (COP) are formed in regions corresponding to the beam portions 41 between the pressure chambers 40 as shown in FIG. 29. In addition, a time to apply voltage between the second constant potential electrodes 23C and the individual electrodes 21 is short, and hence short-circuit by migration is avoided.

Further, the electrodes on upper and lower surfaces of the piezoelectric material layers 12*a*, 12*b* are arranged as shown in FIG. 29 in a plan view. That is, on the upper surface side of the piezoelectric material layer 12*a*, the second constant potential electrodes 23C are formed corresponding respectively to the pressure chambers 40 at a constant pitch in the nozzle row direction, and both side portions thereof in a direction orthogonal to the nozzle row direction are connected by common electrodes 28A, 28B respectively. Then the adjacent second constant potential electrodes 23C are formed to be shifted by a half pitch in the nozzle row direction, and surface individual electrodes 29A to be connected to the connection terminals of the flexible wiring board 13 are formed between the adjacent common electrodes 28A, 28B on a side opposite to the side on which the second constant potential electrodes 23C are formed.

On a lower surface side of the piezoelectric material layer 12*a*, individual electrodes 21 are formed at a constant pitch in the nozzle row direction corresponding respectively to the pressure chambers 40. Parts of the individual electrodes 21 are formed to project to be connection terminal portions 26, and are connected electrically to the surface individual electrodes 29A on the upper surface of the piezoelectric material layer 12*a* via through holes 24 filled with conductive materials inside.

On a lower surface side of the piezoelectric material layer 12*b*, first constant potential electrodes 22C are formed at a constant pitch in the nozzle row direction corresponding respectively to the pressure chambers 40, and end portions thereof are connected to the adjacent first constant potential electrodes 22C mutually via connection portions 27C.

Figure 30A:
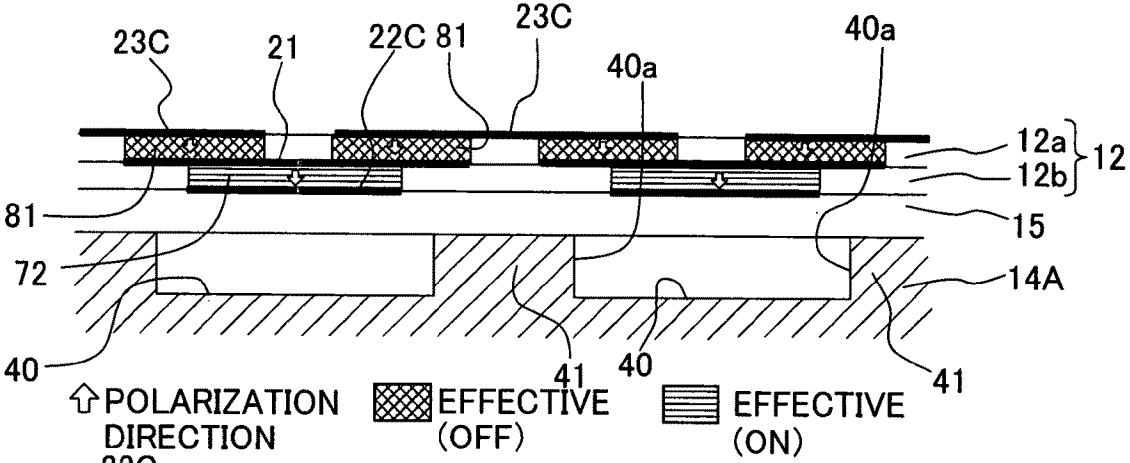
FIGS. 30A, 30B are views similar to FIGS. 6A, 6B respectively regarding the ninth embodiment.
Figure 30B:
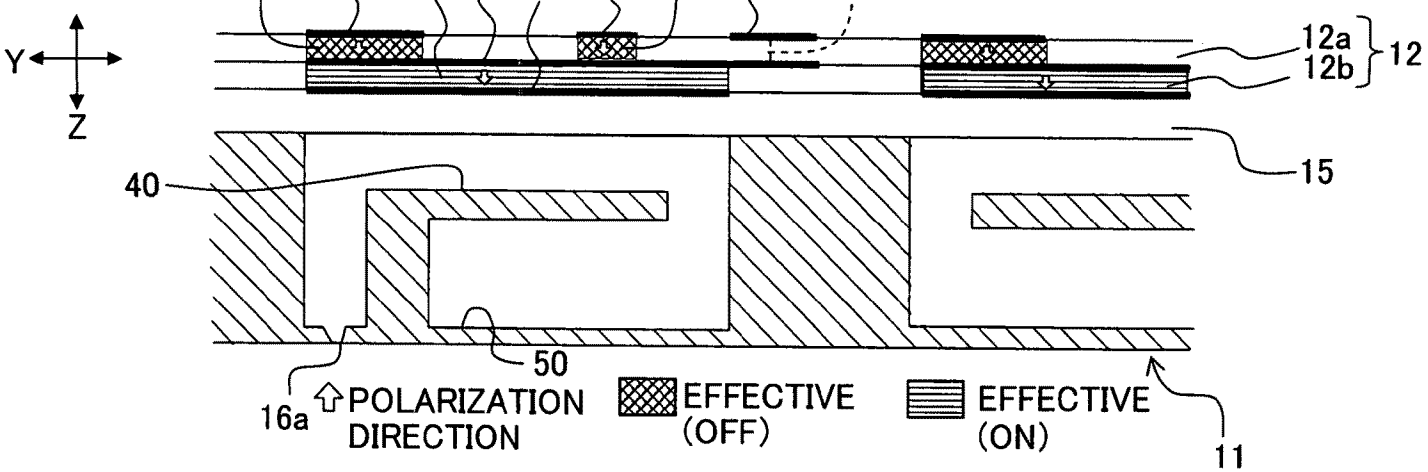
Figure 31B:
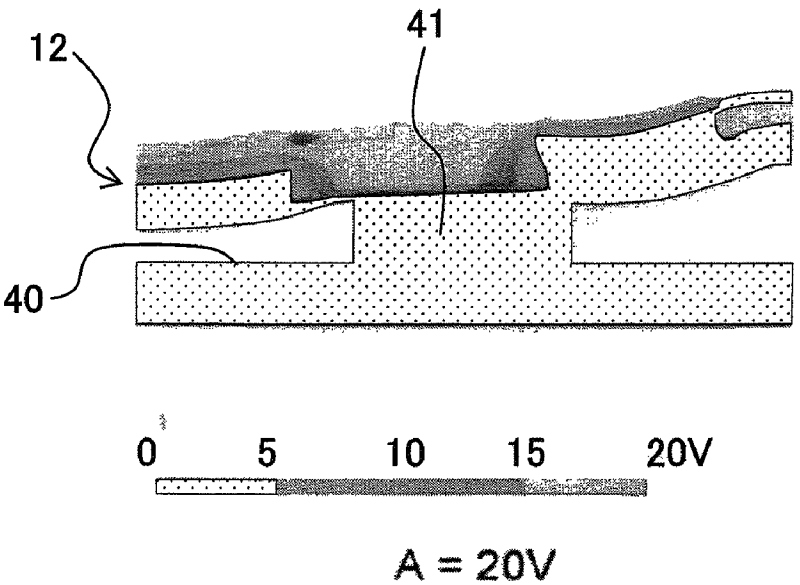
FIGS. 31A, 31B are views similar to FIGS. 7A, 7B respectively regarding the ninth embodiment.
Figure 31A:
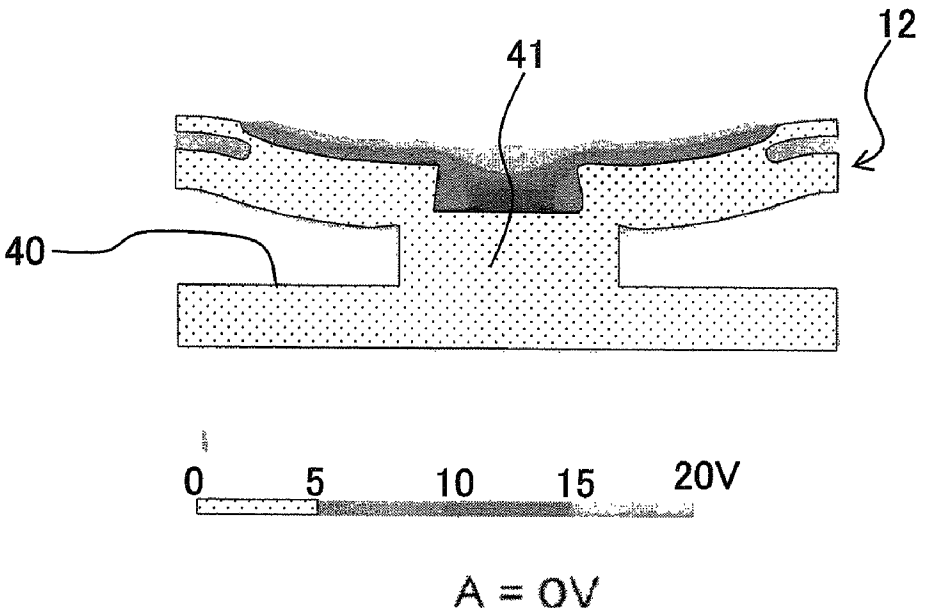

Incidentally, a relationship among the polarization direction, portions (first active portions) which are effective while being turned ON and effective during application of voltage and portions (second active portions) which are effective while being turned OFF and effective during non-application of voltage is shown in FIGS. 30A, 30B. Then it can be seen that the effect of suppressing crosstalk is exhibited by application/non-application of voltage as shown in FIGS. 31A, 31B.

Further, with a structure as in the next tenth embodiment, short-circuit due to migration can be prevented similarly to the ninth embodiment, and the surface individual electrodes can be used to make jetting occur when application of voltage to the first active portions is released, similarly to the eighth embodiment (see FIG. 27B).

Tenth Embodiment

Figure 32:
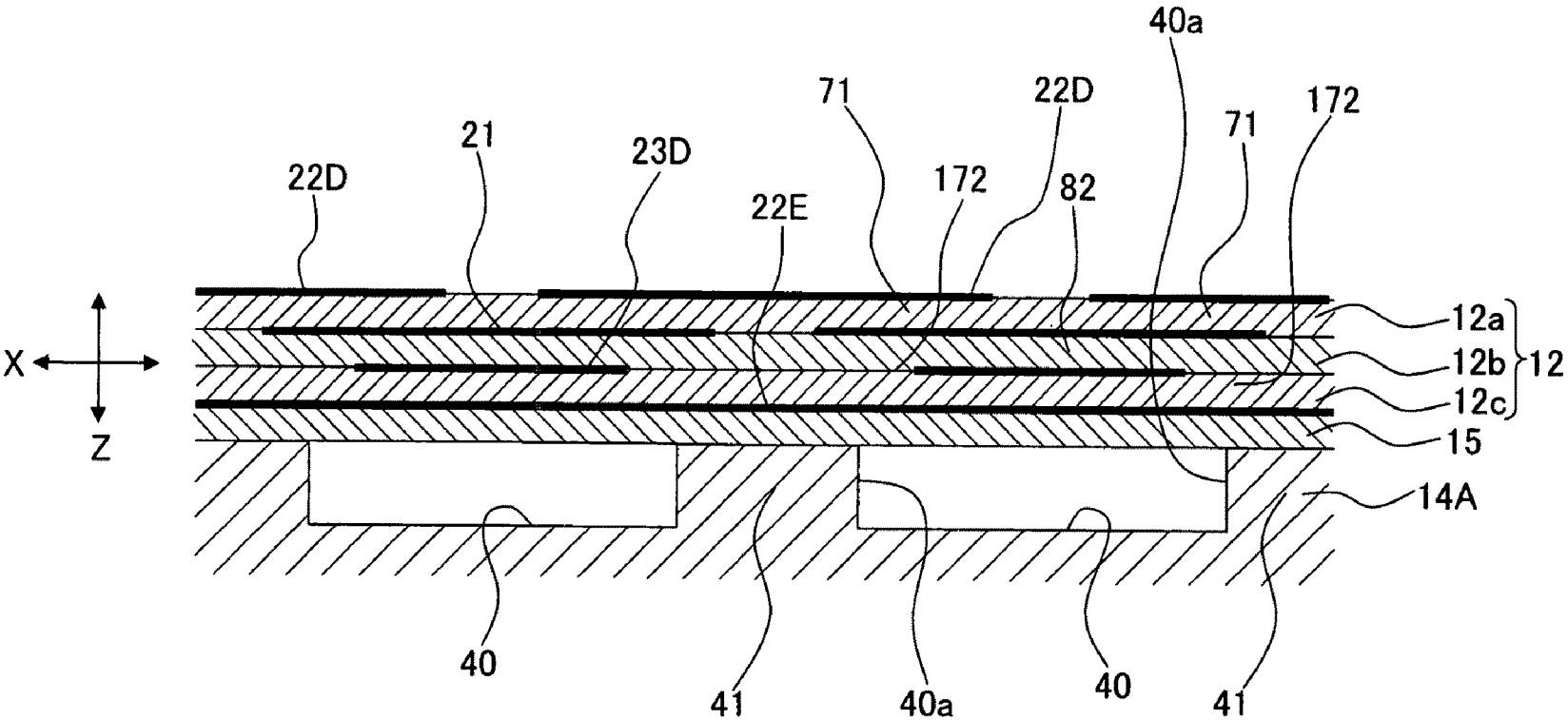
FIG. 32 is a view similar to FIG. 4 regarding the tenth embodiment.

In this example, as shown in FIG. 32, first constant potential electrodes 22D are formed on an upper surface side of the piezoelectric material layer 12*a*, and individual electrodes 21 are formed on a lower surface side thereof. Further, second constant potential electrodes 23D are formed on an upper surface side of the piezoelectric material layer 12*c*, and first constant potential electrodes 22E are formed on a lower surface side thereof. The individual electrodes 21 are connected respectively to the surface individual electrodes 29A using through holes 24 (filled with conductive materials inside) penetrating the piezoelectric material layer 12*a* (see FIG. 33B). Accordingly, there are formed second active portions 82 corresponding respectively to the center portions of the pressure chambers 40, and first active portions 71, 172 on portions on outer peripheral sides thereof respectively.

Figure 34B:
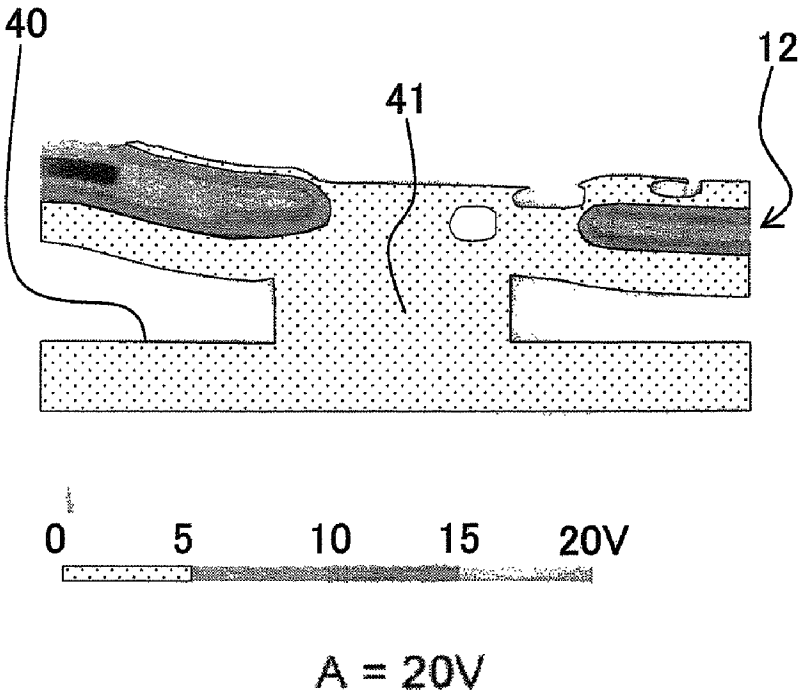
FIGS. 34A, 34B are views similar to FIGS. 7A, 7B respectively regarding the tenth embodiment.
Figure 34A:
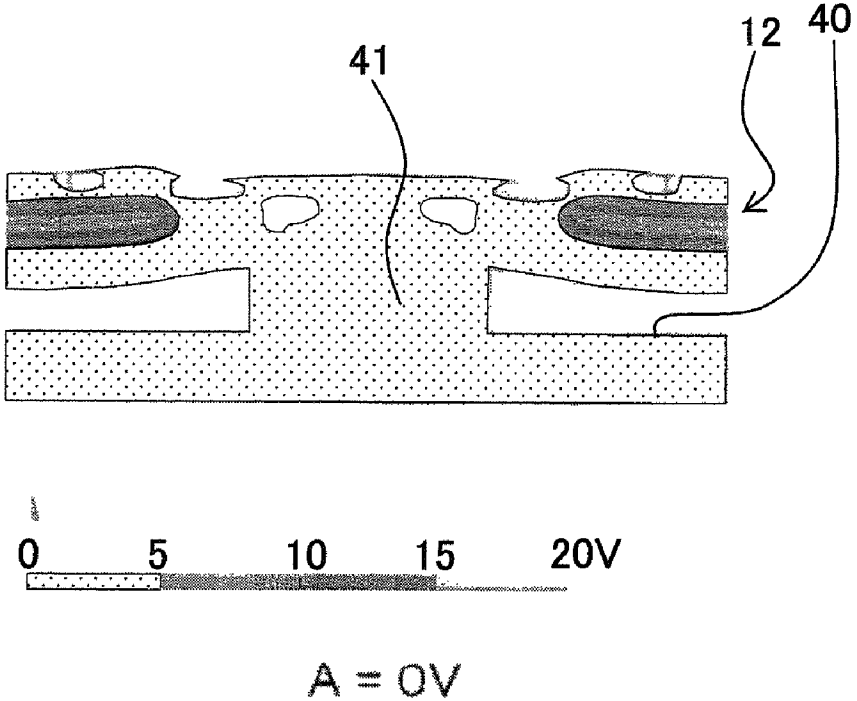

In this case, a relationship among the polarization direction, portions (first active portions) which are effective while being turned ON and effective during application of voltage and portions (second active portions) which are effective while being turned OFF and effective during non-application of voltage is as shown in FIGS. 33A, 33B. Then it can be seen that the effect of suppressing crosstalk is exhibited by application/non-application of voltage as shown in FIGS. 34A, 34B.

In this case also, similarly to the ninth embodiment, dispersion of deformation characteristics during the connection due to flowing in of solder can be avoided. Further, a time in which a potential difference is generated between the first constant potential electrodes 22D, 22E and the individual electrodes 21 is short, and hence short-circuit by migration is avoided.

Furthermore, with a structure as in the next example 11, it is possible to have a less number of stacks without using surface individual electrodes or through holes, and to make jetting occur when application of voltage to the first active portions is released, similarly to the eighth and tenth embodiments (see FIG. 27B).

Eleventh Embodiment

Figure 35:
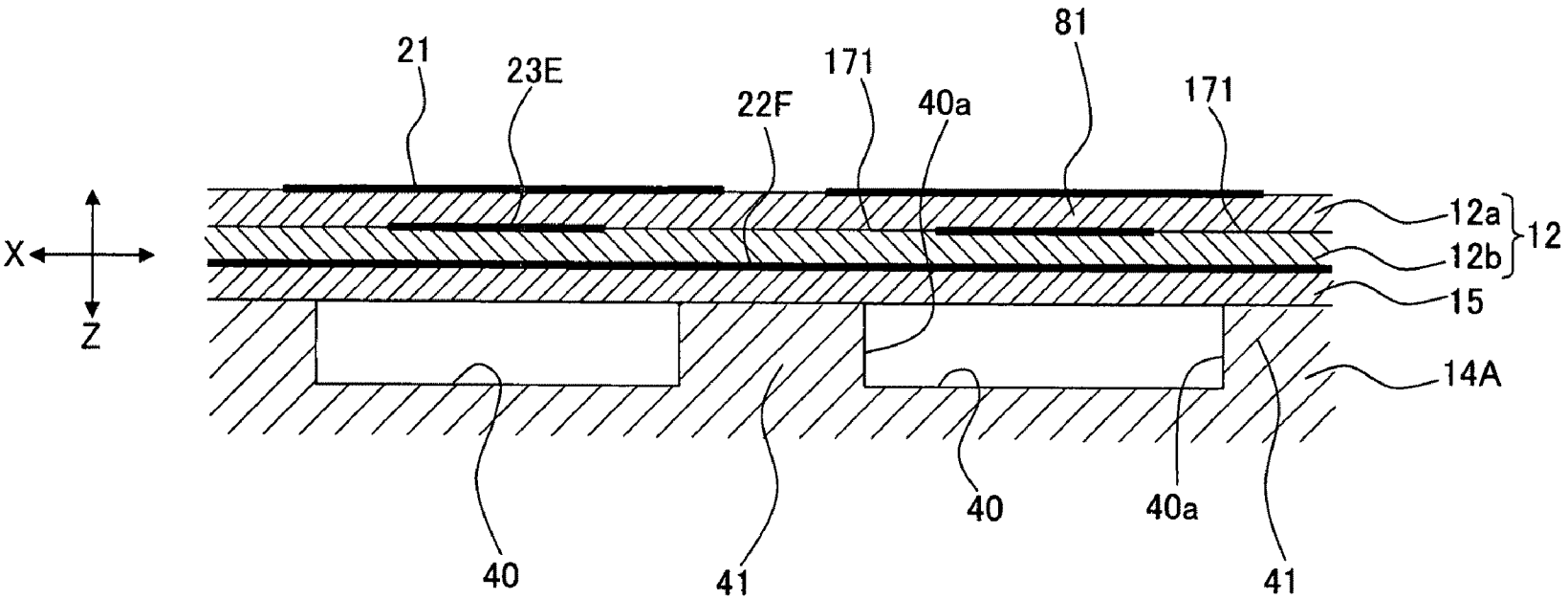
FIG. 35 is a view similar to FIG. 4 regarding the eleventh embodiment.

In this embodiment, as shown in FIG. 35, individual electrodes 21 are formed on an upper surface side of the piezoelectric material layer 12*a*, and second constant potential electrodes 23E are formed on a lower surface side thereof. First constant potential electrodes 22F are formed on a lower surface side of the piezoelectric material layer 12*b*. Accordingly, there are formed first active portions 81 corresponding respectively to the center portions of the pressure chambers 40, and second active portions 171 on portions on outer peripheral sides thereof. Note that it is the same as the eighth and tenth embodiments in that the ground potential is applied to the individual electrodes 21 during standby.

Figure 36:
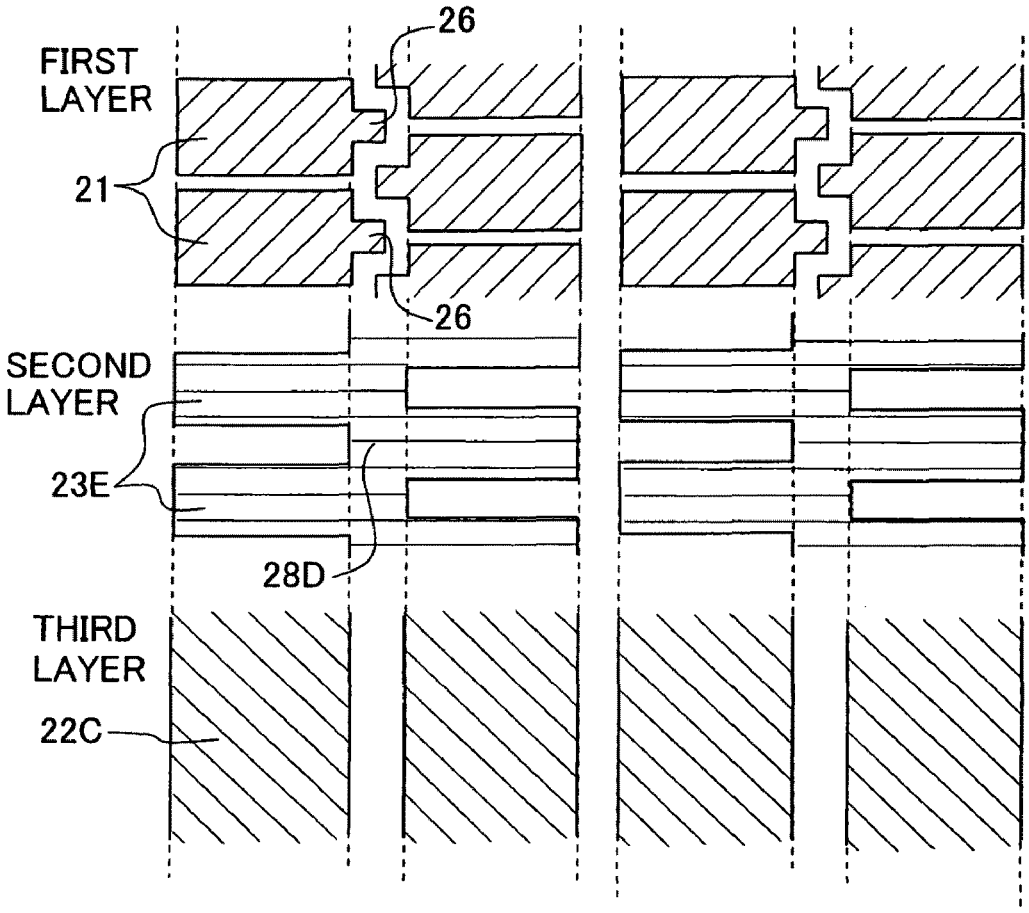
FIG. 36 is a view similar to FIG. 5 regarding the eleventh embodiment.

Further, the electrodes on the upper and lower surfaces of the piezoelectric material layers 12*a*, 12*b* are arranged as shown in FIG. 36 in a plan view. That is, on the upper surface side of the piezoelectric material layer 12*a*, the individual electrodes 21 are formed corresponding respectively to the pressure chambers 40 at a constant pitch in the nozzle row direction, and parts of the individual electrodes project between the arrays of the individual electrodes 21. These projecting portions are formed in a zigzag pattern to be connection terminal portions 26 connected to the connection terminals of the flexible wiring board 13.

On the lower surface side of the piezoelectric material layer 12*a*, the second constant potential electrodes 23E are formed at a constant pitch in the nozzle row direction corresponding respectively to the pressure chambers 40, and one ends thereof are connected electrically to one of common electrodes 23Ea located therebetween. Further, on the lower surface side of the piezoelectric material layer 12*b*, there are formed first constant potential electrodes 22E extending in the nozzle row direction to be electrodes common to the pressure chambers 40 in the nozzle row direction.

Figure 37A:
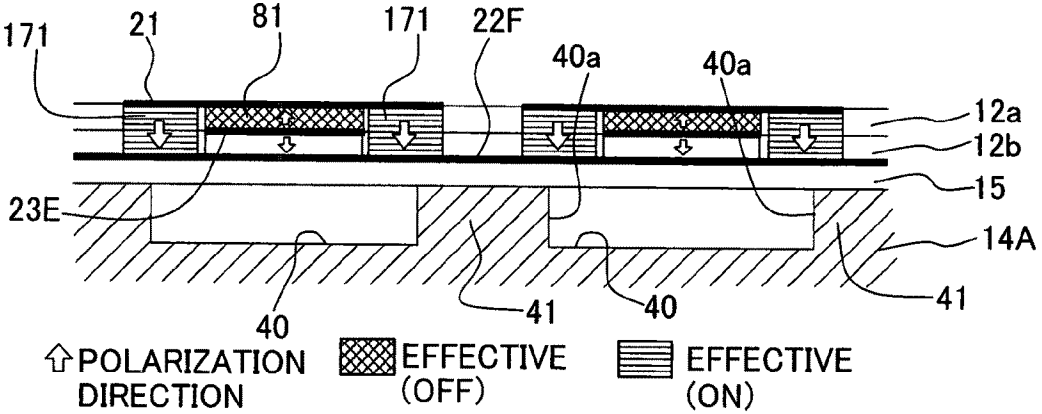
FIGS. 37A, 37B are views similar to FIGS. 6A, 6B respectively regarding the eleventh embodiment.
Figure 37B:
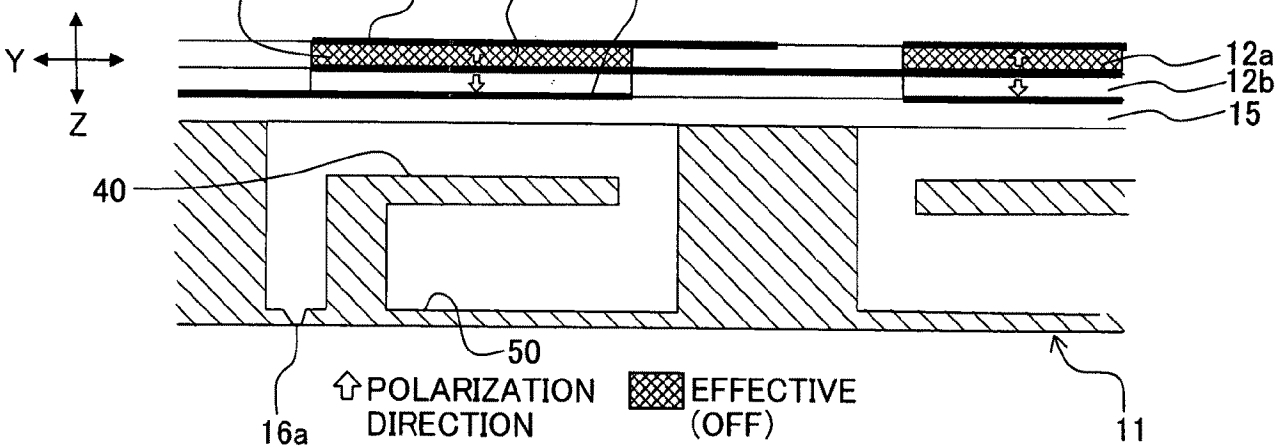
Figure 38B:
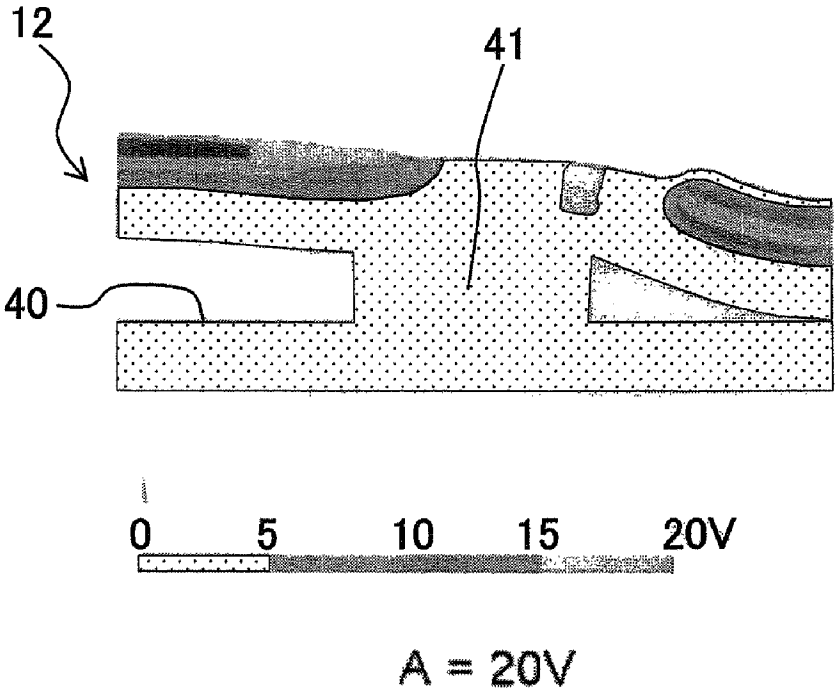
FIGS. 38A, 38B are views similar to FIGS. 7A, 7B respectively regarding the eleventh embodiment.
Figure 38A:
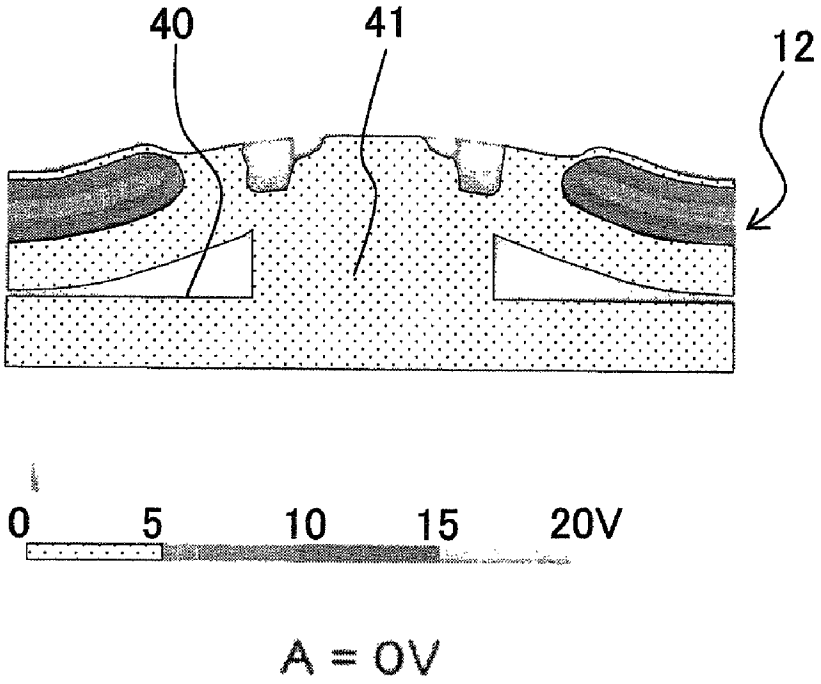

Incidentally, a relationship among the polarization direction, portions (first active portions) which are effective while being turned ON and effective during application of voltage and portions (second active portions) which are effective while being turned OFF and effective during non-application of voltage is as shown in FIGS. 37A, 37B. Then it can be seen that the effect of suppressing crosstalk is exhibited by application/non-application of voltage as shown in FIGS. 38A, 38B. In the case of the eleventh embodiment, as shown in Table 2, the ratio of changes of cross-sectional areas of adjacent pressure chambers is 3%, and the change ratio decreases significantly as compared to the conventional example. It can be seen that it has excellent effect of suppressing crosstalk.

In such a structure, since there is no junctions via through holes and the number of stacks is small, production at low cost is possible. Also, changes of cross-sectional areas become large, but there is excellent effect of suppressing crosstalk.

Further, with structures as in the next twelfth and thirteenth embodiments, not only intra-row crosstalk between pressure chambers adjacent in a pressure chamber row direction can be prevented, but also inter-row crosstalk between pressure chambers which belong to an adjacent pressure chamber row and adjacent in a direction orthogonal to the pressure chamber row direction can be suppressed.

Twelfth Embodiment

Figure 39:
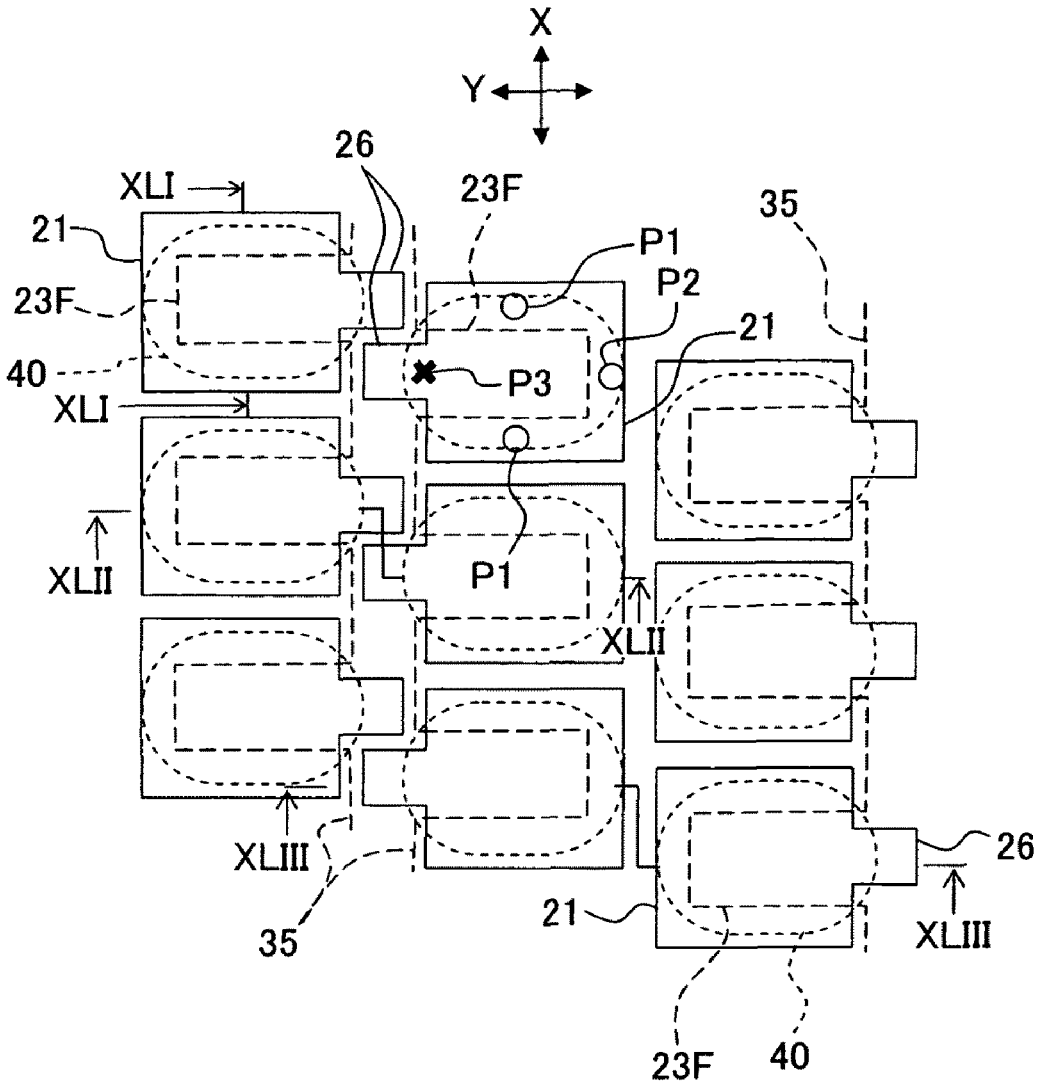
FIG. 39 is an explanatory view of an arrangement of electrodes on piezoelectric material layers of a piezoelectric actuator in the twelfth embodiment.

In this example, as shown in FIG. 39, the piezoelectric actuator 12 includes, in a plan view (that is, when seen in a stacking direction of the cavity unit 11 and the piezoelectric actuator 12), first active portions 91 (first portions) corresponding to the center portions of the pressure chambers 40, second active portions 92 (second portions) provided corresponding to both side portions with respect to the center portions of the pressure chambers 40 in the aforementioned predetermined direction, namely the pressure chamber row direction X, and third active portions 93 (third portions) provided corresponding to one side portions in a direction Y (crossing direction) orthogonal to (crossing) the pressure chamber row direction X with respect to the center portions of the pressure chambers 40. Here, the center portions of the pressure chambers 40 are center portions in the pressure chamber row direction X (also is a nozzle row direction in which the nozzle holes 16*a* are arranged) in which the pressure chambers 40 are arranged.

The second active portions 92 include not only regions corresponding to beam portions 41 which are walls partitioning adjacent pressure chambers 40 but also regions corresponding to portions more inside (center portion side) than outer peripheral edges 40*a* of the pressure chambers 40. Further, the third active portions 93 include regions more outside than the outer peripheral edges of the pressure chambers 40, that is, regions corresponding to beam portions 41A which are walls belonging to an adjacent pressure chamber row and partitioning adjacent pressure chambers 40.

The first active portions 91 are structured including a piezoelectric material (piezoelectric material layer 12*a*) sandwiched between individual electrodes 21 provided respectively for the pressure chambers 40 and second constant potential electrodes 23F. The second active portions 92 and the third active portions 93 are structured including piezoelectric materials (piezoelectric material layers 12*a*, 12*b*) sandwiched between the individual electrodes 21 and first constant potential electrodes 23G.

Then in the piezoelectric actuator 12, a positive potential (first potential) and the ground potential (second potential) are applied selectively as drive signals to the individual electrodes 21 to change volumes of the pressure chambers 40, so as to jet ink from the nozzle holes 16*a*.

To describe in more detail, the individual electrodes 21 are formed, as shown in FIGS. 39 and 40, longer than the pressure chambers 40 in the pressure chamber row direction X, shorter than the pressure chambers 40 in the direction Y orthogonal to the pressure chamber row direction X, and across first regions corresponding to the first active portions 91, second regions corresponding to the second active portions 92 and third regions corresponding to the third active portions 93 so as to cover the first to third regions together. The second constant potential electrodes 23F are formed shorter than the pressure chambers 40 in the pressure chamber row direction X so as to cover the regions corresponding to the first active portions 91. First constant potential electrodes 22G located on the side of the pressure chambers 40 are formed longer in the pressure chamber row direction X than the second constant potential electrodes 23F located away from the pressure chambers 40. That is, the individual electrodes 21 are shared (are used commonly) for the first and second constant potential electrodes 22G, 23F.

The individual electrodes 21 have, on one side in the orthogonal direction Y, portions formed longer than the second constant potential electrodes 23F, and the first constant potential electrodes 22G have portions formed with lengths equal to or longer than the individual electrodes 21 in the orthogonal direction Y in portions where the individual electrodes 21 are formed longer than the second constant potential electrodes 23F.

The first constant potential electrodes 22G are formed to extend to the regions corresponding to the second active portions 92 and cover regions corresponding to the beam portions 41 between the pressure chambers 40 adjacent in the pressure chamber row direction X. That is, the first constant potential electrodes 22G extend to regions corresponding to side portions in the pressure chamber row direction X including the regions corresponding to the beam portions 41, and are shared for two pressure chambers 40 adjacent to each other in the pressure chamber row direction X. Further, the first constant potential electrodes 22G are formed to extend to the regions corresponding to the third active portions 93 and to cover regions corresponding to the beam portions 41A between the pressure chambers 40 adjacent to each other in the direction Y orthogonal to the pressure chamber row direction X. That is, the first constant potential electrodes 22G extend to regions corresponding to side portions in the orthogonal direction Y including the regions corresponding to the beam portions 41A, and are common in two pressure chambers 40 adjacent to each other in the orthogonal direction Y.

Specifically, the first active portions 91 are formed by forming the individual electrodes 21 on an upper surface side of the piezoelectric material layer 12*a* on an upper side located away from the pressure chambers 40, and forming the second constant potential electrodes 23F on a lower surface side thereof. Further, the second and third active portions 92, 93 are formed by forming the first constant potential electrodes 22G on a lower surface side of the piezoelectric material layer 12*b* on the side of the pressure chambers 40.

Further, in a plan view, the electrodes 21, 23F, 22G of the piezoelectric material layers 12*a*, 12*b* are arranged as shown in FIG. 40 in the respective layers. That is, on the upper surface side (first layer) of the piezoelectric material layer 12*a*, the individual electrodes 21 are formed at a constant pitch in the pressure chamber row direction X corresponding respectively to the pressure chambers 40. Then the individual electrodes 21 adjacent to each other in the direction Y orthogonal to the pressure chamber row direction X are formed to be shifted by a half pitch in the pressure chamber row direction X, and between these rows, connection terminal portions 26 of the individual electrodes 21 to be connected to the connection terminals (not shown) of the flexible wiring board 13 are formed in a zigzag pattern.

On the lower surface side (second layer) of the piezoelectric material layer 12*a*, the second constant potential electrodes 23F are formed at a constant pitch in the pressure chamber row direction X corresponding respectively to the pressure chambers 40, the adjacent second constant potential electrodes 23F are formed to be shifted by a half pitch in the pressure chamber row direction X, and one ends thereof are connected to one of connection electrodes 35 extending in the pressure chamber row direction X. Further, the first constant potential electrodes 22G are formed to be shared by the connection terminal portions 26 for two rows of individual electrodes 21 located opposing each other.

Figure 41:
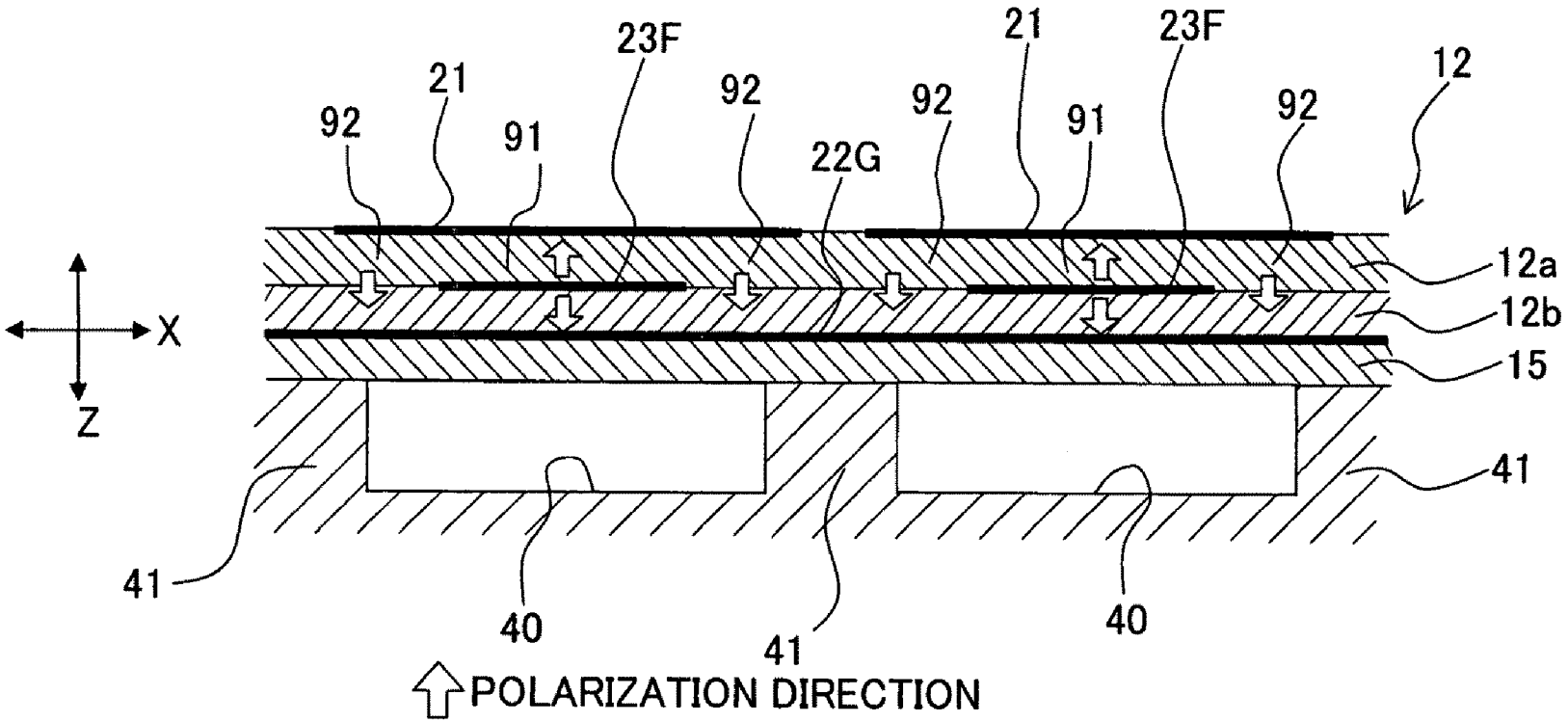
FIG. 41 is a cross-sectional view taken along a line XLI-XLI in FIG. 39.
Figure 42:
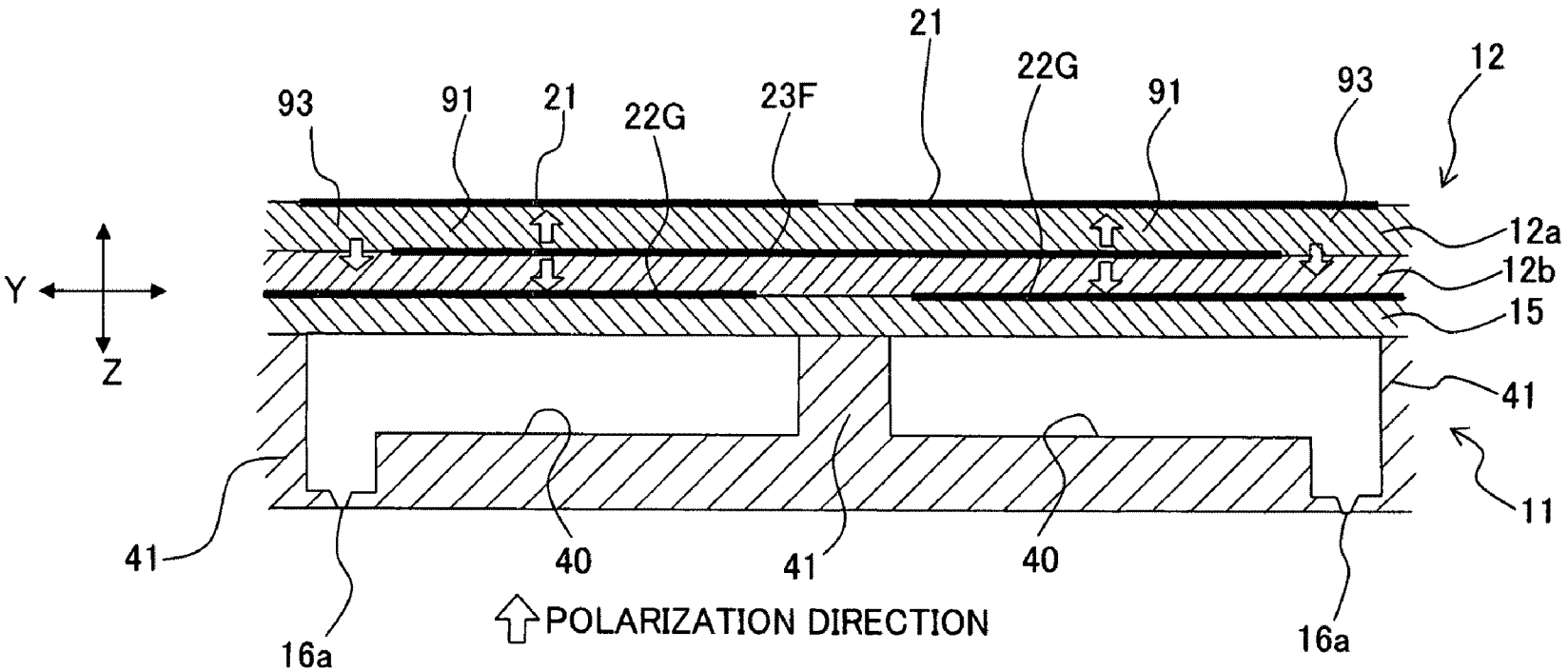
FIG. 42 is a cross-sectional view taken along a line XLII-XLII in FIG. 39.
Figure 43:
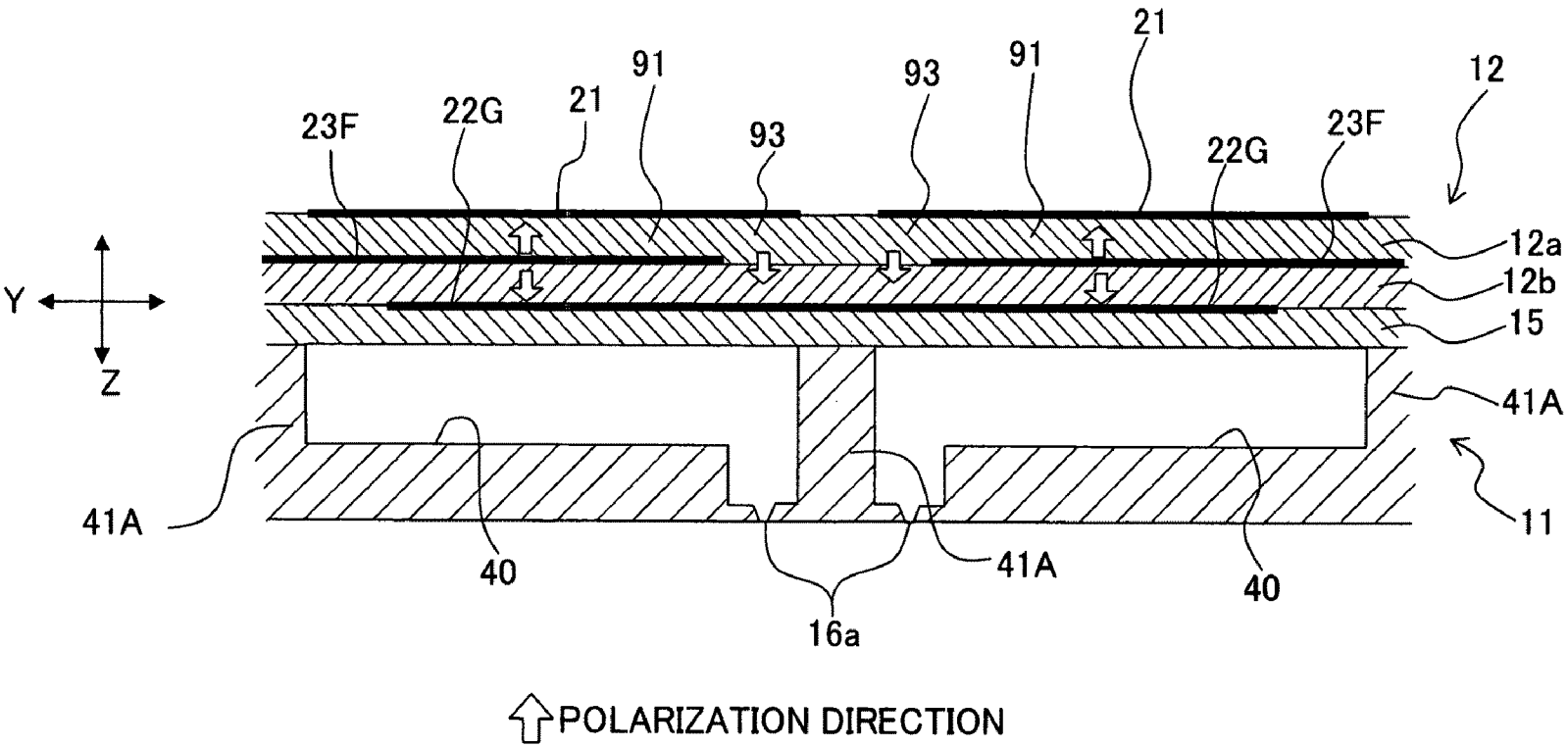
FIG. 43 is a cross-sectional view taken along a line XLIII-XLIII in FIG. 39.
Figure 44:
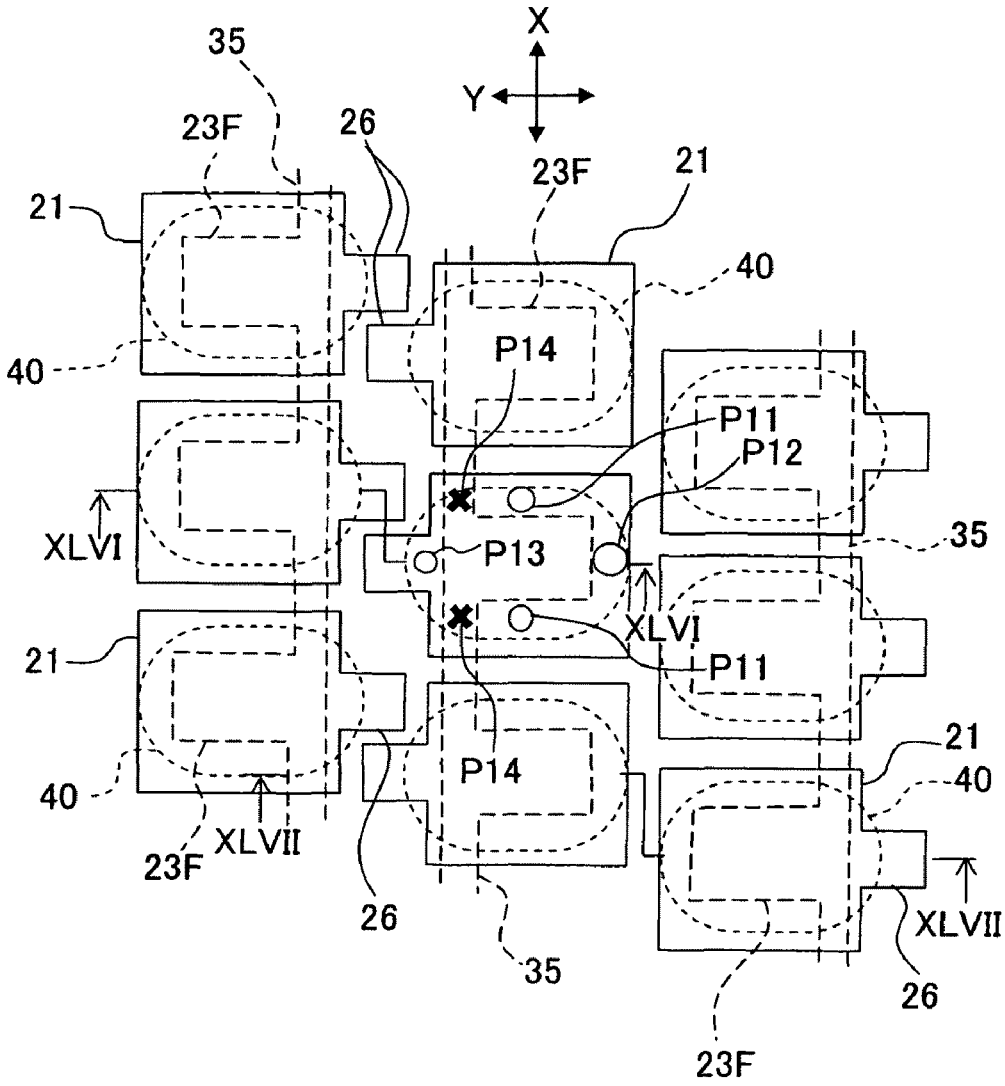
FIG. 44 is a view similar to FIG. 39 regarding a modification example.
Figure 45:
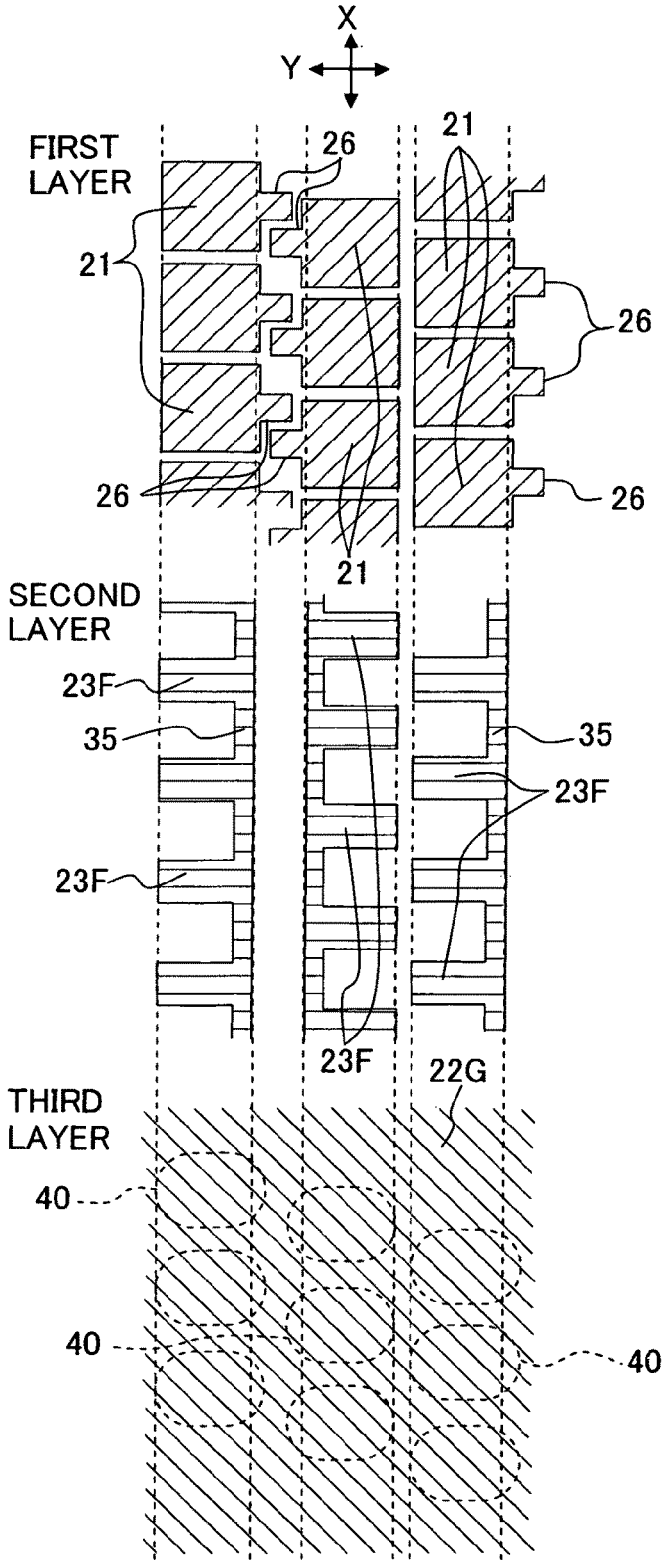
FIG. 45 is a view showing arrangements of electrodes on piezoelectric material layers respectively.
Figure 46:
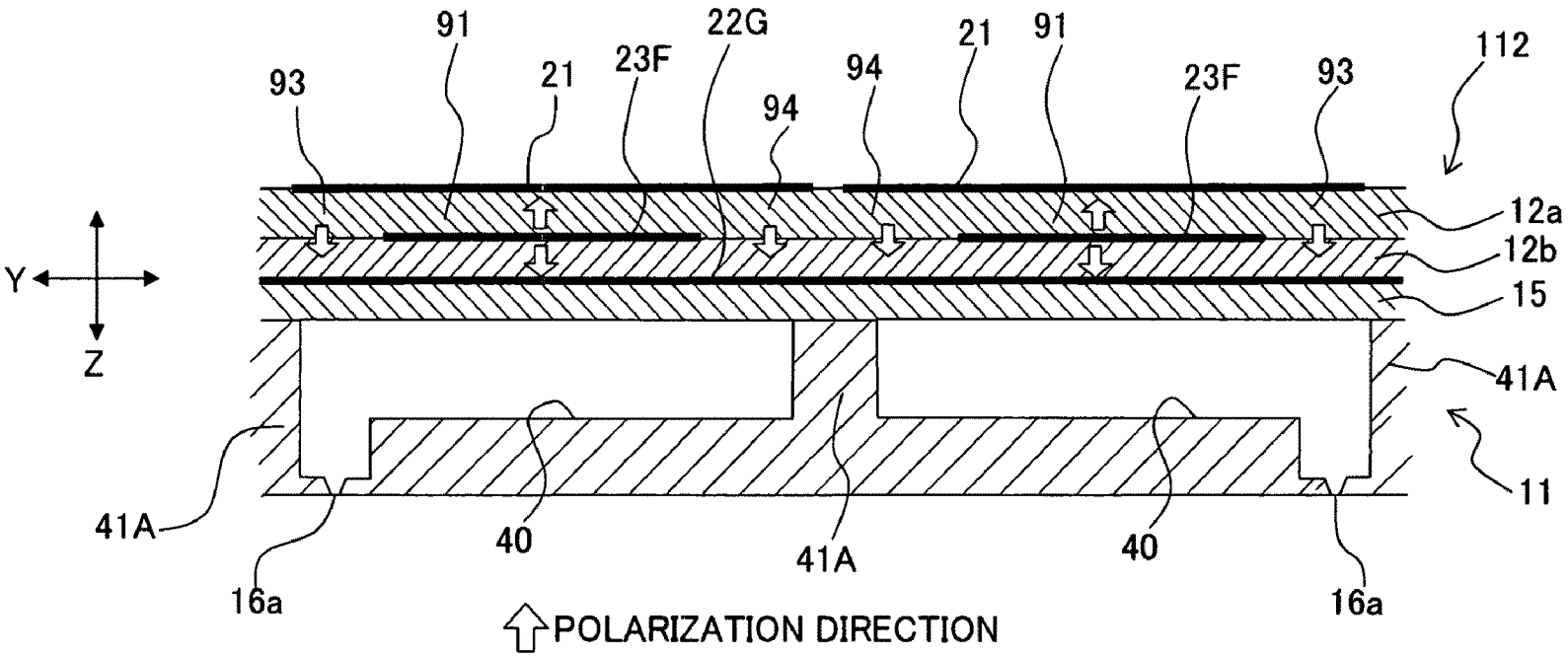
FIG. 46 is a cross-sectional view taken along a line XLVI-XLVI in FIG. 44.
Figure 47:
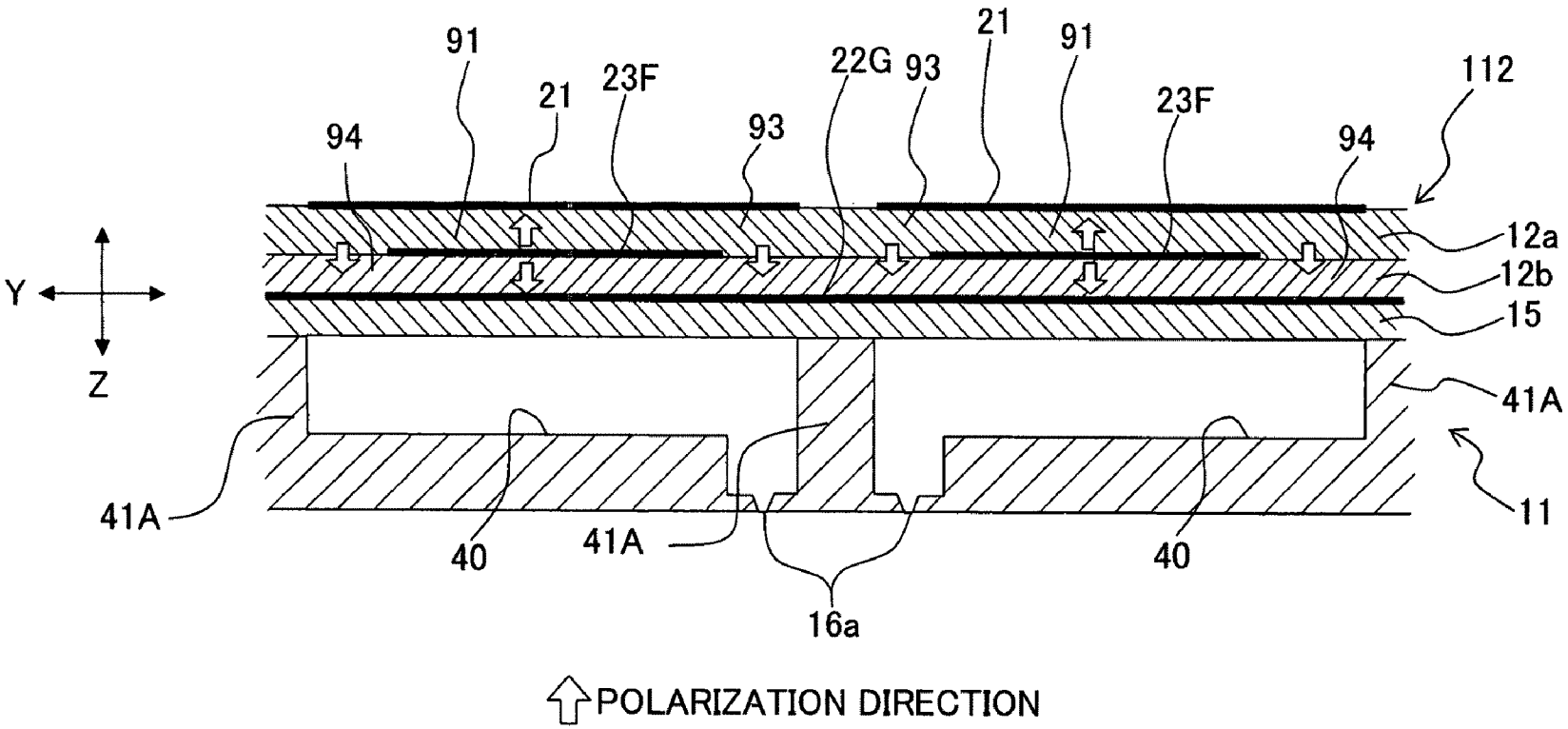
FIG. 47 is a cross-sectional view taken along a line XLVII-XLVII in FIG. 44.
Figure 48:
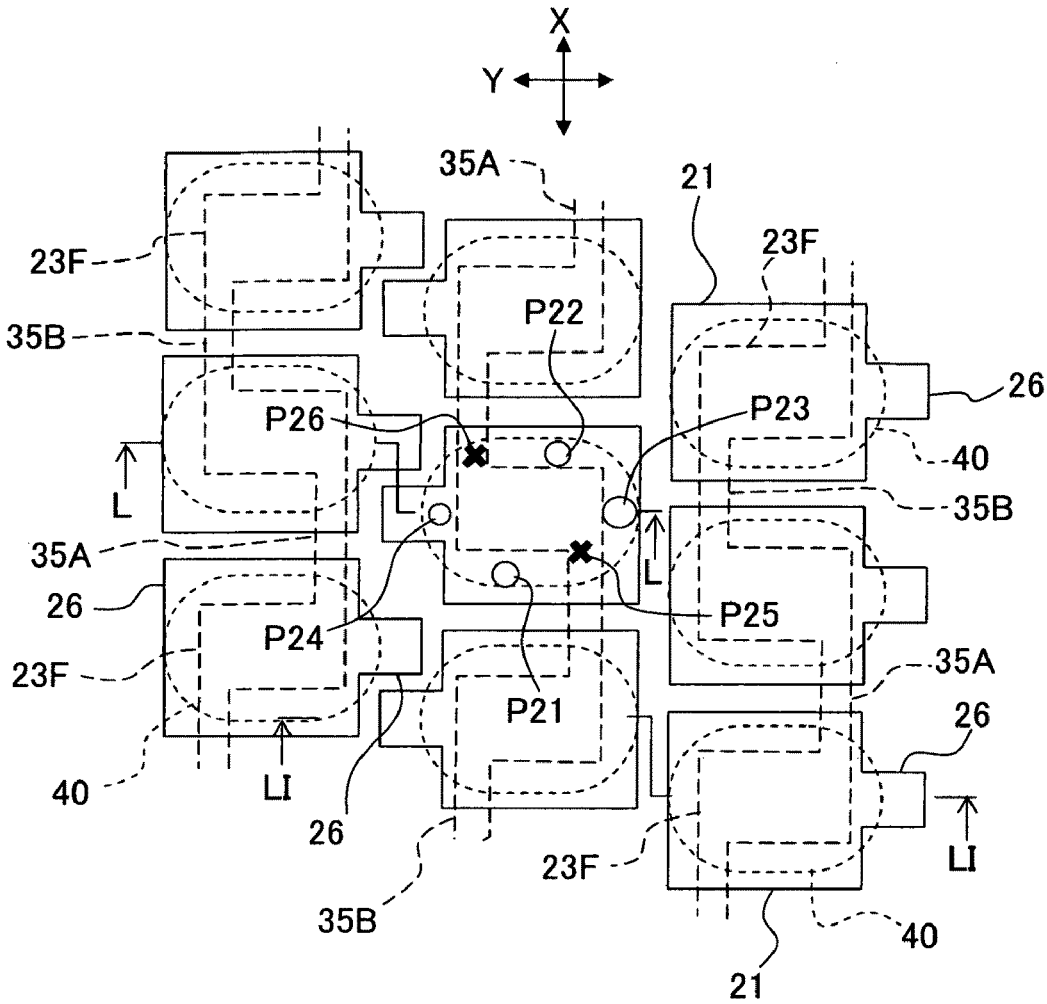
FIG. 48 is a view similar to FIG. 39 regarding another modification example.
Figure 49:
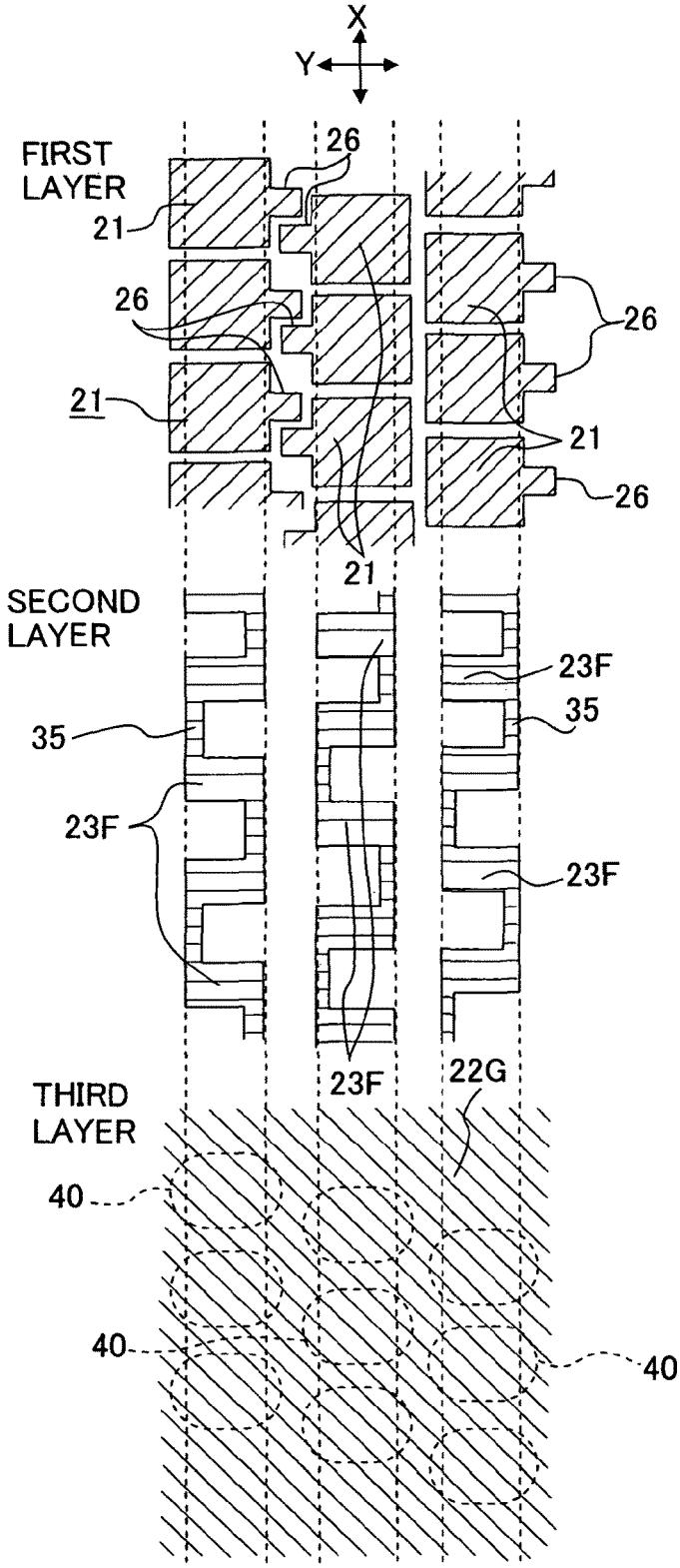
FIG. 49 is a view showing arrangements of electrodes on piezoelectric material layers respectively.
Figure 50:
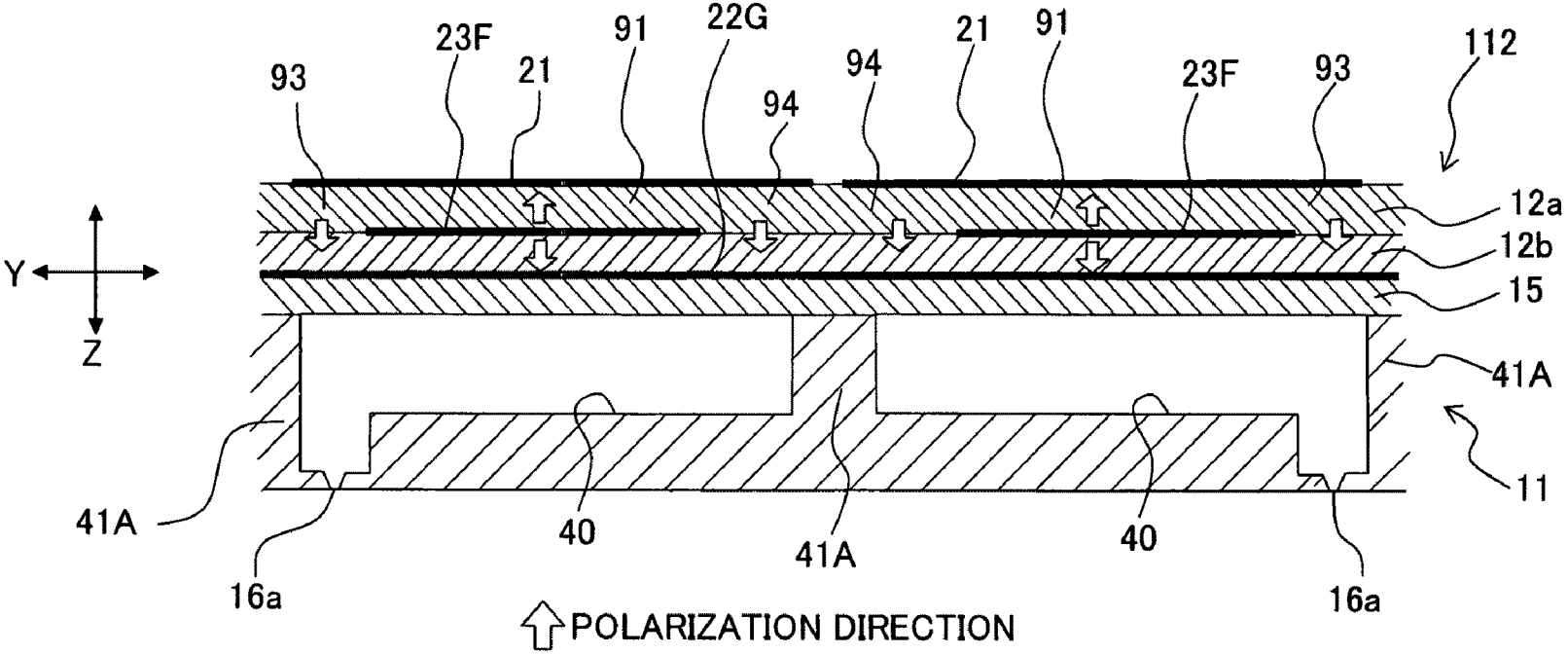
FIG. 50 is a cross-sectional view taken along a line L-L in FIG. 48.
Figure 51:
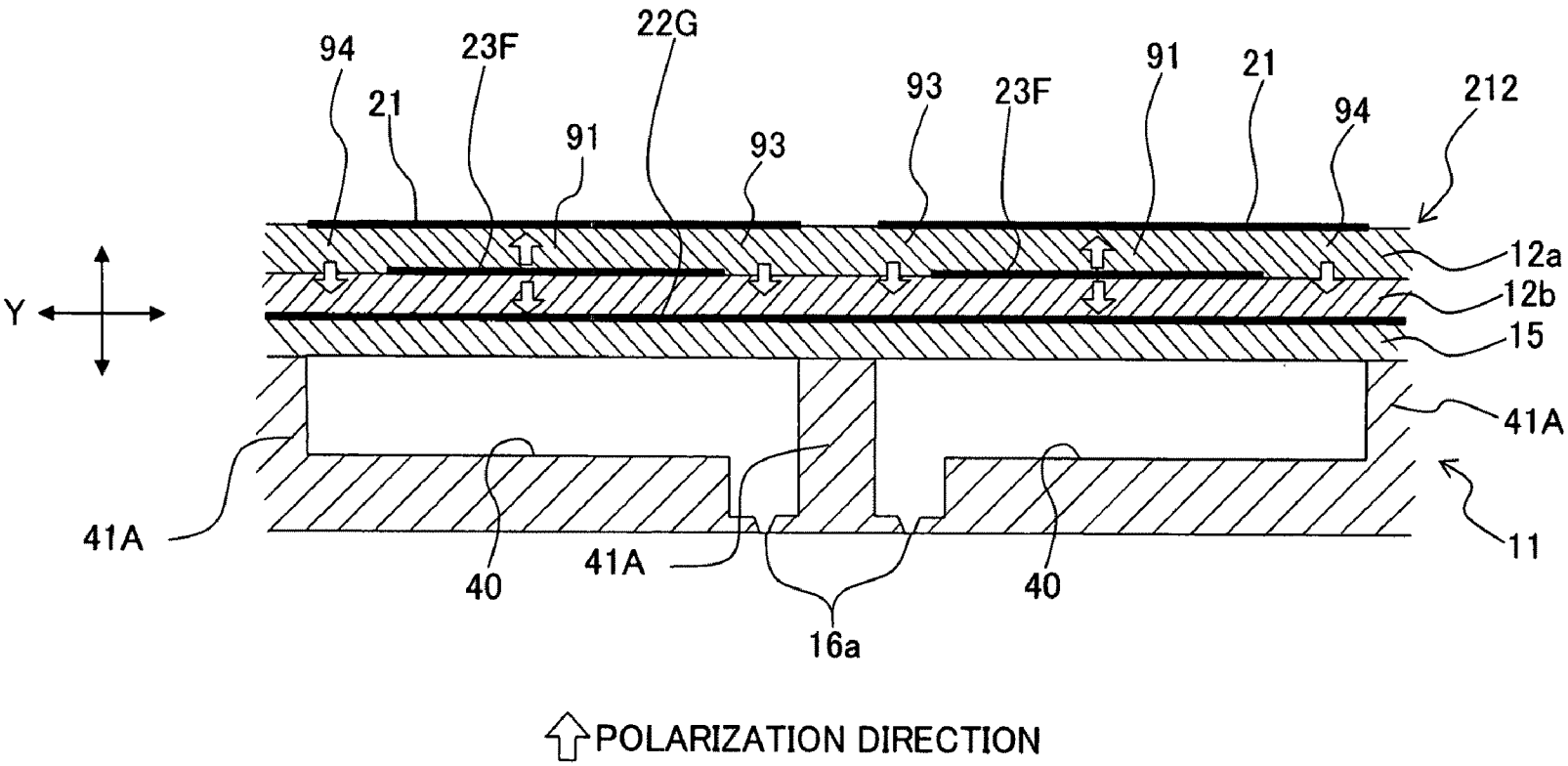
FIG. 51 is a cross-sectional view taken along a line LI-LI in FIG. 48.

Note that as shown in FIGS. 41 to 43, the first active portions 91 are polarized in the same direction (polarization direction) as the direction of the electric field generated by the applied voltage when the ground potential is applied to the individual electrodes 21 and positive potential is applied to the second constant potential electrodes 23F for deformation. On the other hand, the second and third active portions 92, 93 are polarized in the same direction as the direction of the electric field generated by the applied voltage when positive potential is applied to the individual electrodes 21 and the ground potential is applied to the first constant potential electrodes 22G for deformation. That is, during an ink jetting operation, the direction of the electric field caused by the applied voltage and the polarization direction are the same.

The second constant potential electrodes 23F are always at positive potential, and the first constant potential electrodes 22G are always at the ground potential. Then the individual electrodes 21 are applied selectively with the positive potential and the ground potential for changing the volumes of the pressure chambers 40. That is, although the direction of the electric field generated by the applied voltage is the same during polarization and during driving, the second constant potential electrodes 23F are always at the constant positive potential, the first constant potential electrodes 22G are always at the ground potential, and the individual electrodes 21 are applied with the positive potential or the application is released to turn them to the ground potential. Therefore, when the individual electrodes 21 are at the ground potential, voltage is applied to the first active portions 91, but the voltage is not applied to the second and third active portions 92, 93. On the other hand, when the positive potential is applied to the individual electrodes 21, voltage is not applied to the first active portions 91 but the voltage is applied to the second and third active portions 92, 93. Here, the voltage applied between electrodes during driving is smaller than the voltage which is applied during polarization, thereby suppressing deterioration due to repeated application of voltage between electrodes.

Thus, since the electrodes 21, 23F, 22G are arranged as described above, when jetting ink, the ground potential is applied first to the individual electrodes 21 by the above-described voltage application mechanism. Accordingly, the first active portions 91 are in a standby state. That is, the first active portions 91 are applied with voltage such that the direction of the electric field is the same as the direction as the polarization direction. Therefore the first active portions 91 expand in the stacking direction Z (first direction) toward the pressure chambers 40 and contracts in the directions X, Y (second directions) orthogonal to the stacking direction Z by piezoelectric lateral effect, and thereby project and deform in a direction toward insides of the pressure chambers 40.

Subsequently, when positive potential (for example 20 V) is applied to the individual electrodes 21, the first active portions 91 turn to a non-deformation state of not expanding/contracting in the stacking direction Z and the direction X orthogonal thereto. At this time, the second and third active portions 92, 93 turn to a voltage application state, and attempt to expand in the stacking direction Z (first direction) toward the pressure chambers 40 and attempt to contract in the two directions X, Y (second directions) orthogonal to the stacking direction Z. Thus, with the operation of the top plate 15 as a binding plate, the second active portions 92 located at both side portions of the pressure chamber row direction X as well as the third active portions 93 located at one side portions in the direction Y orthogonal to the pressure chamber row direction X deform to bend in a direction to depart from the pressure chambers 40. This deformation of the second and third active portions 92, 93 contributes to increasing of volumetric changes of the pressure chambers 40, and contributes to sucking of a large amount of ink from the manifolds 50 to the pressure chambers 40.

Then, when the ground potential is applied again to the individual electrodes 21, the first active portions 91 expand in the stacking direction Z toward the pressure chambers 40, contract in the directions X, Y orthogonal to the stacking direction Z, and thereby project and deform in the direction toward the insides of the pressure chambers 40. Accordingly, the volumes of the pressure chambers 40 decrease, the pressure of ink increases, and the ink is jetted from the nozzle holes 16*a*.

When the ground potential is applied to the individual electrodes 21 and the first active portions 91 are driven to jet the ink, the individual electrodes 21 and the first constant potential electrodes 22G are both at the ground potential, and the second and third active portions 92, 93 turn to a non-application state of voltage. Thus, the second and third active portions 92, 93 return to a state of not expanding/contracting (non-deform) in anyone of the directions Z, X, Y. Therefore, when the first active portions 91 project and deform in the direction toward the pressure chambers 40 (stacking direction Z), the second and third active portions 92, 93 return to a state of not deforming (this is equivalent to contracting in the stacking direction Z and expanding in the two directions X, Y orthogonal to the stacking direction Z). Thus, the influence of deformation of the first active portions 91 is suppressed in a manner of being cancelled by deformation of the second and third active portions 92 (see the parts P1, P2 in FIG. 4) and hardly reaches the pressure chambers 40 adjacent thereto in the pressure chamber row direction X and the direction Y orthogonal thereto, thereby suppressing crosstalk. That is, application and non-application of voltage to the second and third active portions 92, 93 (second and third portions) are switched so as to suppress that deformation of the first active portions 91 (first portions) due to switching of application/non-application of voltage to the first active portions 91 propagates to both sides in the pressure chamber row direction X of the pressure chambers 40 and to the pressure chambers 40 adjacent to each other on one side in the direction Y orthogonal to the direction X thereof.

Thereafter, when the individual electrodes 21 are returned to the same potential (positive potential) as the second constant potential electrodes 23F, as explained above, the first active portions 91 turn to a state of not deforming, and the second and third active portions 92, 93 deform to bend in a direction to depart from the pressure chambers 40, resulting in sucking of ink from manifolds 50 to the pressure chambers 40.

By such deformation of the first to third active portions 91 to 93, the jetting operation of ink is repeated, and volumetric changes of the pressure chambers 40 are made to be large in each jetting operation, thereby increasing jetting efficiency and suppressing crosstalk in the three directions.

In the above-described embodiment, it is not possible to suppress propagation to the adjacent pressure chambers 40 on the other side of the direction Y orthogonal to the pressure chamber row direction X (see the part P3 in FIG. 39). Accordingly, it is possible to make the individual electrodes 21 have portions formed longer than the second constant potential electrodes 23F not only on one side of the orthogonal direction Y but also on the both sides, so as to enable suppressing of propagation to the adjacent pressure chambers 40 in either side of the orthogonal direction Y.

In this case, for example as shown in FIGS. 44 to 47, the piezoelectric actuator 112 further includes, in addition to the first to third active portions 91 to 93, fourth active portions 94 corresponding to the other side portion of the orthogonal direction Y with respect to the center portions of the pressure chambers 40. By forming the connection electrodes 35 connecting the second constant potential electrodes 23F closer to the center portions of the pressure chambers 40 in the direction Y than in the above-described embodiment, the individual electrodes 21 have portions (portions P12, P13 in FIG. 44) formed longer than the second constant potential electrodes 23F not only on one side of the direction Y but also on the other side thereof. These fourth active portions 94 (corresponding to the portion P13 of FIG. 44) are structured including piezoelectric materials (piezoelectric material layers 12*a*, 12*b*) sandwiched between the individual electrodes 21 and the first constant potential electrodes 22G, similarly to the second and third active portions. Further, the first constant potential electrodes 22G are formed on the entire surface.

When voltage is applied to the first active portions 91, the voltage is not applied to the fourth active portions 94. When voltage is not applied to the first active portions 91, the voltage is applied to the fourth active portions 94, in which when voltage is applied by the voltage application mechanism, they turn to a deformation state of expanding in the stacking direction Z and contracting in the directions X, Y orthogonal thereto, similarly to the second and third active portions 92, 93.

Accordingly, it is possible to suppress inter-row crosstalk that is propagation of the influence of deformation of the first active portions 91 to the adjacent pressure chambers 40 by the fourth active portions 94, similarly to the second and third active portions 92, 93. Note that as regions occupied by the fourth active portions 94 are, in a plan view, smaller on average than regions occupied by the third active portions 93, the effect of suppressing inter-row crosstalk is exhibited also by the fourth active portions 94, although it is slightly poorer than by the third active portions 93.

Further, in this case, in the pressure chamber row direction X, two of the connection electrodes for connecting the second constant potential electrodes 23F to the adjacent second constant potential electrodes 23F in the pressure chamber row direction X are arranged on the same side. However, as shown in FIGS. 48 to 51, it is also possible to arrange one connection electrodes 35*a* thereof on one side of the direction Y, and other connection electrodes 35*b* thereof on the other side of the direction Y. In this manner, active portions to cancel the influence of deformation of the pressure chambers 40 (corresponding to parts P21 to P24 in FIG. 47) can be formed in a well-balanced manner in circumferences of the pressure chambers 40 in a plan view, and portions to suppress crosstalk can be formed more effectively. Note that the portions P25, P26 where the connection electrodes 35A, 35B are provided cannot exhibit the suppression effect. Further, in the case of this embodiment, although the effect of suppressing inter-row crosstalk by the fourth active portions 94 is slightly poorer than by the third active portions 93, the effect of suppressing inter-row crosstalk can be exhibited also by the fourth active portions 94.

Figure 52:
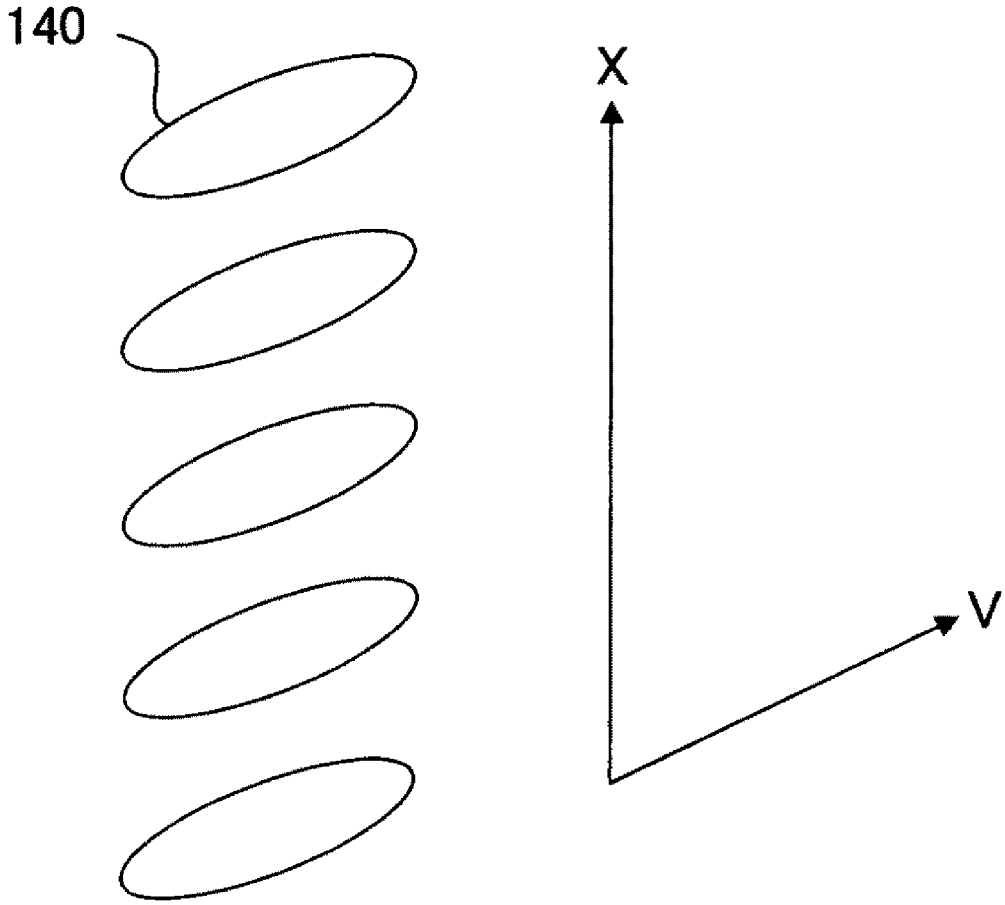
FIG. 52 is an explanatory view in a crossing direction.

In this example 12, the third active portions are provided corresponding to the one side in a direction orthogonal to the predetermined direction with respect to the center portions of the pressure chambers. However, as shown in FIG. 52 for example, when pressure chambers 140 are provided to incline in a direction orthogonal to the pressure chamber row direction X (predetermined direction), it is also possible to provide the third active portions on one side in a crossing direction V corresponding to the inclined direction, or to provide the third and fourth active portions on both sides.

Thirteenth Embodiment

Figure 53:
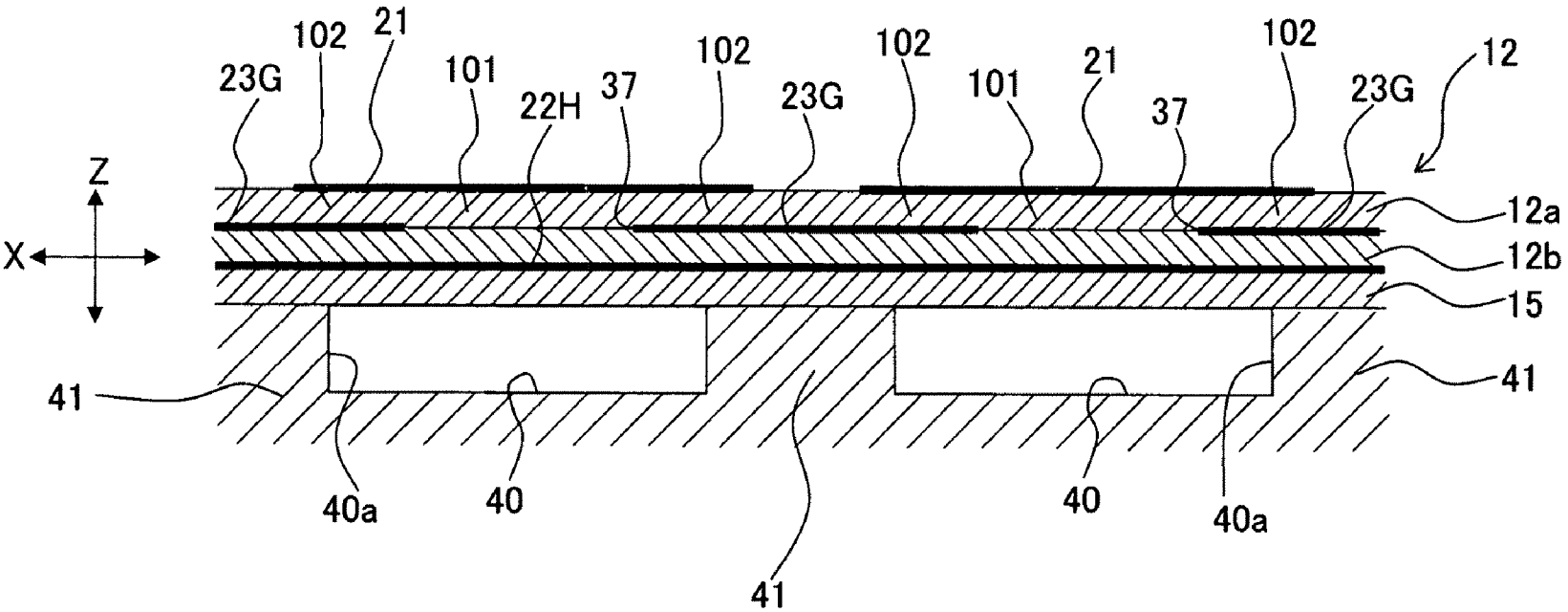
FIG. 53 is a schematic cross-sectional view of the thirteenth embodiment.
Figure 54:
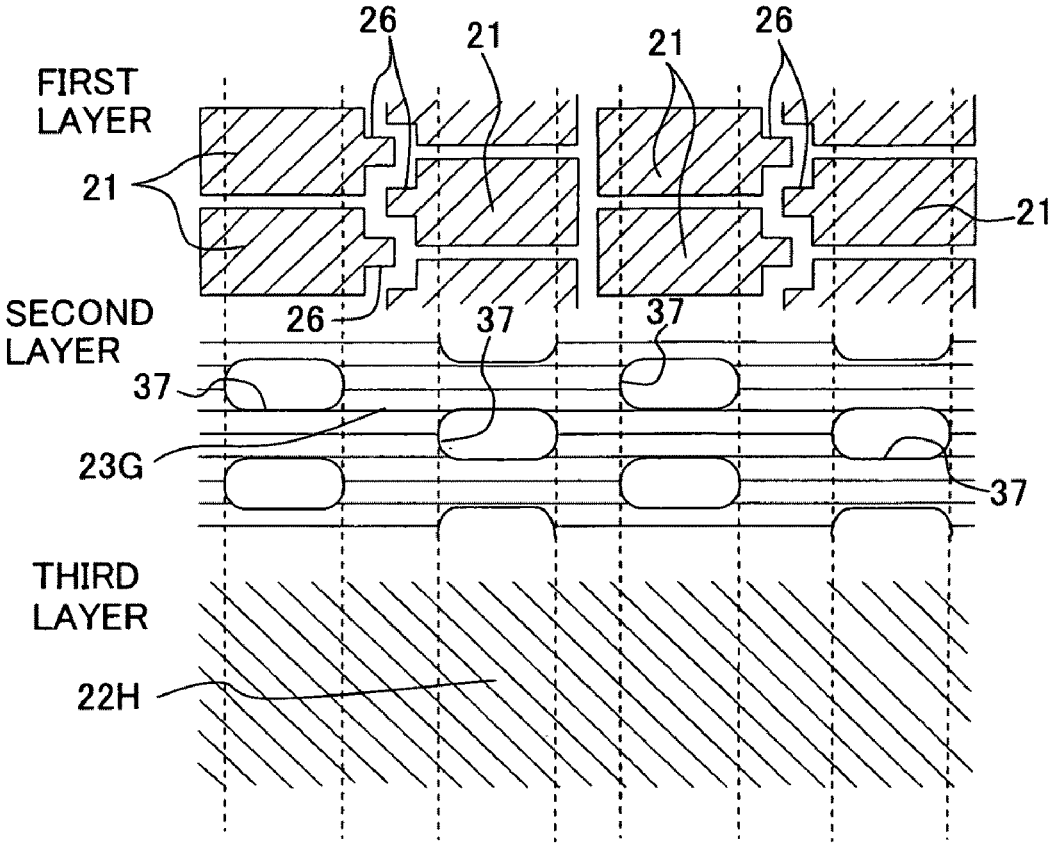
FIG. 54 is an explanatory view of arrangements of electrodes on piezoelectric material layers of a piezoelectric actuator.

In this example, as shown in FIGS. 53 to 55, a stack in which at least two of piezoelectric material layers 12*a*, 12*b* are stacked vertically is included, and there are provided, in a plan view, a plurality of individual electrodes 21 provided corresponding to the pressure chambers 40, a first common constant potential electrode 22H sandwiching the piezoelectric material layers 12*a*, 12*b* with the individual electrodes 21, and a second common constant potential electrode 23G having a plurality of openings 37 and sandwiching the piezoelectric material layer 12*a* with the individual electrodes 21. Then, the second common constant potential electrode 23G is formed between the two layers of piezoelectric material layers 12*a*, 12*b* forming the stack. The individual electrodes 21 are formed on one surface of the stack (piezoelectric material layers 12*a*, 12*b*), that is, an upper surface side of the piezoelectric material layer 12*a* on an upper side, and the first common constant potential electrode 22H is formed on the other surface thereof, that is, a lower surface side of the piezoelectric material layer 12*b* on a lower side.

Further, a plurality of first active portions 101 are formed by portions corresponding respectively to center portions of the individual electrodes 21 in the piezoelectric materials (piezoelectric material layers 12*a*, 12B) sandwiched between the individual electrodes 21 and the first common constant potential electrode 22H. Further, second active portions 102 are formed by the piezoelectric material (piezoelectric material layer 12*a*) sandwiched between the individual electrodes 21 and the second common constant potential electrode 23G.

Figure 55A:
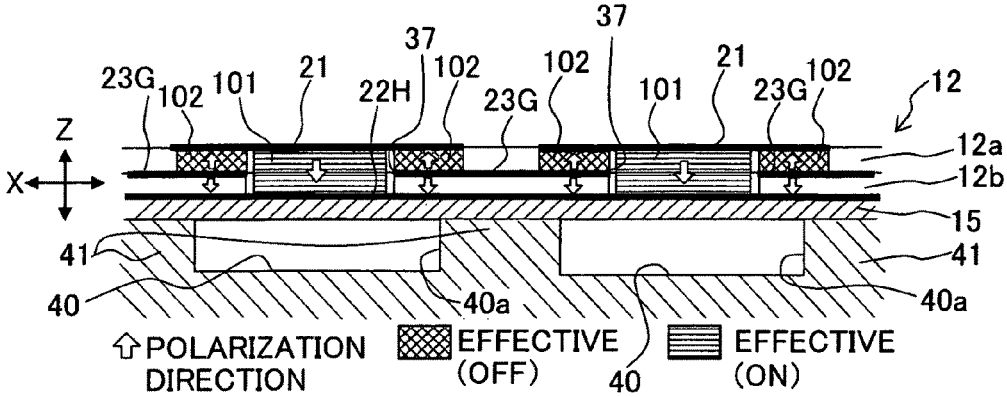
FIGS. 55A, 55B, 55C are explanatory views showing a relationship among a polarization direction, portions (first active portions) which are effective while being turned ON and effective during application of voltage, and portions (second active portions) which are effective while being turned OFF and effective during non-application of voltage, regarding the thirteenth embodiment.
Figure 55B:
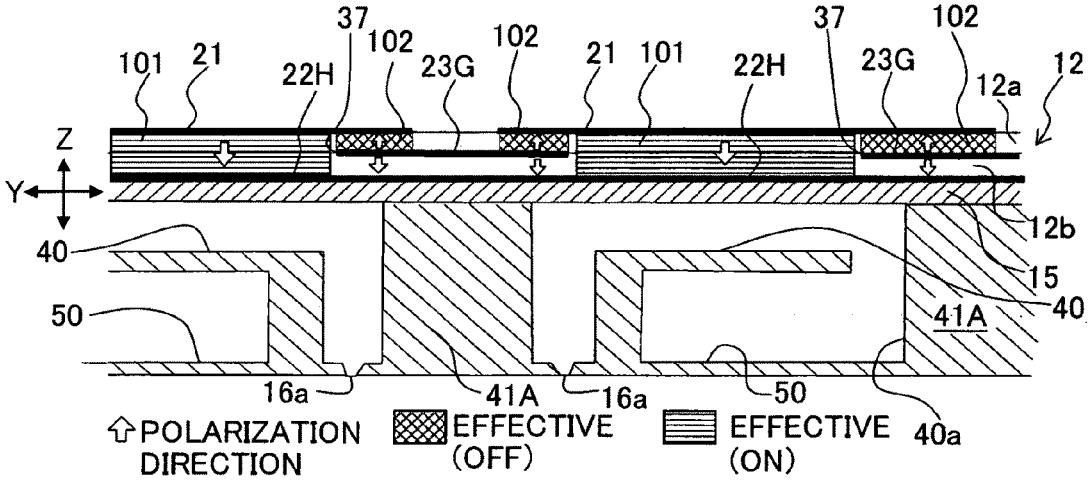
Figure 55C:
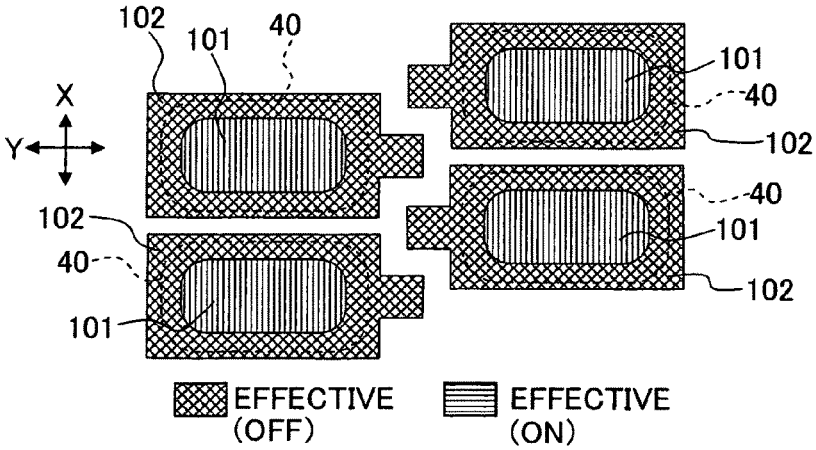

Then as shown in FIG. 55C, the piezoelectric actuator 12 includes, in a plan view (seeing from the stacking direction of the cavity unit 11 and the piezoelectric actuator 12), the first active portions 101 (first portions) provided corresponding to the pressure chambers 40 and the second active portions 102 (second portions) corresponding respectively to outer peripheral sides which are more outside than center portions of the pressure chambers 40. Here, the center portions of the pressure chambers 40 are portions located at substantially centers both in the pressure chamber row direction X in which the pressure chambers 40 are arranged and in the direction Y orthogonal thereto. That is, the second active portions 102 are formed in circumferences of the first active portions 101. Further, the second active portions 102 include not only regions corresponding to portions (center portion sides) more inside than the outer peripheral edges 40*a* of the pressure chambers 40 but also regions corresponding to the beam portions 41, 41A which are walls partitioning the adjacent pressure chambers 40, both in the pressure chamber row direction X and in the direction Y orthogonal thereto.

Further, the individual electrodes 21 have, in a plan view, connection terminal portions 26 for applying voltage by the voltage application mechanism arranged outside the regions corresponding to the pressure chambers 40. The second common constant potential electrode 23G also have, in a plan view, portions overlapping with the connection terminal portions 26 of the individual electrodes 21, and hence parts of the second active portions 102 are formed also by the piezoelectric material layer 12*a* sandwiched between the overlapping portions and the connection terminal portions 26. Note that in adjacent pressure chamber rows, the individual electrodes 21 are formed to be shifted by a half pitch in the pressure chamber row direction X, and between rows thereof, connection terminal portions 26 of the individual electrodes 21 to be connected to the connection terminals (not shown) of the flexible wiring board 13 are formed in a zigzag pattern.

The openings 37 of the second common constant potential electrode 23G each have, in a plan view, a shape duplicating the shape of the pressure chambers 40 but smaller than the pressure chambers 40, and these openings 37 are also formed to be shifted by a half pitch in the pressure chamber row direction X in adjacent pressure chamber rows.

Further, to the individual electrodes 21, the driver IC 90 supplying driving signals is connected electrically via the flexible wiring board 13 (signal lines). The driver IC 90 and the flexible wiring board 13 form a voltage application mechanism for applying driving voltage to the first and second active portions 101, 102 of the piezoelectric actuator 12.

Specifically, to change volumes of the pressure chambers 40, the ground potential (first potential) and positive potential (second potential: 20 V for example) different therefrom are applied selectively to the individual electrodes 21 via the flexible wiring board 13. Further, the ground potential is applied constantly to the first common constant potential electrode 22H, and the positive potential is applied constantly to the second common constant potential electrode 23G.

Thus, the piezoelectric actuator 12 has the individual electrodes 21 corresponding respectively to the pressure chambers 40, and is structured to change the volumes of the pressure chambers 40 by applying the ground potential and the positive potential selectively to the individual electrodes 21 as a drive signal, so as to jet ink from the nozzle holes 16*a*.

To describe in more detail, in a plan view, the individual electrodes 21 are formed longer than the pressure chambers 40 both in the pressure chamber row direction X and in the direction Y orthogonal thereto and across regions corresponding to the first active portions 101 and regions corresponding to the second active portions 102 so as to cover both of these regions. Then the first common constant potential electrode 22H is formed to cover regions corresponding to the first active portions 101. The second common constant potential electrode 23G is then formed to cover, in a plan view, regions corresponding to the second active portions 102 and regions corresponding to the beam portions 41, 41A between the pressure chambers 40 adjacent to each other in the pressure chamber row direction X and the direction Y orthogonal thereto. That is, the second common constant potential electrode 23G extends to regions corresponding to side portions in the pressure chamber row direction of the pressure chambers 40 including the regions corresponding to the beam portions 41, and are shared for two pressure chambers 40 adjacent to each other in the pressure chamber row direction X of the pressure chambers 40.

Note that as shown in FIGS. 55A, 55B, the first active portions 101 are polarized in the same direction (polarization direction) as the direction of the electric field caused by the applied voltage when the positive potential is applied to the individual electrodes 21 and the ground potential is applied to the first common constant potential electrode 22H for deformation. On the other hand, the second active portions 102 are polarized in the same direction as the direction of the electric field caused by the applied voltage when the ground potential is applied to the individual electrodes 21 and the positive potential is applied to the second common constant potential electrode 23G for deformation. That is, the directions of the electric field generated by the applied voltage is applied and the polarization directions are the same. Here, in FIGS. 55A to 55C, portions which are "effective while being turned ON" correspond respectively to the first active portions to which voltage (20 V) is applied when the positive potential is applied to the individual electrodes 21, and portions which are "effective while being turned OFF" correspond respectively to the second active portions to which voltage (20 V) is applied when the ground potential is applied to the individual electrodes 21.

Figure 56:
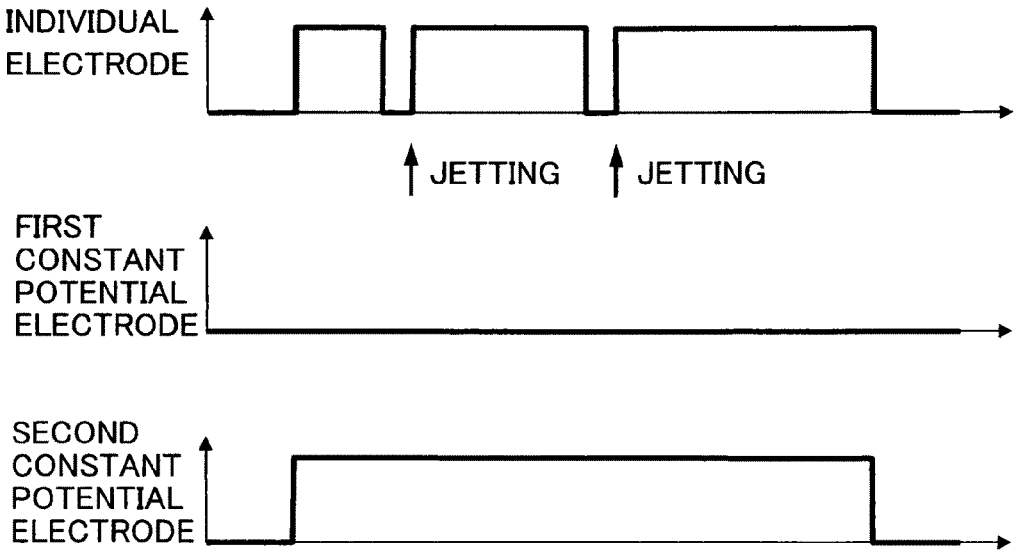
FIG. 56 is a timing chart.

The first common constant potential electrode 22H is always at the ground potential, and the second common constant potential electrode 23G is always at the positive potential. Then, to the individual electrodes 21, the ground potential and the positive potential are applied selectively for changing the volumes of the pressure chambers 40. The direction of the electric field generated by the applied voltage is the same during polarization and during driving. However, the first common constant potential electrode 22H is always at the ground potential (0 V), the second common constant potential electrode 23G is always at the positive potential (20 V: constant), and to the individual electrodes 21, the positive potential (20 V: constant) is applied or this application is released (see FIG. 56). Therefore, when the positive potential is applied to the individual electrodes 21, the voltage is applied to the first active portions 101 but the voltage is not applied to the second active portions 102. On the other hand, when the positive potential is not applied to the individual electrodes 21 and the individual electrodes 21 are at the ground potential, the voltage is not applied to the first active portions 101, and the voltage is applied to the second active portions 102. Here, the voltage applied between electrodes during driving is smaller than the voltage applied during polarization, thereby suppressing deterioration due to repeated application of voltage between electrodes.

Figure 57A:
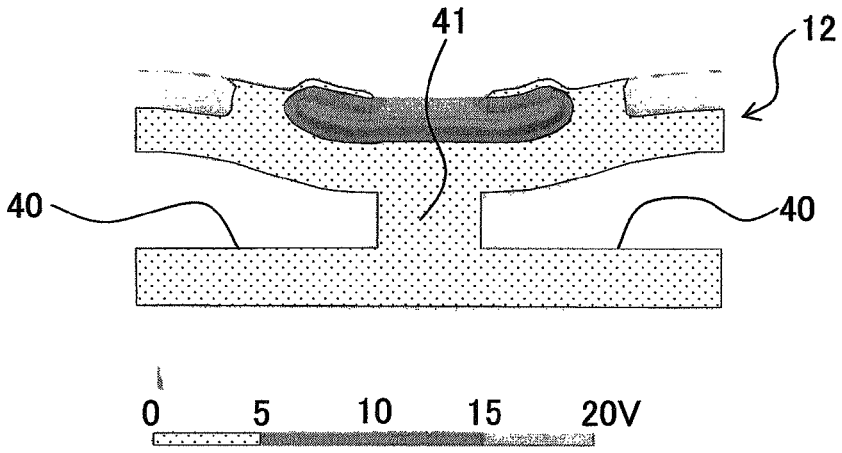
FIGS. 57A, 57B are explanatory views showing volumetric changes of pressure chambers during non-application/application of voltage to first active portions.
Figure 57B:
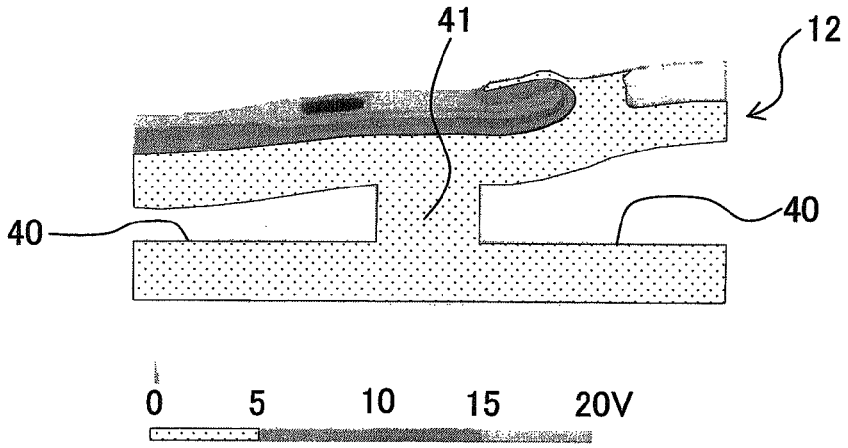

Since the electrodes 21, 22H, 23G are arranged as described above, in a standby state, when the voltage application mechanism makes the individual electrodes 21 be at the ground potential, the electric field in the first active portions 101 is generated in the same direction as the polarization direction. Then, by piezoelectric lateral effect, the first active portions 101 expand in the stacking direction Z toward the pressure chambers 40 and contract in the directions X, Y orthogonal to the stacking direction Z, thereby attempting to project and deform in a direction toward insides of the pressure chambers 40. On the other hand, as the top plate 15 does not contract spontaneously because it is not influenced by electric field, a differences is made in distortion in the polarization direction and in the vertical direction between the piezoelectric material layer 12*b* located on the upper side and the top plate 15 located on the lower side. This and the top plate 15 being fixed to the cavity plate 14A together cause the piezoelectric material layer 12*b* and the top plate 15 to turn to a deformed state so as to project toward the side of the pressure chambers 40 (unimorph deformation), as shown in FIG. 57B.

When jetting ink, first the positive potential is applied by the individual electrodes 21 by the voltage application mechanism, and the first active portions 101 are in a state of not expanding/contracting (non-deform) in the pressure chamber row direction and the directions X, Y orthogonal thereto. At this time, the second active portions 102 are in a voltage applied state, and attempt to expand in the stacking direction Z (first direction) toward the pressure chambers 40 and contract in the directions X, Y (second directions) orthogonal to the stacking direction Z. Thus, by the operation of the top plate 15 as a binding plate, the second active portions 102 located at the side portions in the pressure chamber row direction deform to bend in a direction to depart from the pressure chambers 40. This deformation of the second active portions 102 contributes to increasing of volumetric changes of the pressure chambers 40 as shown in FIG. 57A, and contributes to sucking of a large amount of ink from the manifolds 50 to the pressure chambers 40.

Then, by turning the individual electrodes 21 again to the ground potential, and by applying the voltage to the first active portions 101 in the same direction as the polarization direction, there is created a state of projecting and deforming toward the insides of the pressure chambers 40, similarly to the above-described case. Accordingly, the volumes of the pressure chambers 40 decrease, the pressure of ink increases, and the ink is jetted from the nozzle holes 16*a*.

In this application period of voltage to the first active portions 101, the second active portions 102 turn to a non-application state of voltage, and hence return to a state of not expanding/contracting (non-deform) in the stacking direction Z and the directions X, Y orthogonal thereto. Thus, when the first active portions 101 project and deform in the direction (stacking direction Z) toward the pressure chambers 40, the second active portions 102 return to a state of not deforming (this is equivalent to contracting in the stacking direction Z and expanding in the two directions X, Y orthogonal to the stacking direction Z). Thus, as shown in FIG. 57A, the influence of deformation of the first active portions 101 is suppressed in a manner of being cancelled by deformation of the second active portions 102 and hardly reaches the pressure chambers 40 adjacent thereto located in the circumference (that is, pressure chambers 40 adjacent thereto in the pressure chamber row direction X and pressure chambers 40 adjacent thereto in a direction orthogonal to the pressure chamber row direction X), thereby suppressing crosstalk. That is, application and non-application of voltage to the second active portions 102 are switched so as to suppress that deformation of the first active portions 101 due to switching of application and non-application of voltage to the first active portions 101 propagates to the adjacent pressure chambers 40.

Thereafter, when jetting the ink again, the individual electrodes 21 are returned to the same potential (ground potential) as the first common constant potential electrode 22H, the first active portions 101 turn to a state of not deforming as described above, the second active portions 102 deform to bend in a direction to depart from the pressure chambers 40, and the volumes of the pressure chambers 40 return to the original volumes. Thus, the ink is sucked into the pressure chambers 40 from the manifolds 14Da, 14Ea.

Thus, deformation of the first active portions 101 and the second active portions 102 is repeated, and volumetric changes of the pressure chambers 40 are made to be large in each jetting operation. Thus, jetting efficiency is increased, and crosstalk is suppressed.

In the examples, the thicknesses of the piezoelectric material layers 12*a*, 12*b* and the top plate 15 (binding plate) are the same. Thus, when the piezoelectric actuator 12 including the top plate 15 deforms, a neutral plane in which deformation does not occur is located in a center portion in the thickness direction of the piezoelectric material layer 12*b* on a lower side. Therefore, deformation of the piezoelectric actuator 12 cannot be used effectively for deforming the pressure chambers 40 to allow jetting of the ink.

Figure 58:
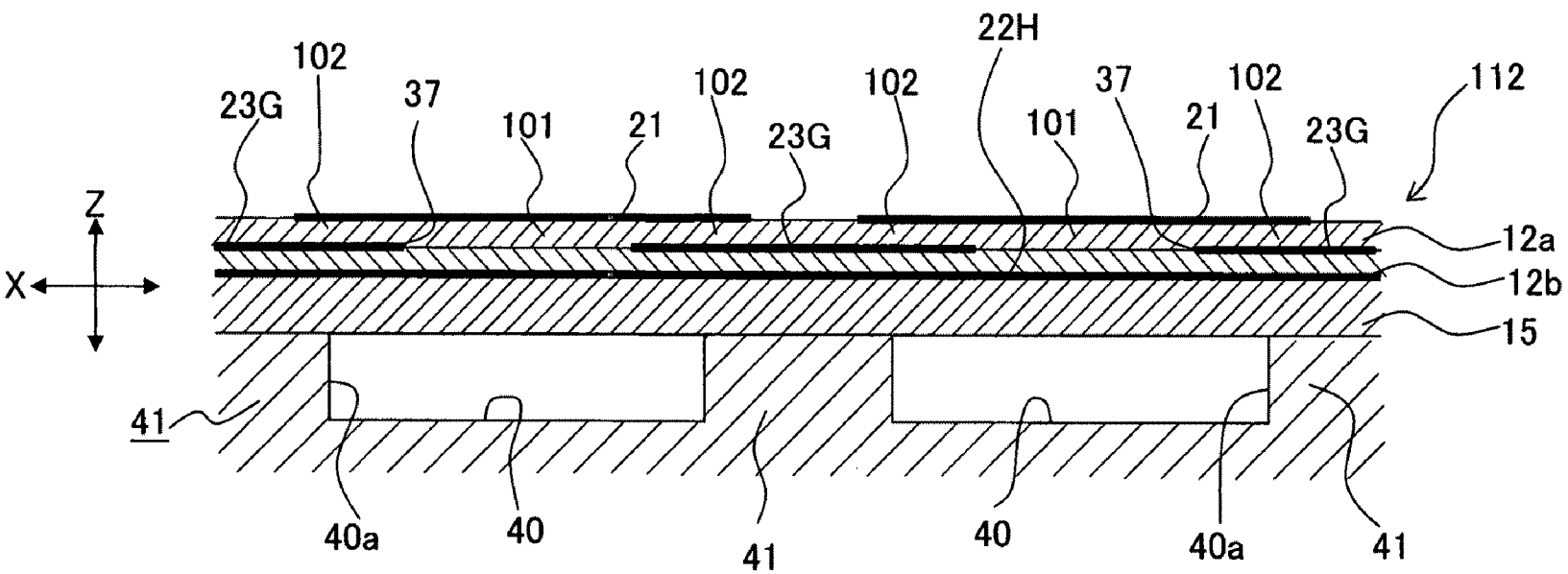
FIG. 58 is a view similar to FIG. 53 regarding a modification example of the thirteenth embodiment.
Figure 59A:
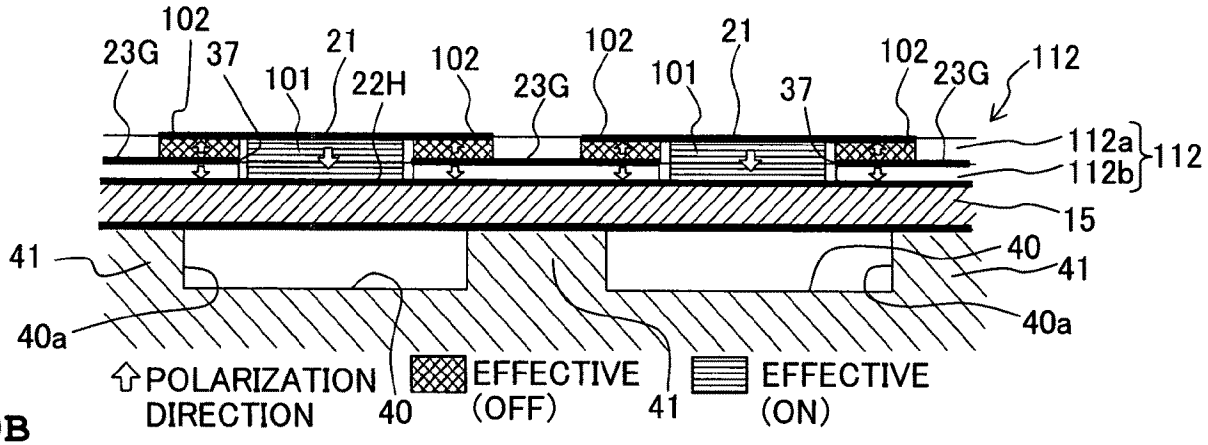
FIGS. 59A, 59B are views similar to FIGS. 55A, 55B respectively regarding the modification example.
Figure 59B:
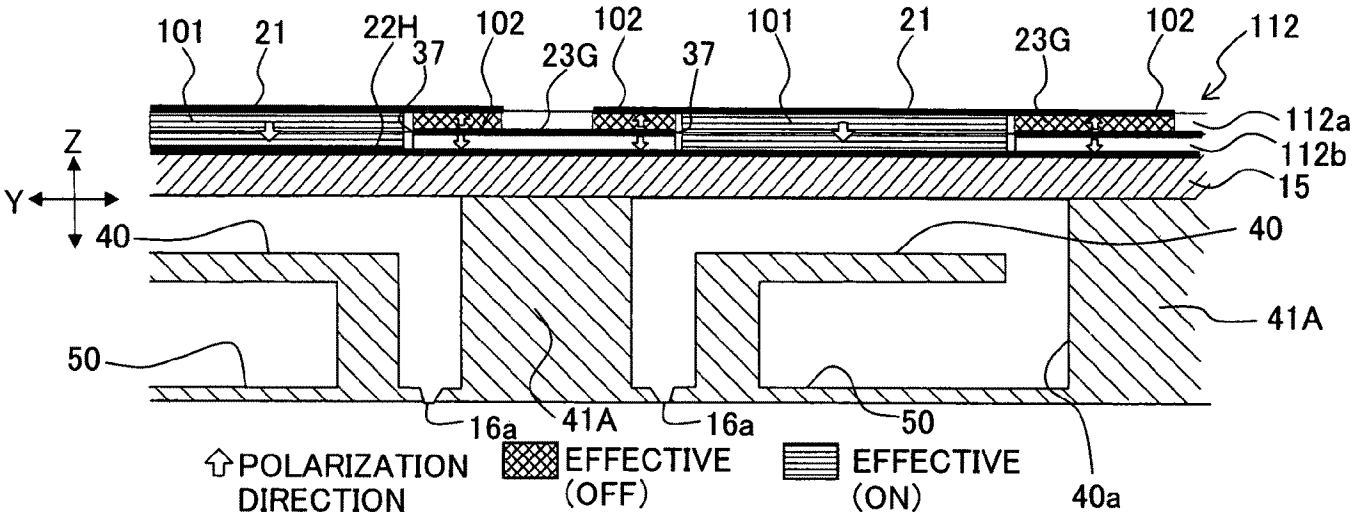
Figure 60:
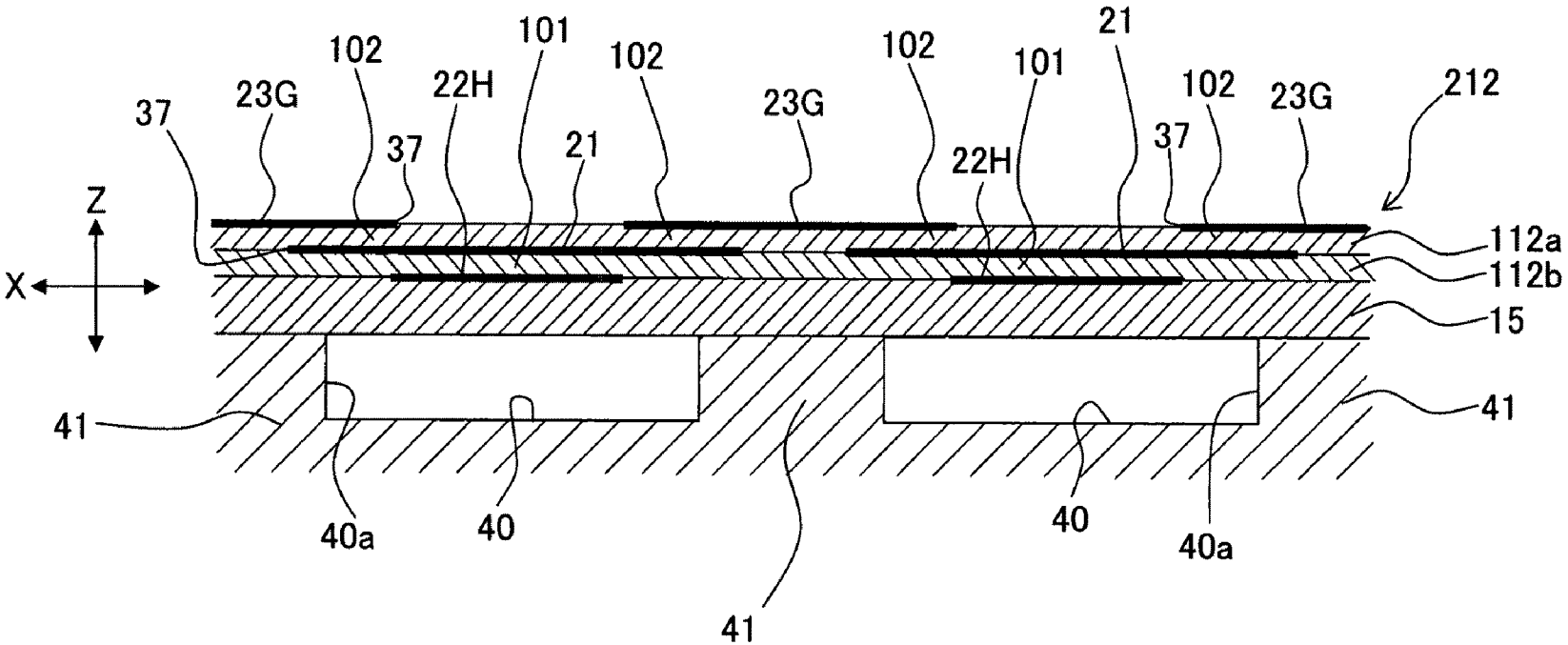
FIG. 60 is a view similar to FIG. 53 regarding a further different modification example of the thirteenth embodiment.
Figure 61:
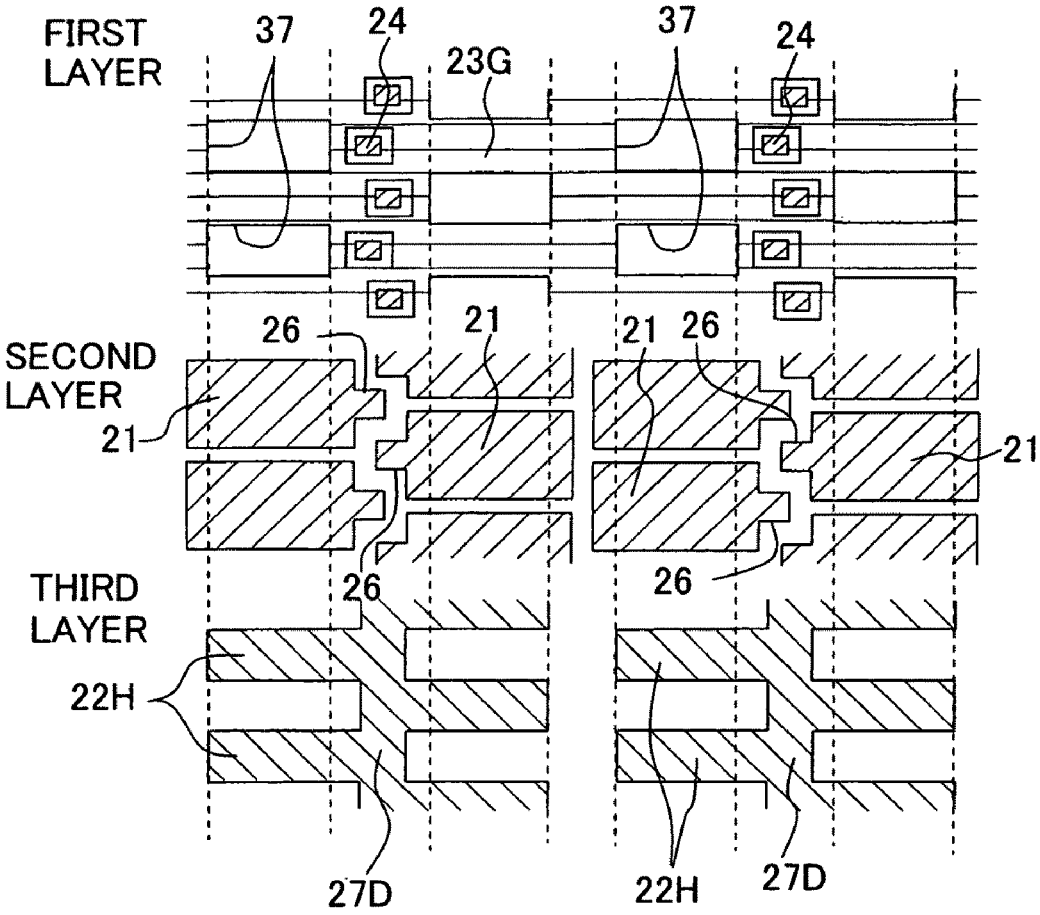
FIG. 61 is a view similar to FIG. 54 regarding the different modification example.
Figure 62A:
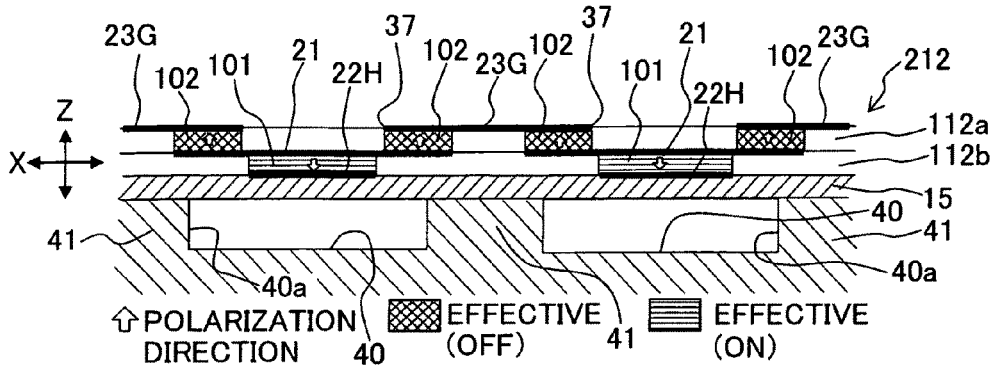
FIGS. 62A, 62B, 62C are views similar to FIGS. 55A, 55B, 55C respectively regarding the different modification example.
Figure 62B:
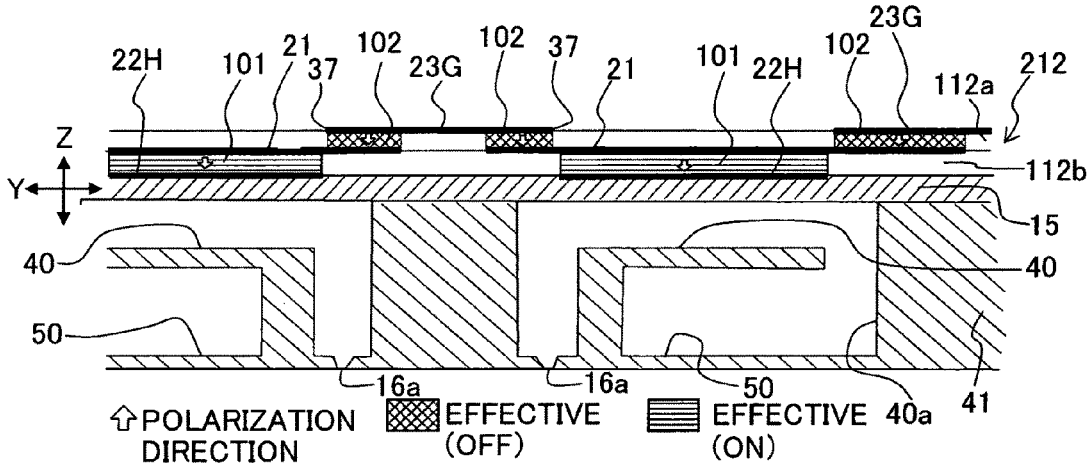
Figure 62C:
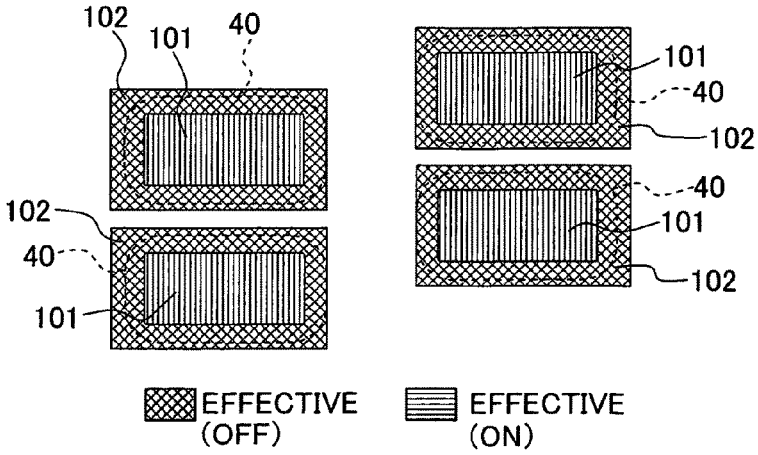

Accordingly, since the piezoelectric actuator 12 is stacked on the upper side of the cavity unit 11 via the top plate 15, when the thickness of the top plate (binding plate) and the thickness of a piezoelectric actuator 112 (piezoelectric material layers 112*a*, 112*b*) are made to be the same as shown in FIGS. 58, 59A, and 59B, a lower surface of the piezoelectric actuator 112 (piezoelectric material layer 112*b* on a lower side) becomes a neutral plane which does not deform (neutral plane not expanding/contracting within the plane) when the first and second active portions 101, 102 deform. Thus, deformation of the piezoelectric actuator 112 (first and second active portions 101, 102) can be used effectively.

Further, it is not necessary that the individual electrodes are provided on the upper surface side of the piezoelectric material layer on the upper side and the second common constant potential electrode is provided on the lower surface side as in the above-described embodiment. As shown in FIGS. 60, 61, and 62A to 62C, it is also possible to have a structure in which the second common constant potential electrode 23G is formed on an upper surface side of the piezoelectric material layer 112*a* on an upper side, and the individual electrodes 21 are formed on a lower surface side thereof. In this case, it is necessary for wiring to the individual electrodes 21 that through holes 24 filled with conductive materials are formed with respect to connection terminal portions 26 of the individual electrodes 21 so as to guide the connection terminal portions 26 of the individual electrodes 21 to the upper surface side of the piezoelectric material layer 112*a* on the upper side. Further, first common constant potential electrodes 22H are formed corresponding to center portions of the individual electrodes 21 and are connected to connection electrode portions 27 extending in the pressure chamber row direction X, and the connection electrode portions 27D are common electrodes of these first common constant potential electrodes 22H.

Figure 63A:
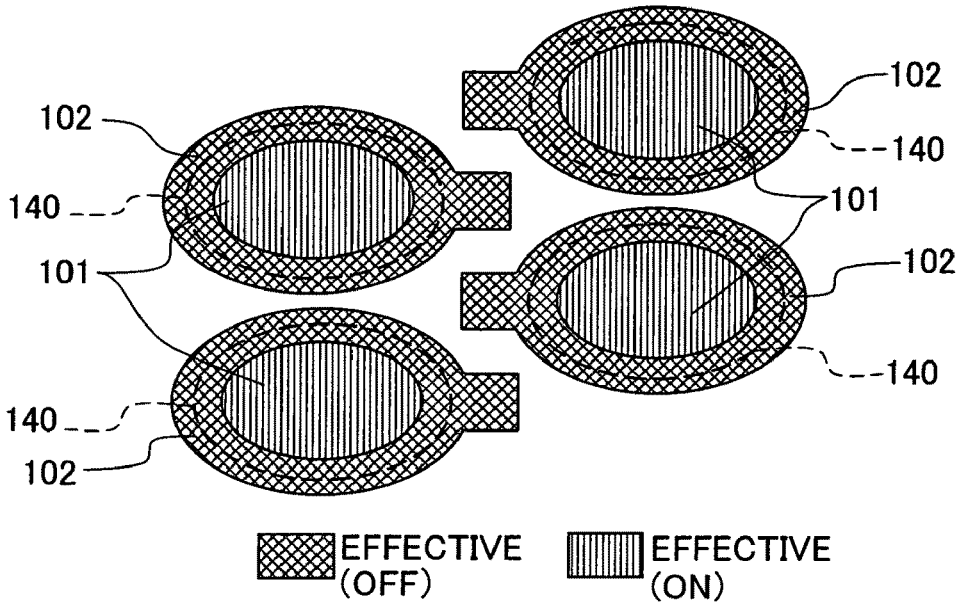
FIGS. 63A, 63B are explanatory views regarding modification examples of shapes of pressure chambers.
Figure 63B:
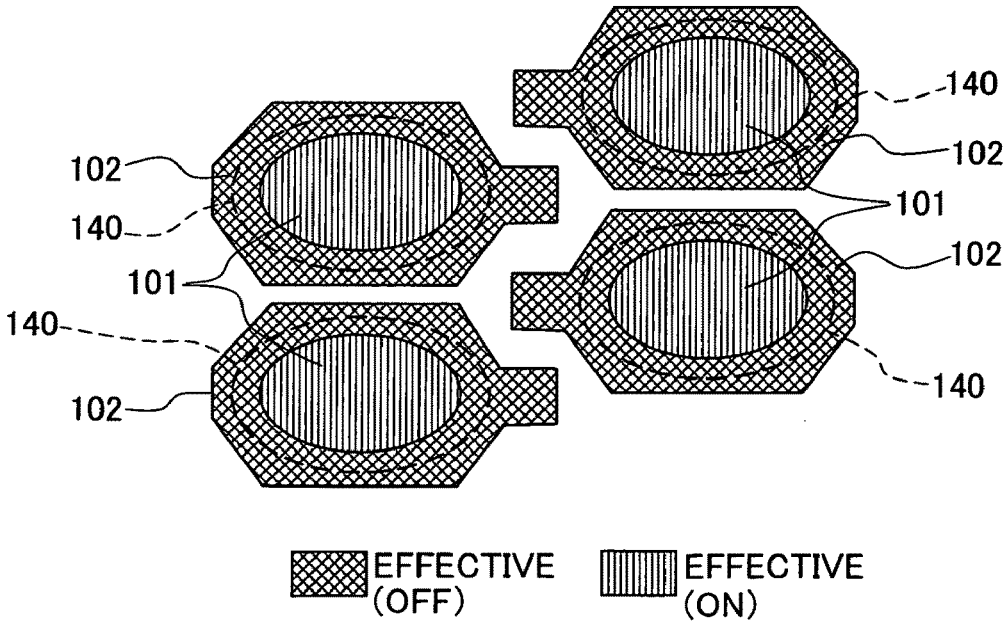

In this example, in a plan view, the pressure chambers 40 each have an elliptic shape and the individual electrodes 21 each have a rectangular shape, but in the present invention, shapes of the pressure chambers as well as the individual electrodes having shapes corresponding thereto are not limited to these shapes, and can also be formed as shown in FIGS. 63A and 63B. In the case shown in FIG. 63A, in a plan view, the pressure chambers 140 and the individual electrodes are both made to have elliptic shapes. In the case shown in FIG. 63B, the pressure chambers 140 are each formed in an elliptic shape but the individual electrodes are each formed in an octagonal shape that is long in a pressure chamber longitudinal direction. These cases thus show relationships of the first active portions 101 and the second active portions 102.

In the above-described example, since the second constant potential electrodes are applied with positive potential, impedance thereof can be reduced to suppress voltage drop by forming the second constant potential electrodes as described in the next fourteenth embodiment, so that equal jetting performance can be obtained for any nozzle communicating with any one of the pressure chambers 40.

Fourteenth Embodiment

In the case of this example, as shown in FIGS. 64 to 67, in a plan view (that is, when seen in a stacking direction of the cavity unit 11 and the piezoelectric actuator 12), there are provided a plurality of individual electrodes 21 corresponding respectively to the pressure chambers 40; first common constant potential electrode 22K sandwiching piezoelectric material layers 12*a*, 12*b* with individual electrodes 21 formed corresponding to outer peripheral side portions of the pressure chambers 40; and a second common constant potential electrode 23K formed corresponding to center portions of the individual electrodes 21 and sandwiching the piezoelectric material layer 12*a* with the individual electrodes 21. That is, the second common constant potential electrode 23K is formed between the piezoelectric material layers 12*a*, 12*b* forming the stack, the individual electrodes 21 are formed on an upper surface (one surface) of the stack (piezoelectric material layers 12*a*, 12*b*) to sandwich the piezoelectric material layer 12*a* with the second common constant potential electrode 23K, and the first common constant potential electrode 22K is formed on a lower surface (the other surface) thereof to sandwich the piezoelectric material layer 12*b* with the second common constant potential electrode 23K. Here, the center portions of the individual electrodes 21 are center portions in the pressure chamber row direction X (which is also the nozzle row direction in which the nozzle holes 16*a* are arranged) in which the pressure chambers 40 are arranged The individual electrodes 21 have connection terminal portions 26 arranged outside the pressure chambers 40, and it is arranged that voltage is applied to these connection terminal portions 26 by the voltage application mechanism.

The second common constant potential electrode 23K has a plurality of first portions 36A extending in the pressure chamber row direction between adjacent pressure chamber rows, and has a plurality of second portions 36B provided corresponding respectively to the pressure chambers 40 between adjacent two of the first portions 36A to couple them, and these second portions 36B extend in a direction orthogonal to (crossing) the pressure chamber row direction. Thus, the second common constant potential electrode 23K is formed in a mesh pattern. It is attempted to reduce impedance. Thus by reducing the impedance, voltage drop is suppressed, and equal jetting performance can be obtained for any nozzle communicating with any one of the pressure chambers 40.

Further, the first common constant potential electrode 22K has a plurality of third portions 36C extending in the pressure chamber row direction so as to overlap with a plurality of pressure chambers 40 forming a pressure chamber row, and has fourth portions 36D coupling end portions of the plurality of third portions 36C. Note that the third portions 36C are provided so as not to overlap with the first portions 36A of the second common constant potential electrode 23K.

Then there are provided a plurality of first active portions 103 formed by the piezoelectric material layer sandwiched between the individual electrodes 21 and the second common constant potential electrode 23K (second portions 36B), and second active portions 104 formed by the piezoelectric material layer sandwiched between the individual electrodes 21 and the first common constant potential electrode 22K (third portions 36C). Here, the second common constant potential electrode 23K taking part in forming of the first active portions 103 is formed in a mesh pattern for reducing impedance. Thus, voltage drop is suppressed in the second common constant potential electrode 23K, and equal jetting performance can be obtained for nozzles communication with any one of the pressure chambers 40.

To the individual electrodes 21, a driver IC 90 supplying driving signals is connected electrically via the flexible wiring board 13 (signal lines). The driver IC 90 and the flexible wiring board 13 form a voltage application mechanism for applying driving voltage to the first and second active portions 103, 104 of the piezoelectric actuator 12.

Then, by applying the positive potential (first potential) and the ground potential (second potential) as a drive signal selectively to the individual electrodes 21, the piezoelectric actuator 12 changes volumes of the pressure chambers 40 to jet ink from the nozzle holes 16*a*.

Figure 65:
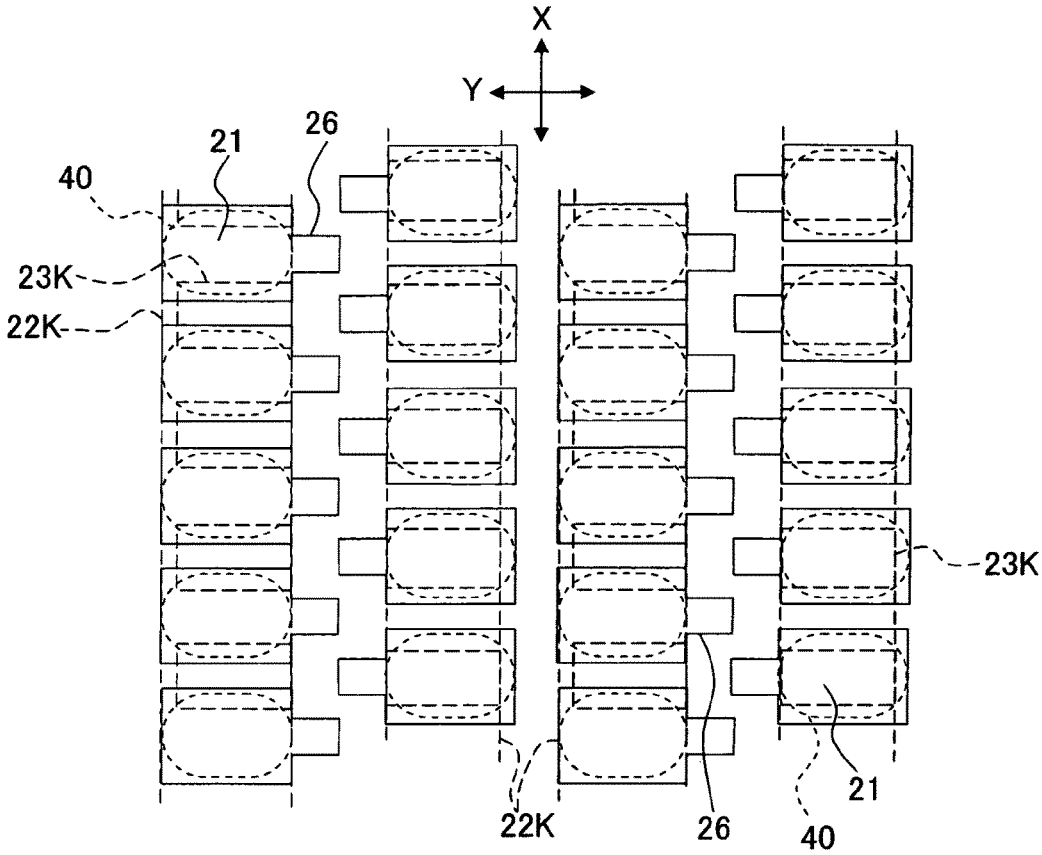
FIG. 65 is a view showing arrangements of electrodes on piezoelectric material layers respectively.
Figure 66:
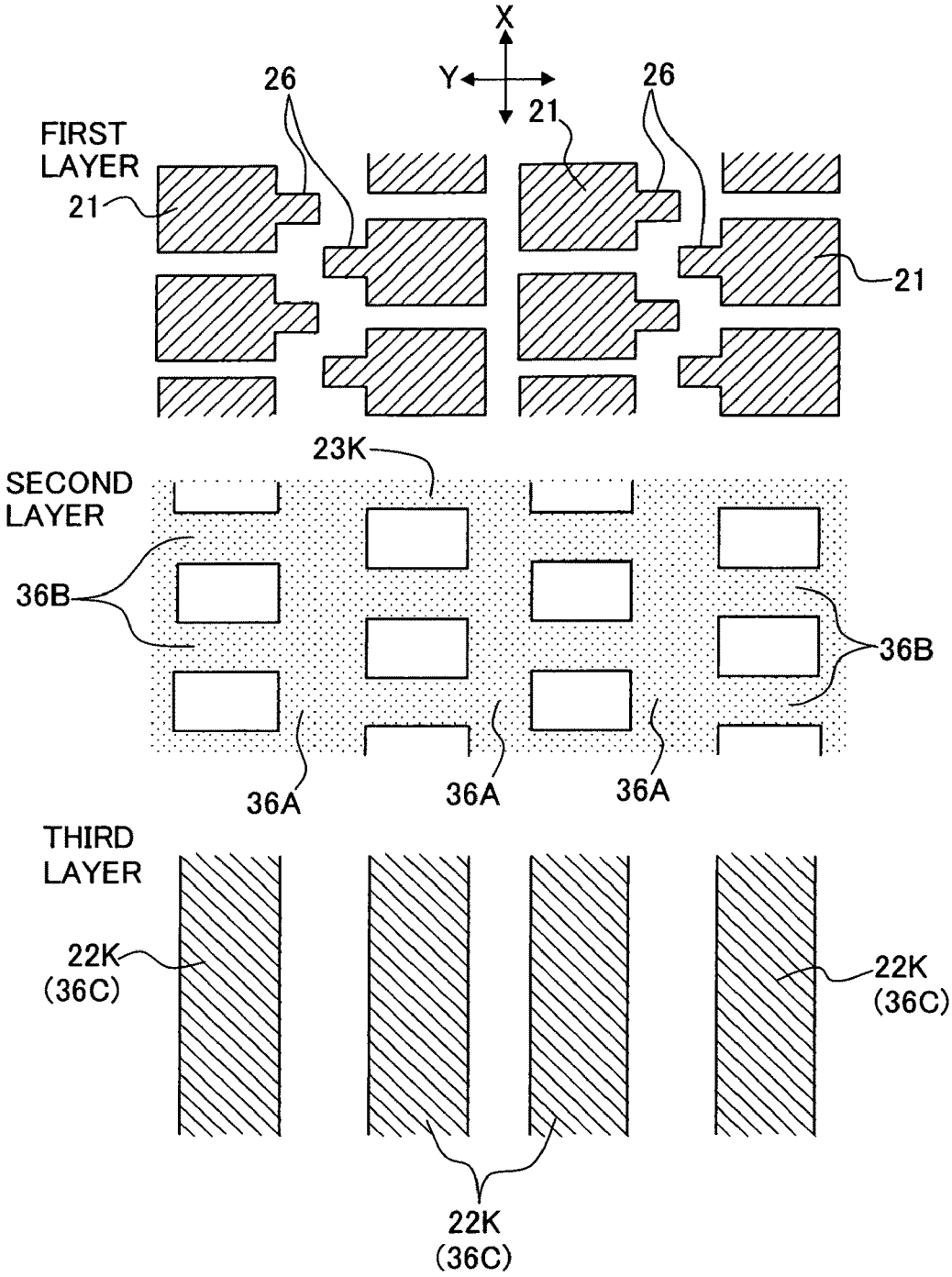
FIG. 66 is a view showing the electrodes on the piezoelectric material layers respectively.

To describe in more detail, as shown in FIGS. 65 and 66, the individual electrodes 21 are rectangular in a plan view and are formed longer than the pressure chambers 40 in the pressure chamber row direction X, shorter than the pressure chambers 40 in the direction Y orthogonal to the pressure chamber row direction X, and across regions corresponding to the first active portions 103 and regions corresponding to the second active portions 104 so as to cover both of these regions. Then the second common constant potential electrode 23K is formed shorter than the pressure chambers 40 in the pressure chamber row direction X so as to cover regions corresponding to the first active portions 103. Then the first common constant potential electrode 22K located on the side of the pressure chambers 40 is formed longer than the second common constant potential electrode 23K in the pressure chamber row direction X. That is, the individual electrodes 21 are shared for the first and second common constant potential electrodes 22K, 23K.

The first common constant potential electrode 22K is formed to cover the regions corresponding to the second active portions 104 and regions corresponding to the beam portions 41 between the pressure chambers 40 adjacent to each other in the pressure chamber row direction X. That is, the first common constant potential electrode 22K extends to regions corresponding to side portions of the pressure chamber row direction X including the regions corresponding to the beam portions 41 and is shared for the pressure chambers 40 adjacent to each other in the pressure chamber row direction X.

Specifically, the first active portions 103 are formed by forming the individual electrodes 21 on the upper surface side of the piezoelectric material layer 12*a* on the upper side, and forming the second common constant potential electrode 23K on the lower surface side thereof. Further, the second active portions 104 are formed by forming the first common constant potential electrode 22K on the lower surface side of the piezoelectric material layer 12*b* on the lower side.

Further, the electrodes 21, 22K, 23K of the piezoelectric material layers 12*a*, 12*b* are, in a plan view, arranged as shown in FIG. 66 in the respective layers. That is, on the upper surface side (first layer) of the piezoelectric material layer 12*a*, the individual electrodes 21 are formed at a constant pitch in the pressure chamber row direction X corresponding respectively to the pressure chambers 40. Then the adjacent individual electrodes 21 are formed to be shifted by a half pitch in the pressure chamber row direction X, and between these rows, connection terminal portions 26 of the individual electrodes 21 to be connected to the connection terminals (not shown) of the flexible wiring board 13 are formed in a zigzag pattern.

On the lower surface side (second layer) of the piezoelectric material layer 12*a*, the second portions 36B of the second common constant potential electrode 23K are formed to be arranged corresponding respectively to the pressure chambers 40, and both end portions of the second portions 36B are coupled respectively to the first portions 36A extending in the pressure chamber row direction between adjacent pressure chamber rows. Further, the third portions 36C of the first common constant potential electrode 22K extend in the pressure chamber row direction between adjacent two of the first portions 36A, and hence do not overlap with the first portions 36A of the second common constant potential electrode 23K.

Figure 67:
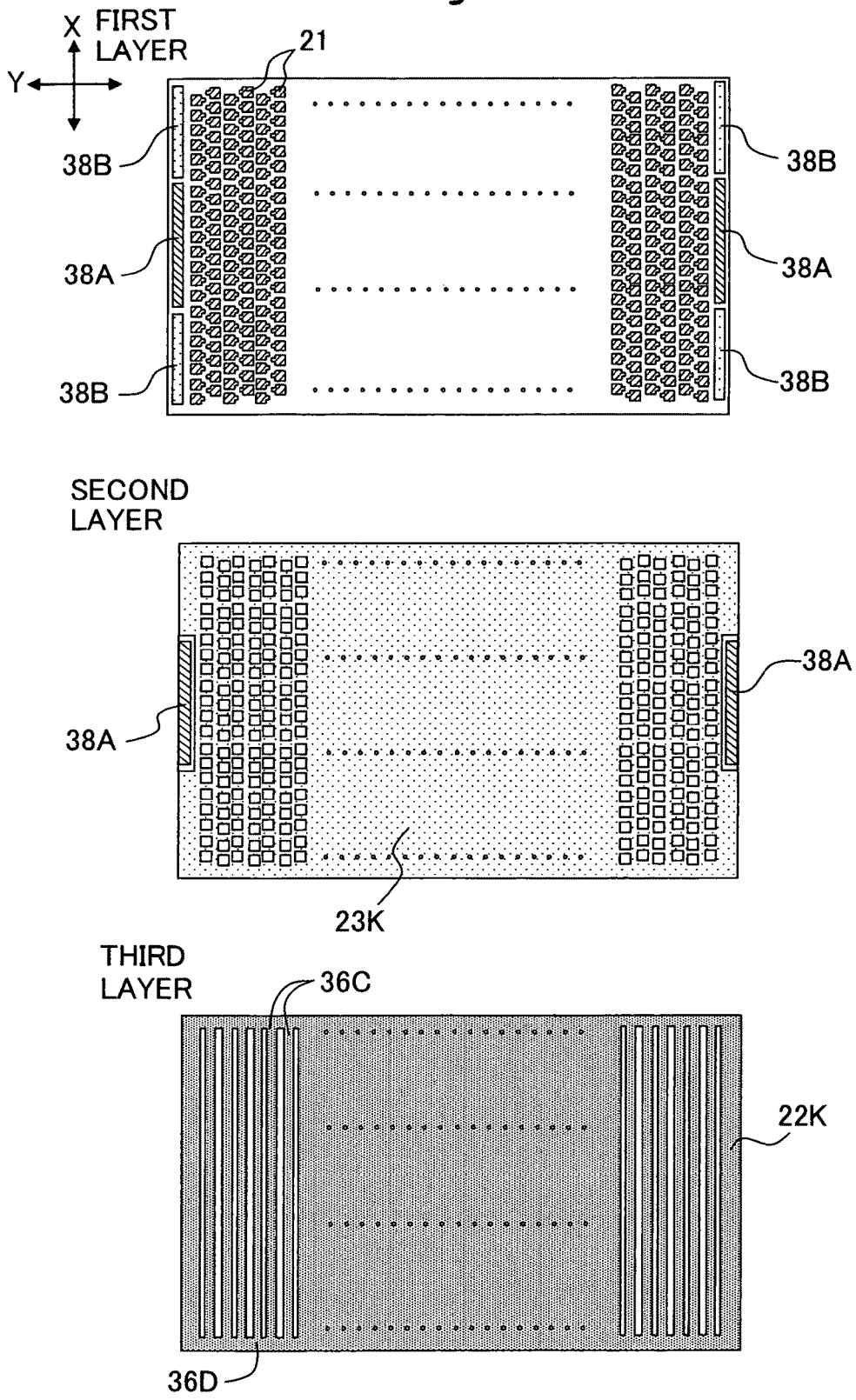
FIG. 67 is a view showing electrode patterns on the piezoelectric material layers respectively.

Further, as shown in FIG. 67, for connection of wirings to the first and second common constant potential electrodes 22K, 23K, connection terminals 38A are formed at centers of end portions of the actuator on the upper surface side of the piezoelectric material layer 12*a*, and connection terminals 38B are formed on both sides of the end portions. The connection terminals 38A are connected to the first common constant potential electrode 22K via through holes filled with conductive materials, and the connection terminals 38B are connected to the second common constant potential electrode 23K via through holes filled with conductive materials.

Figure 64:
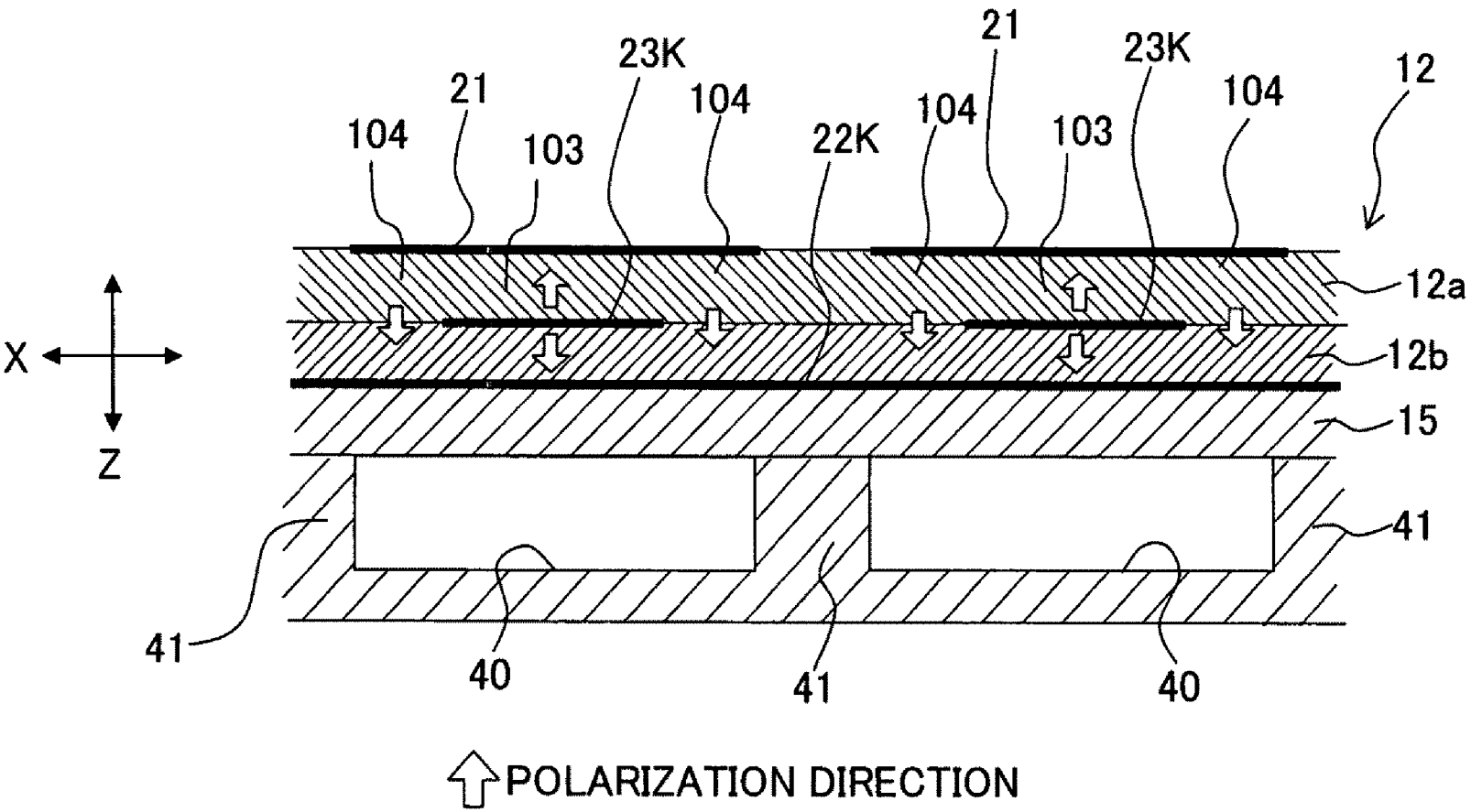
FIG. 64 is a cross-sectional view showing arrangements of electrodes on piezoelectric material layers of a piezoelectric actuator of the fourteenth embodiment.

Note that as shown in FIG. 64, the first active portions 103 are polarized in the same direction (polarization direction) as the direction of the electric field caused by the applied voltage when second potential (ground potential) is applied to the individual electrodes 21 and first potential (positive potential) is applied to the second common constant potential electrode 23K for deformation. On the other hand, the second active portions 104 are polarized in the same direction as the direction of the electric field caused by the applied voltage when the first potential is applied to the individual electrodes 21 and the second potential is applied to the first common constant potential electrode 22K for deformation. That is, during an ink jetting operation, the directions of the electric field caused by the applied voltage and the polarization directions are the same.

The second common constant potential electrode 23K is always at the positive potential, and the first common constant potential electrode 22K is always at the ground potential. Then, to the individual electrodes 21, the positive potential and the ground potential are applied selectively for changing the volumes of the pressure chambers 40. That is, the direction of the electric field caused by the applied voltage is the same during polarization and during driving. The second common constant potential electrode 23K is always at the positive potential, the first common constant potential electrode 22K is always at the ground potential, and to the individual electrodes 21, the positive potential is applied or this application is released to change to the ground potential. Therefore, when the individual electrodes 21 are at the ground potential, the voltage is applied to the first active portions 103 but the voltage is not applied to the second active portions 104. On the other hand, when the positive potential is applied to the individual electrodes 21, the voltage is not applied to the first active portions 103, and the voltage is applied to the second active portions 104. Here, the voltage applied between electrodes during driving is smaller than the voltage applied during polarization, thereby suppressing deterioration due to repeated application of voltage between electrodes.

Since the electrodes 21, 22K, 23K are arranged as described above, when first the ground potential is applied by the voltage application mechanism to the individual electrodes 21 when jetting ink, the electric field in the first active portions 103 directs in the same direction as the polarization direction. Then, by piezoelectric lateral effect, first active portions 103 expand in the stacking direction Z (first direction) toward the pressure chambers 40 and contract in the directions X, Y (second directions) orthogonal to the stacking direction Z thereof, thereby turning to a standby state to project and deform in a direction (stacking direction Z) toward insides of the pressure chambers 40.

Subsequently, when the first potential (positive potential: 20 V) is applied to the individual electrodes 21, the first active portions 103 are in a state of not expanding/contracting, deforming in the stacking direction Z and the directions X, Y orthogonal thereto. At this time, the second active portions 104 are in a voltage applied state, and attempt to expand in the stacking direction Z (first direction) toward the pressure chambers 40 and contract in the two directions X, Y (second directions) orthogonal to the stacking direction Z. Thus, by the operation of the top plate 15 as a binding plate, the second active portions 104, 104 located at both side portions in the pressure chamber row direction X deform to bend in a direction to depart from the pressure chambers 40. This deformation of the second active portions 102 contributes to increasing of volumetric changes of the pressure chambers 40, and contributes to sucking of a large amount of ink from the manifolds 50 to the pressure chambers 40.

Then, when the ground potential is applied again to the individual electrodes 21, the first active portions 103 expand in the stacking direction Z toward the pressure chambers 40, contract in the directions X, Y orthogonal to the stacking direction Z, and thereby project and deform in the direction (stacking direction Z) toward the insides of the pressure chambers 40. Accordingly, the volumes of the pressure chambers 40 decrease, the pressure of ink increases, and the ink is jetted from the nozzle holes 16*a*.

When the ground potential is applied to the individual electrodes 21 and the first active portions 103 are driven to jet the ink, the individual electrodes 21 and the first common constant potential electrode 22K are both at the second potential, and the second active portions 104 turn to a non-application state of voltage. Thus, the second active portions 104 return to a state of not expanding/contracting (non-deform) in any one of the directions Z, X, Y. Therefore, when the first active portions 103 project and deform in the direction toward the pressure chambers 40, the second active portions 104 return to a state of not deforming (this is equivalent to contracting in the stacking direction Z and expanding in the two directions X, Y orthogonal to the stacking direction Z). Thus, the influence of deformation of the first active portions 103 is suppressed in a manner of being cancelled by deformation of the second active portions 104 and hardly reaches the pressure chambers 40 adjacent thereto in the pressure chamber row direction X and the direction Y orthogonal thereto, thereby suppressing crosstalk. That is, application and non-application of voltage to the second active portions 104 (second portions) are switched so as to suppress that deformation of the first active portions 103 (first portions) due to switching of application/non-application of voltage to the first active portions 103 propagates to the pressure chambers 40 adjacent to each other in both sides in the pressure chamber row direction X of the pressure chambers 40.

Thereafter, when the individual electrodes 21 are returned to the same potential (positive potential) as the second common constant potential electrode 23K, the first active portions 103 turn to a state of not deforming as described above, and the second active portions 104 deform to bend in a direction to depart from the pressure chambers 40. Thus, the ink is sucked into the pressure chambers 40 from the manifolds 50.

By such deformation of the first and second active portions 103, 104, jetting operation of ink is repeated, and volumetric changes of the pressure chambers 40 are made to be large in each jetting operation. Thus, jetting efficiency is increased, and crosstalk in the three directions is suppressed.

Figure 68:
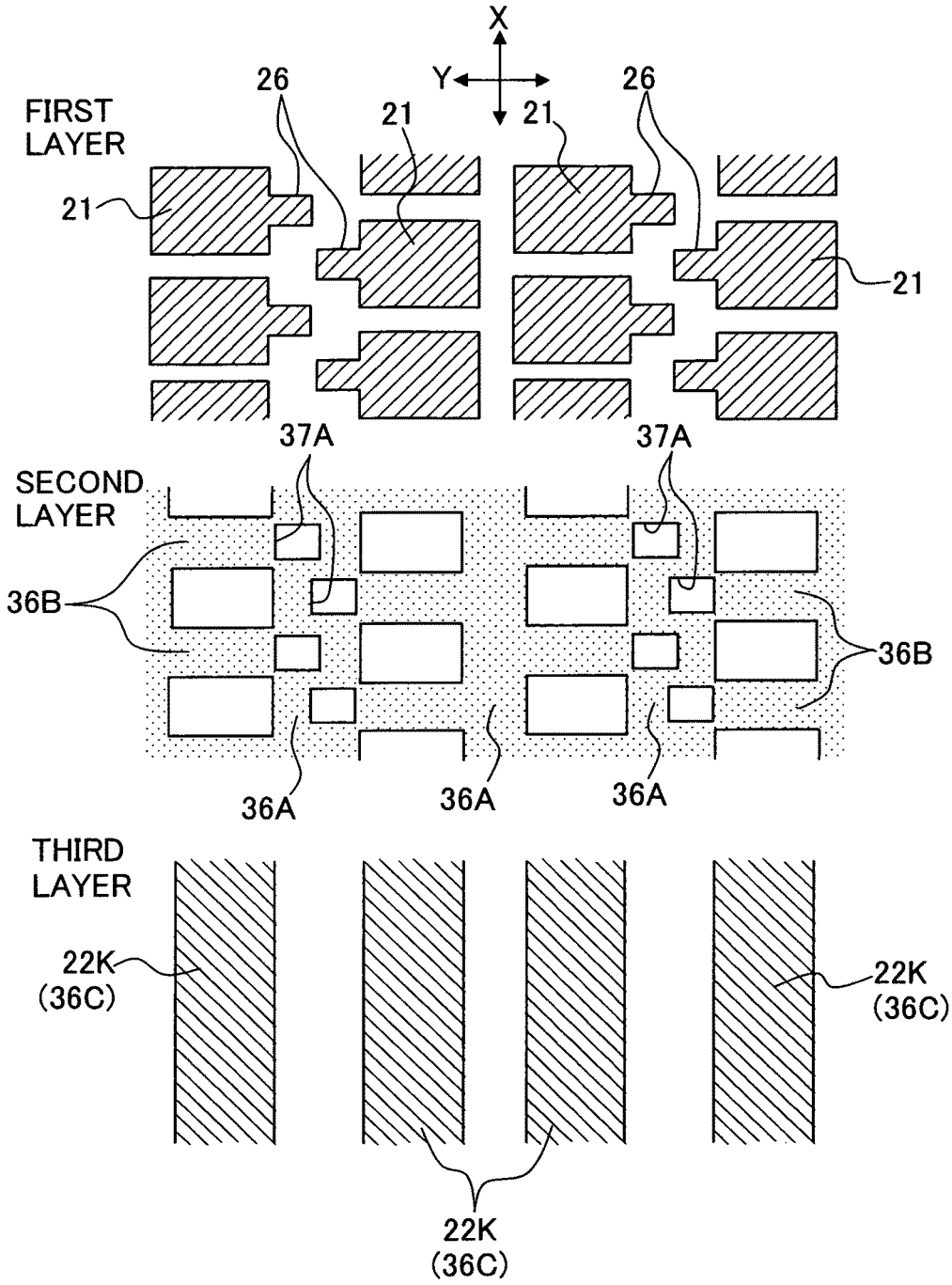
FIG. 68 is a view showing arrangements of electrodes on piezoelectric material layers respectively regarding a modification example of the fourteenth embodiment.
Figure 69:
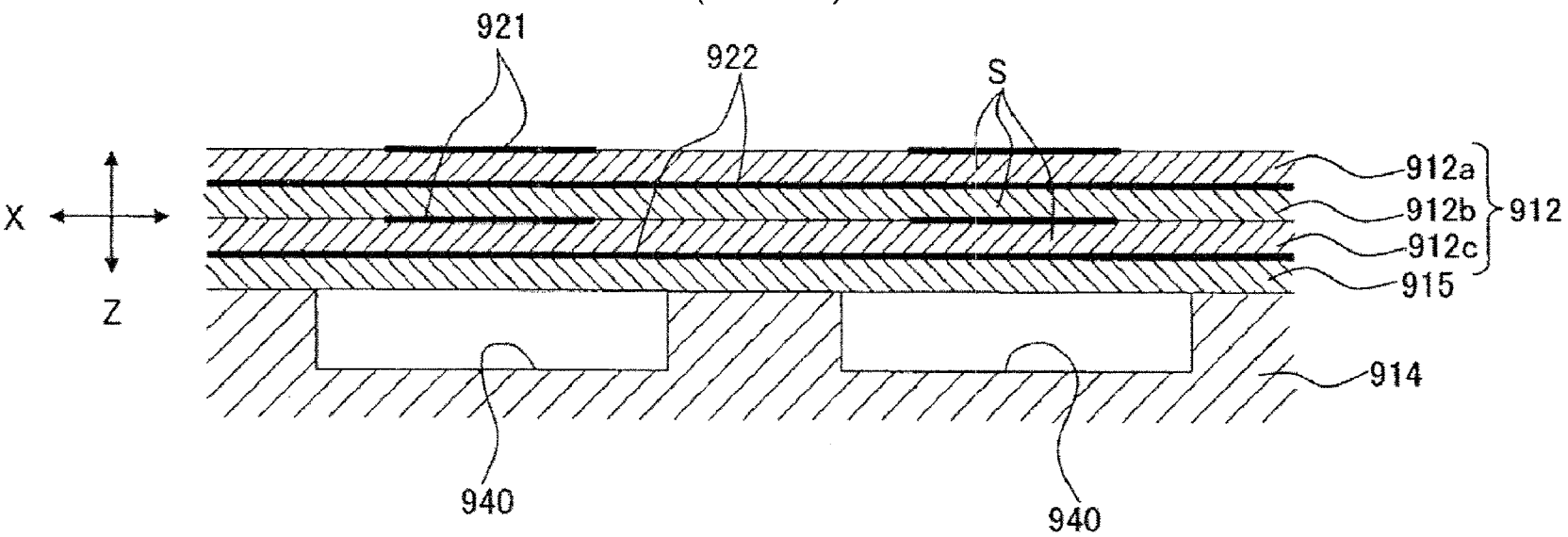
Fig. 69 (Prior Art)
FIG. 69 is a schematic cross-sectional view regarding a conventional example.
Figure 70:
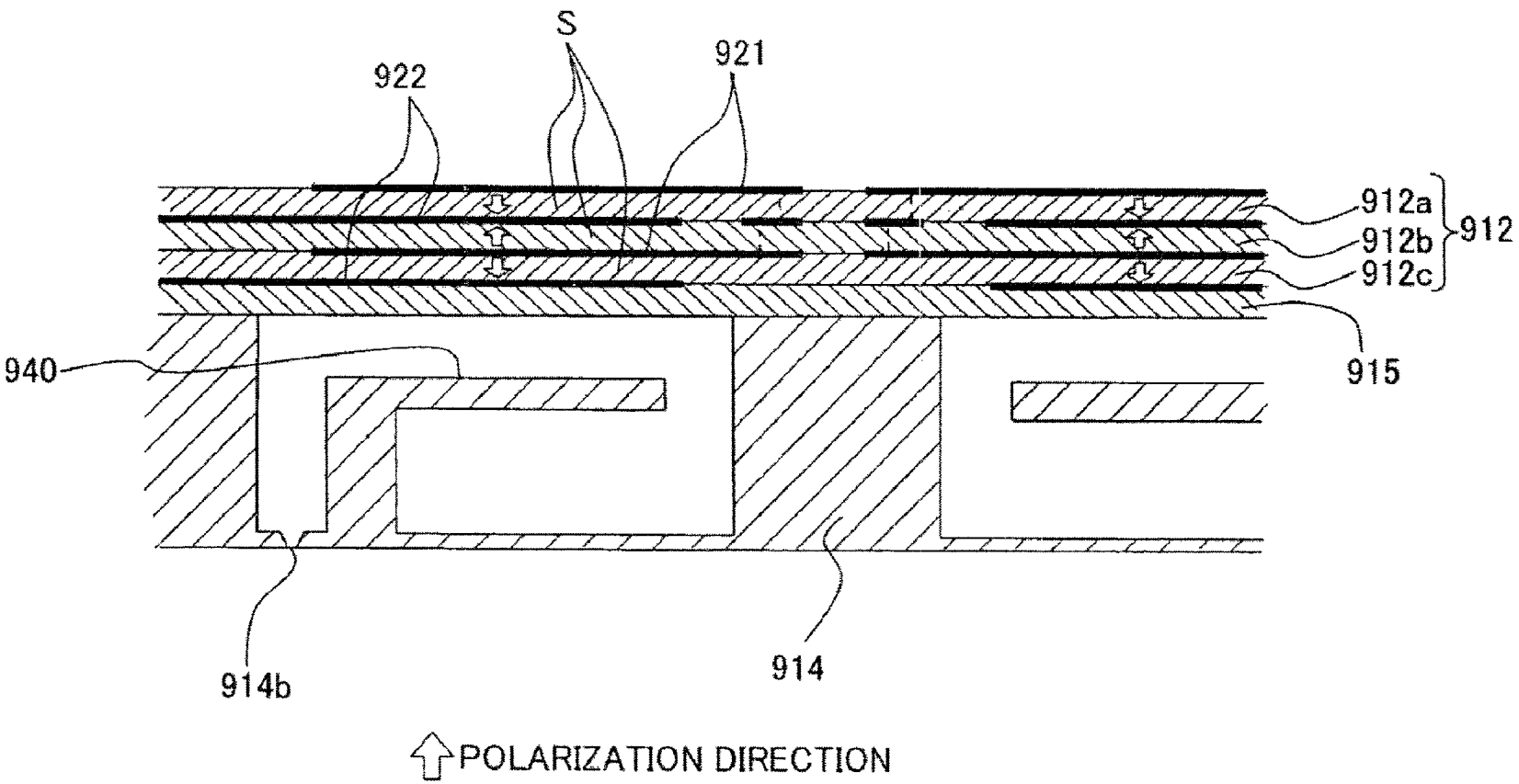
Fig. 70 (Prior Art)
FIG. 70 is an explanatory view showing a relationship among a polarization direction, portions which are effective during application of voltage, and portions which are effective during non-application of voltage regarding the conventional example.
Figure 71:
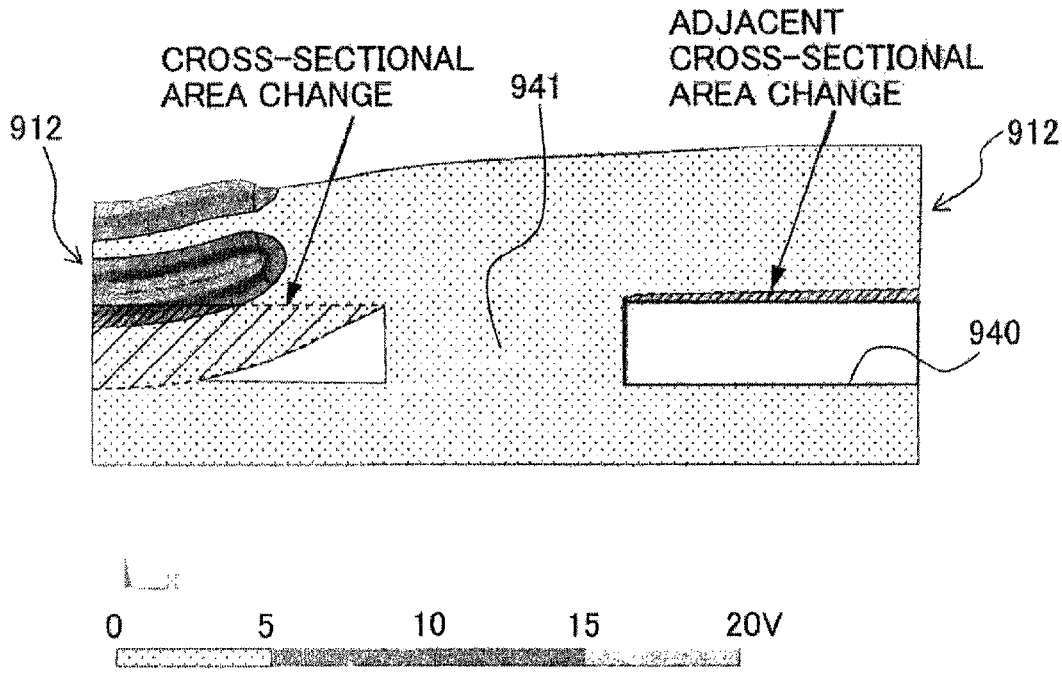
Fig. 71 (Prior Art)
FIG. 71 is an explanatory view showing volumetric changes of pressure chambers when applying voltage to active portions of the conventional example.

In the case of this embodiment, portions (piezoelectric material layer 12*a*) sandwiched, when seen in plan view, between the connection terminal portions 26 of the individual electrodes 21 which are arranged outside (beam portions 41) of the pressure chambers 40 and the second common constant potential electrode 23K also function as first active portions, and hence there is a fear that these portions operate in a direction of suppressing deformation of all the first active portions when jetting ink. Accordingly, as shown in FIG. 68, the second common constant potential electrode 23K can be structured such that, in a plan view, portions overlapping with the connection terminal portions 26 of the individual electrodes 21 are openings 37A (empty spaces). These openings 37A are formed in the first portions 36A.

Further, the second portions 36B of the second common constant potential electrode 23K are provided in the direction Y orthogonal to the pressure chamber row direction X, but having portions overlapping with the pressure chambers 40 will suffice. For example, the second portions may be provided along a direction V inclining with respect to the pressure chamber row direction X. When they are provided to incline in a direction orthogonal to a predetermined direction, third active portions can be provided on one side in the crossing direction V corresponding to the inclining direction, or the third and fourth active portions can be provided on both sides thereof.

It should be noted that, although a predetermined electric potential is always applied to the constant potential electrodes in the above-described embodiments, it is not necessary to always apply the electric potential. For example, a predetermined constant electric potential may be applied when the recording apparatus is performing printing operation, and it may be kept at the ground potential in other time. In this case, since the predetermined constant electric potential is not always applied, the power consumption of the liquid-droplet jetting apparatus can be reduced.

The above embodiments are explained for the case where the liquid-droplet jetting apparatus is an ink-jet type recording apparatus, but the present invention is not limited to this. It may also be applied to another liquid-droplet jetting apparatus for applying a colored liquid with micro liquid-droplets, for forming a wiring pattern by jetting electrically conductive liquid, or the like.

Further, as the recording medium, not only the recording paper but various kinds of materials such as resin, cloth, and the like can be applied, and as the liquid to be jetted, not only the ink but various kinds of liquids such as colored liquid, functional liquid, and the like can be applied.

What is claimed is:

1. A liquid-droplet jetting apparatus which jets droplets of a liquid, comprising:

a liquid-droplet jetting head including;

a cavity unit in which a plurality of pressure chambers arranged regularly are formed; and a piezoelectric actuator which is joined to the cavity unit to cover the pressure chambers and which jets the liquid in the pressure chambers selectively, the piezoelectric actuator having:

first active portions each corresponding to a center portion of one of the pressure chambers; and second active portions each corresponding to an outer peripheral portion, of one of the pressure chambers, which covers a portion located outside of the center portion of one of the pressure chambers; and a voltage application mechanism which applies a voltage to the piezoelectric actuator;

wherein the first active portions and the second active portions expand in a first direction toward the pressure chambers and contract in a second direction orthogonal to the first direction when the voltage is applied to the first and second active portions by the voltage application mechanism; and wherein the voltage application mechanism does not apply a second voltage to the second active portions when a first voltage is applied to the first active portions, and the voltage application mechanism applies the second voltage to the second active portions when the first voltage is not applied to the first active portions.

2. The liquid-droplet jetting apparatus according to claim 1;

wherein each of the second active portions covers an inside portion located inside an outer peripheral edge of one of the pressure chambers.

3. The liquid-droplet jetting apparatus according to claim 1;

wherein the piezoelectric actuator includes:

individual electrodes to which first potential and second potential different from the first potential are applied selectively;

first constant potential electrodes to which the first potential is applied; and second constant potential electrodes to which the second potential is applied;

wherein each of the first active portions includes a piezoelectric material sandwiched between one of the individual electrodes and one of the first constant potential electrodes; and wherein each of the second active portions includes a piezoelectric material sandwiched between one of the individual electrodes and one of the second constant potential electrodes.

4. The liquid-droplet jetting apparatus according to claim 3;

wherein the individual electrodes are formed across a first region corresponding to the first active portions and a second region corresponding to the second active portions of the piezoelectric actuator so as to cover the first and second regions;

wherein the first constant potential electrodes are formed to cover the first region of the piezoelectric actuator; and wherein the second constant potential electrodes are formed to cover the second region of the piezoelectric actuator.

5. The liquid-droplet jetting apparatus according to claim 3;

wherein the first active portions are polarized in a direction same as a direction of an electric field generated by the applied voltage when the second potential is applied to the individual electrodes and the first potential is applied to the first constant potential electrodes; and wherein the second active portions are polarized in a direction same as a direction of an electric field generated by the applied voltage when the first potential is applied to the individual electrodes and the second potential is applied to the second constant potential electrodes.

6. The liquid-droplet jetting apparatus according to claim 3;

wherein the first potential is a positive potential and the second potential is a ground potential.

7. The liquid-droplet jetting apparatus according to claim 3;

wherein the first potential is a ground potential and the second potential is a positive potential.

8. The liquid-droplet jetting apparatus according to claim 7;

wherein each of the second constant potential electrodes is common in two adjacent pressure chambers among the pressure chambers.

9. The liquid-droplet jetting apparatus according to claim 7;

wherein the piezoelectric actuator has a piezoelectric material layer; and wherein the individual electrodes are formed on a side of one surface of the piezoelectric material layer and the first constant potential electrodes and the second constant potential electrodes are formed on a side of the other surface of the piezoelectric material layer, and the first active portions and the second active portions are formed on the same piezoelectric material layer.

10. The liquid-droplet jetting apparatus according to claim 9;

wherein an insulating layer thinner than the piezoelectric material layer is provided to be sandwiched by the first constant potential electrodes and the second constant potential electrodes formed on the side of the other surface; and wherein first constant potential electrodes and the second constant potential electrodes are isolated by the insulating layer.

11. The liquid-droplet jetting apparatus according to claim 10;

wherein the insulating layer is formed of a material same as the piezoelectric material layer.

12. The liquid-droplet jetting apparatus according to claim 7;

wherein the first constant potential electrodes are formed to be sandwiched between adjacent two pressure chambers among the pressure chambers to form rows with the two adjacent pressure chambers; and wherein the second constant potential electrodes are formed only on one side of the two pressure chambers.

13. The liquid-droplet jetting apparatus according to claim 3;

wherein the piezoelectric actuator has a plurality of piezoelectric material layers;

wherein the first constant potential electrodes or the second constant potential electrodes are formed on a farthest surface not facing the pressure chambers, of a farthest layer, among the plurality of piezoelectric material layers, the farthest layer being located farthest from the pressure chambers;

wherein the individual electrodes are formed on a surface of one of the piezoelectric material layers, the surface being different from the farthest layer;

wherein surface electrodes which are to be input terminals to the individual electrodes, respectively, are formed in areas, of the farthest surface, overlapping with the outer peripheral portions; and wherein the individual electrodes are conducted to the surface electrodes via a conductive material filled in through holes penetrating the piezoelectric material layers.

14. The liquid-droplet jetting apparatus according to claim 13;

wherein the second active portions are formed on a layer other than the farthest layer among the plurality of piezoelectric material layers; and wherein each of the surface electrodes is formed in an area, on the farthest surface, overlapping with a portion between the adjacent pressure chambers.

15. A liquid-droplet jetting apparatus which jets droplets of a liquid, comprising:

a liquid-droplet jetting head including;

a cavity unit in which a plurality of pressure chambers arranged regularly are formed; and a piezoelectric actuator which is joined to the cavity unit to cover the pressure chambers and jets the liquid in the pressure chambers selectively, the piezoelectric actuator having;

first portions each located to correspond to a center portion of one of the pressure chambers; and second portions each located to correspond to an outer peripheral portion which covers a portion located outside of the center portion of one of the pressure chambers; and a voltage application mechanism which applies a voltage to the piezoelectric actuator;

wherein the voltage application mechanism is configured to switch application and non-application of a first voltage to the first portions so as to change a volume of each of the pressure chambers, and to switch application and non-application of a second voltage to the second portions so as to suppress that deformation of the first portions generated in a pressure chamber among the pressure chambers due to switching to the application of voltage to the first portions, propagates to another pressure chamber adjacent to the pressure chamber.

16. A liquid-droplet jetting head which jets droplets of a liquid, comprising:

a cavity unit in which a plurality of pressure chambers arranged regularly are formed; and a piezoelectric actuator which is joined to the cavity unit to cover the pressure chambers and jets the liquid in the pressure chambers selectively, the piezoelectric actuator having:

first active portions each corresponding to a center portion of one of the pressure chambers;

second active portions each corresponding to an outer peripheral portion, of one of the pressure chambers, which covers a portion located outside of the center portion of one of the pressure chambers;

individual electrodes formed across a first region corresponding to the first active portions and a second region corresponding to the second active portions so as to cover the first and second regions;

first constant potential electrodes formed to cover the first region; and second constant potential electrodes formed to cover the second region;

wherein the first active portions and the second active portions are polarized in a direction substantially parallel or anti-parallel to each other.

* * * * *